US006652079B2

(12) United States Patent
Tsuchii et al.

(10) Patent No.: US 6,652,079 B2
(45) Date of Patent: Nov. 25, 2003

(54) INK JET RECORDING HEAD WITH EXTENDED ELECTROTHERMAL CONVERSION ELEMENT LIFE AND METHOD OF MANUFACTURING THE SAME

(75) Inventors: Ken Tsuchii, Kanagawa (JP); Mineo Kaneko, Tokyo (JP); Masaki Oikawa, Kanagawa (JP); Ryoji Inoue, Kanagawa (JP); Kenji Yabe, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 65 days.

(21) Appl. No.: 09/947,059

(22) Filed: Sep. 6, 2001

(65) Prior Publication Data

US 2002/0063756 A1 May 30, 2002

(30) Foreign Application Priority Data

Sep. 6, 2000 (JP) ..... 2000-270222
Feb. 23, 2001 (JP) ..... 2001-048663

(51) Int. Cl.[7] ..... B41J 2/05; B41J 2/14; B41J 2/16; B41J 2/17

(52) U.S. Cl. ..... 347/65; 347/47; 347/94

(58) Field of Search ..... 347/20, 56, 61, 347/63, 65, 62, 67

(56) References Cited

U.S. PATENT DOCUMENTS

| | | | | |
|---|---|---|---|---|
| 4,502,060 A | | 2/1985 | Rankin et al. | 347/65 |
| 4,550,326 A | | 10/1985 | Allen et al. | 347/44 |
| 5,455,613 A | | 10/1995 | Canfield et al. | 347/65 |
| 5,734,399 A | | 3/1998 | Weber et al. | 347/65 |
| 5,793,393 A | | 8/1998 | Coven | 347/65 |
| 6,003,977 A | | 12/1999 | Weber et al. | 347/63 |
| 6,042,222 A | | 3/2000 | Moritz, III et al. | 347/65 |
| 6,053,599 A | * | 4/2000 | Maeda | 347/65 |
| 6,312,112 B1 | * | 11/2001 | Pietrzyk | 347/65 |
| 6,443,564 B1 | * | 9/2002 | Keil et al. | 347/65 |

FOREIGN PATENT DOCUMENTS

| | | | |
|---|---|---|---|
| EP | 0 303 350 | 2/1989 | B41J/3/04 |
| EP | 0 314 486 | 5/1989 | B41J/3/04 |
| EP | 0 691 204 A1 | 1/1996 | B41J/2/14 |
| EP | 0 792 744 | 9/1997 | B41J/2/14 |
| EP | 1 016 525 | 7/2000 | B41J/2/05 |

* cited by examiner

*Primary Examiner*—Juanita Stephens
(74) *Attorney, Agent, or Firm*—Fitzpatrick, Cella, Harper & Scinto

(57) ABSTRACT

An ink jet recording head that is capable of avoiding damages due to cavitation of an electrothermal converting element and thus extending its life is provided. The ink jet recording head comprises a plurality of ink discharge ports for discharging ink; a plurality of electrothermal converting elements provided to be associated with each of the ink discharge ports, respectively, for bubbling and discharging the ink; a plurality of pressure chambers for containing the electrothermal converting elements and providing spaces for heating and bubbling the ink; a common liquid chamber for supplying ink to the plurality of pressure chambers; and a plurality of ink flow paths for communicating the pressure chambers with the common liquid chamber. The ink flow paths are arranged such that central lines in a direction of ink supply to the pressure chambers are positioned offset from central lines of the electrothermal converting elements in the same direction.

36 Claims, 48 Drawing Sheets

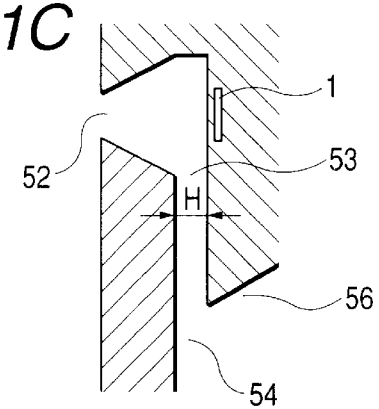
FIG. 1C
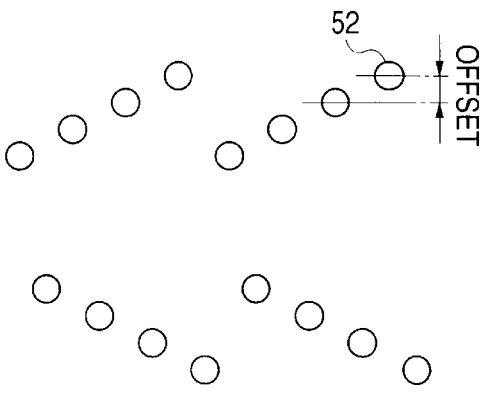
FIG. 1B
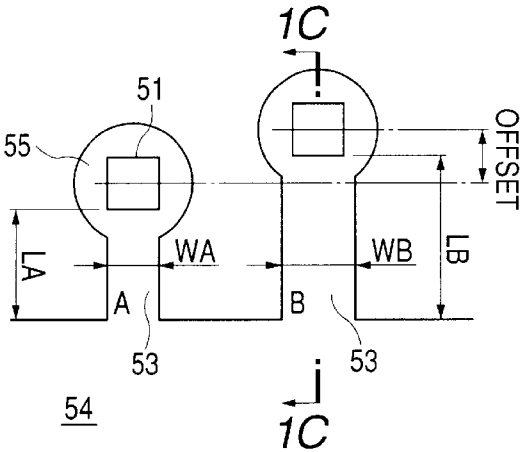
FIG. 1A
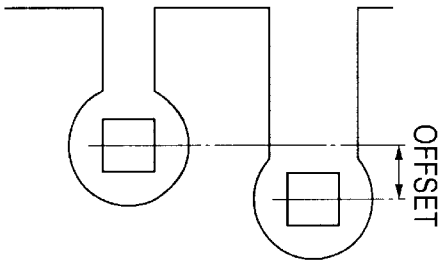

FIG. 12A1
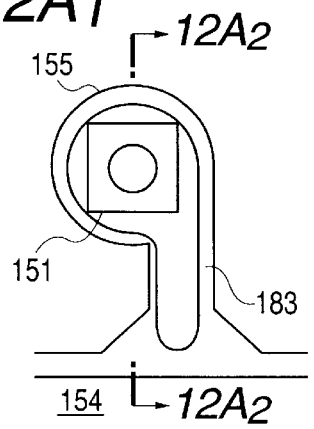
FIG. 12A2
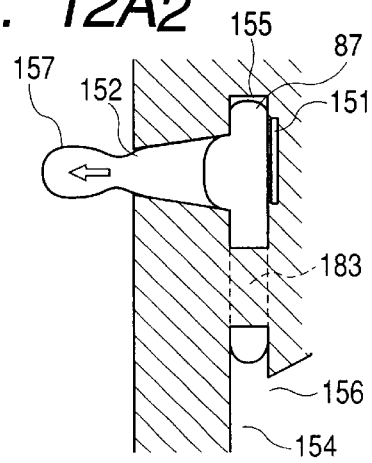
FIG. 12B1
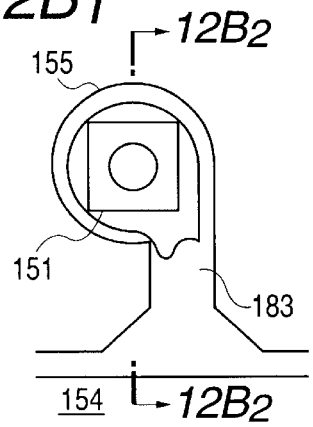
FIG. 12B2
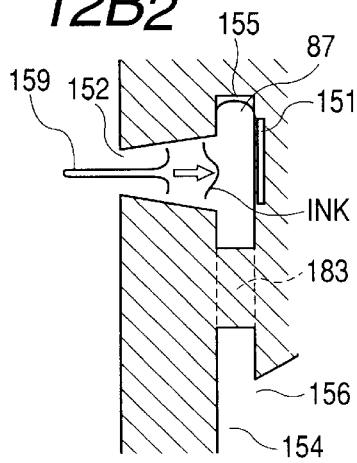
FIG. 12C1
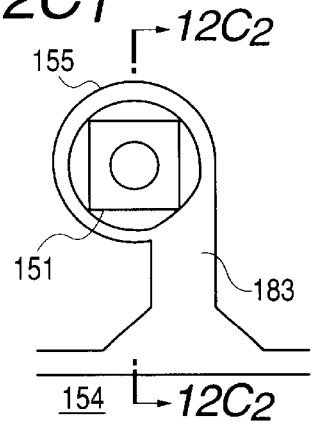
FIG. 12C2
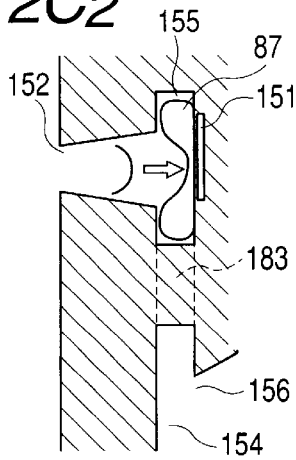

FIG. 13A3
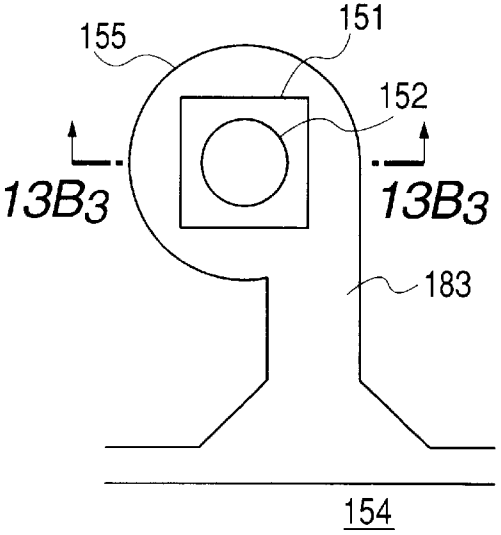
FIG. 13A2
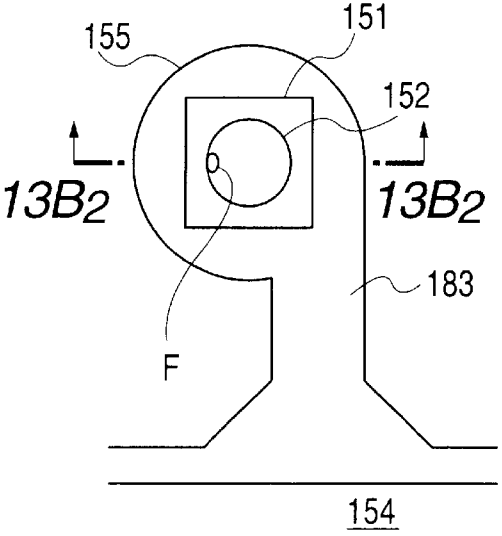
FIG. 13A1
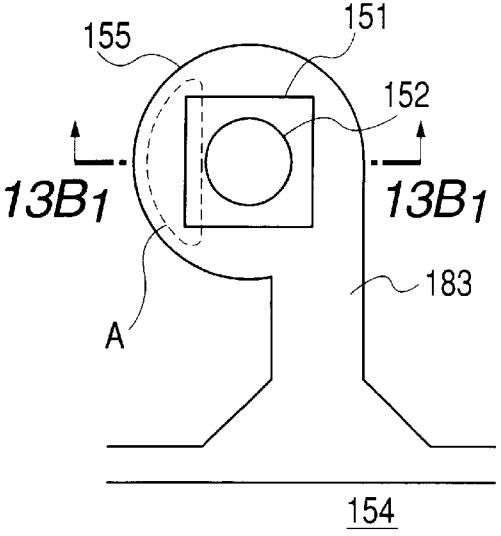

FIG. 13B3
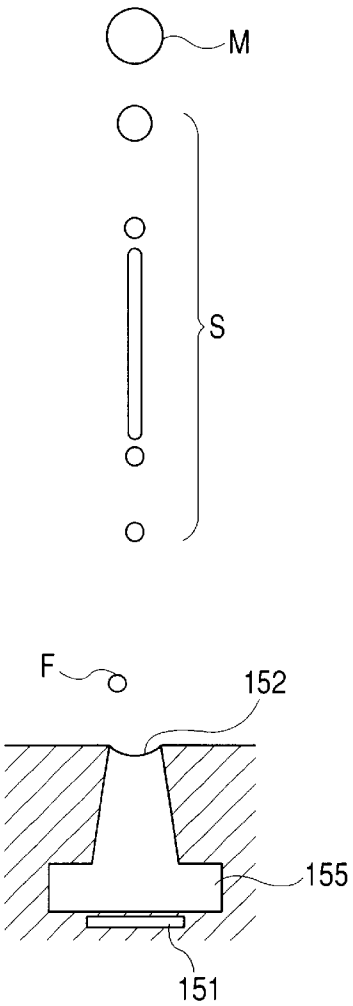
FIG. 13B2
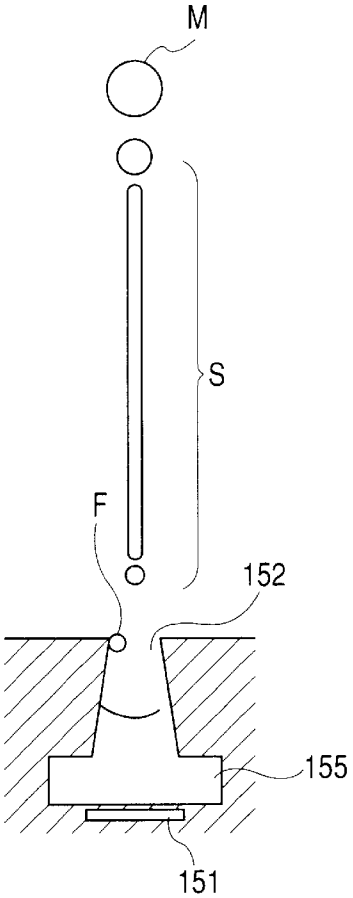
FIG. 13B1
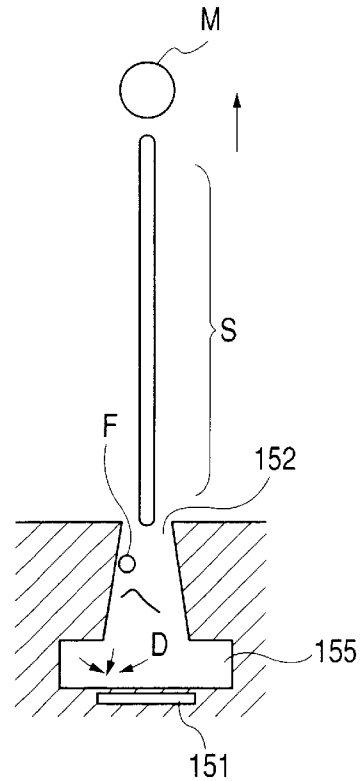

FIG. 14A1
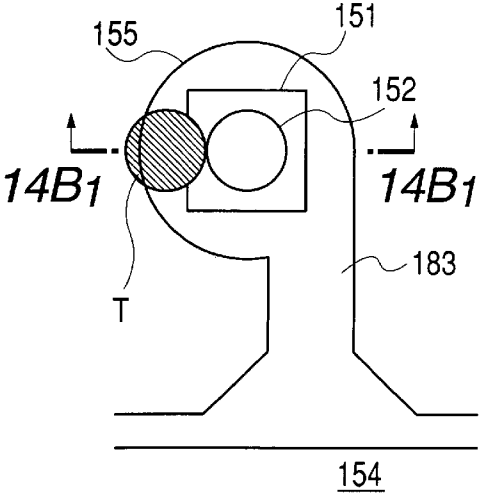
FIG. 14A2
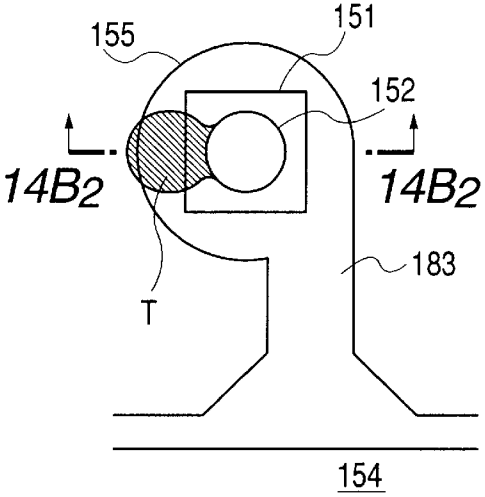
FIG. 14A3
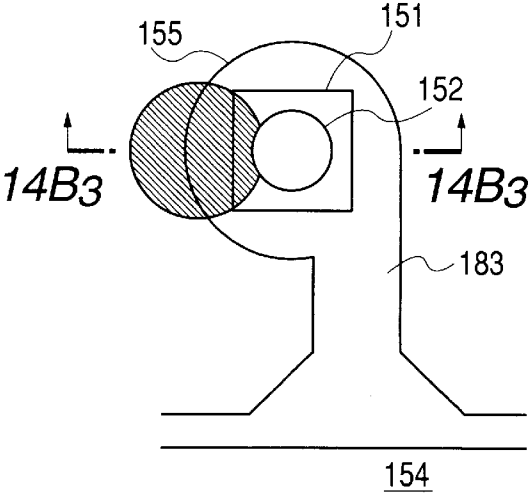

FIG. 14B3
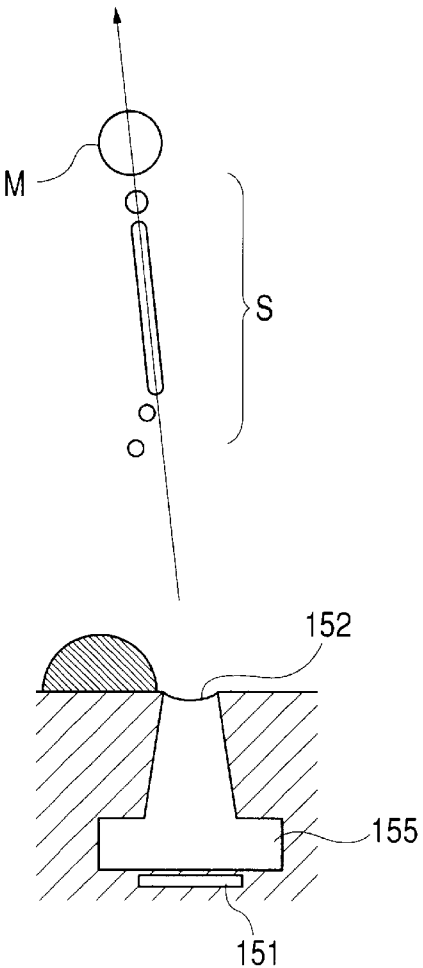
FIG. 14B2
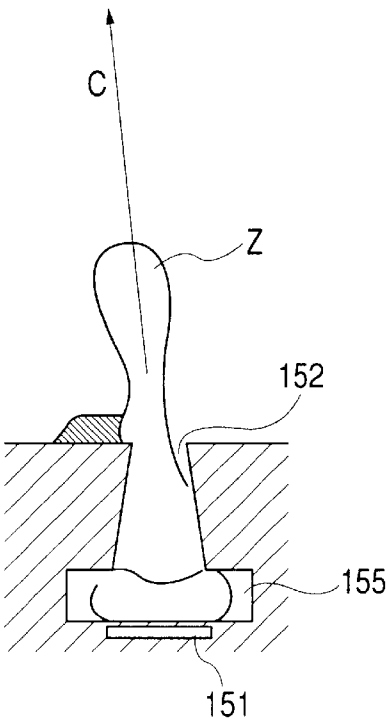
FIG. 14B1
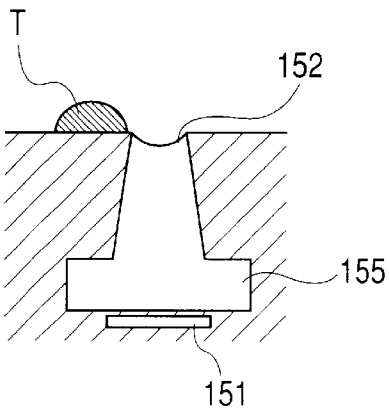

FIG. 17A3
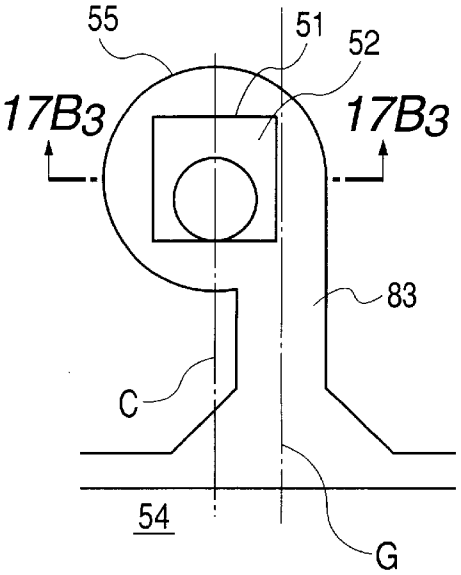
FIG. 17A2
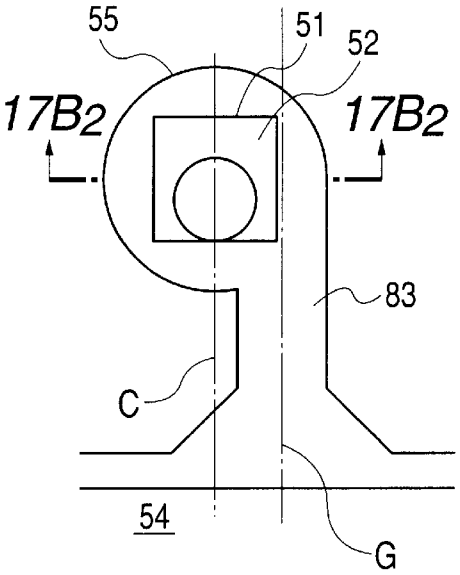
FIG. 17A1
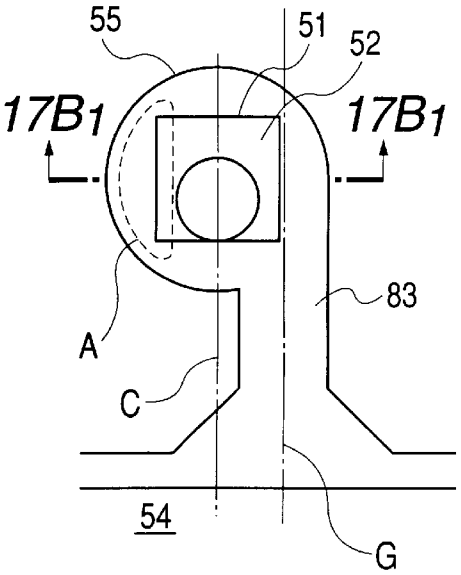

FIG. 17B3
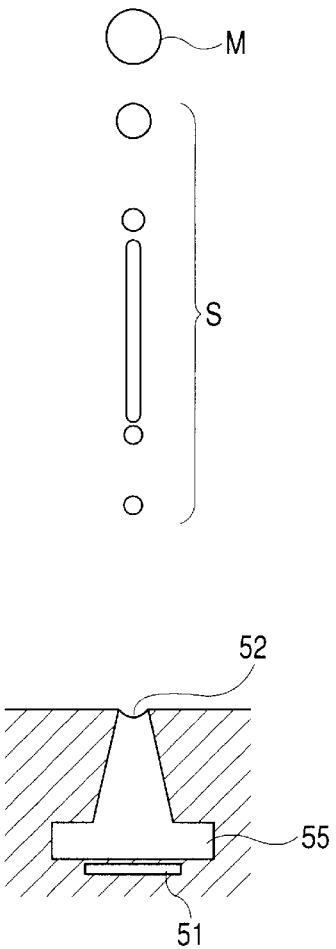
FIG. 17B2
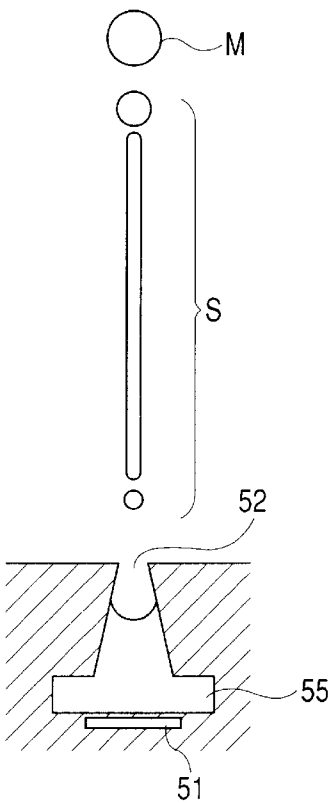
FIG. 17B1
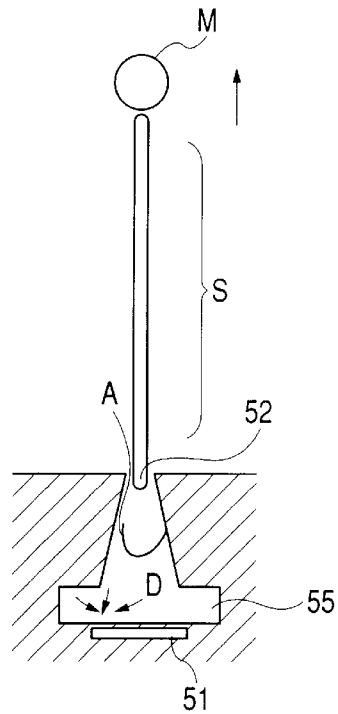

FIG. 19A1
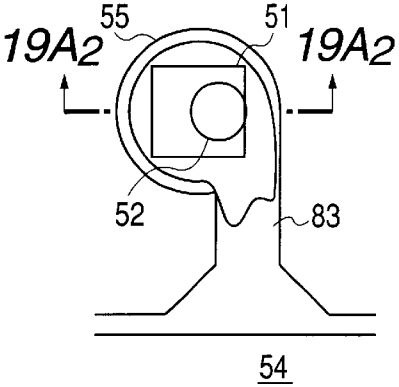
FIG. 19A2
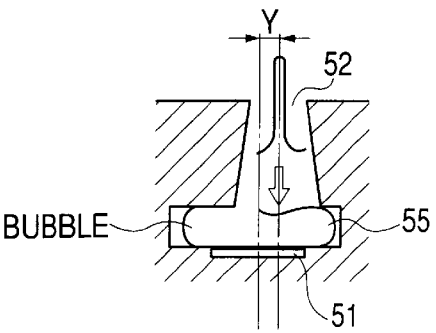
FIG. 19B1
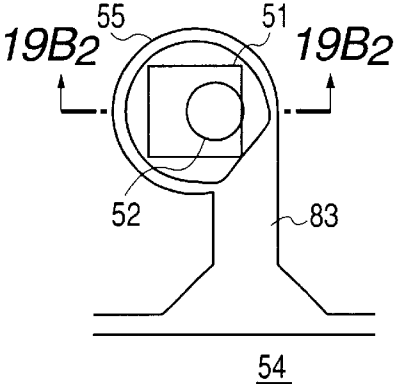
FIG. 19B2
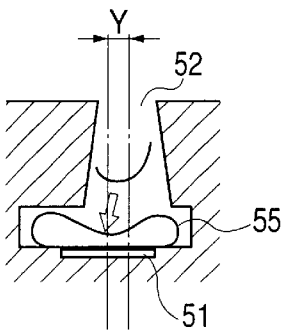
FIG. 19C1
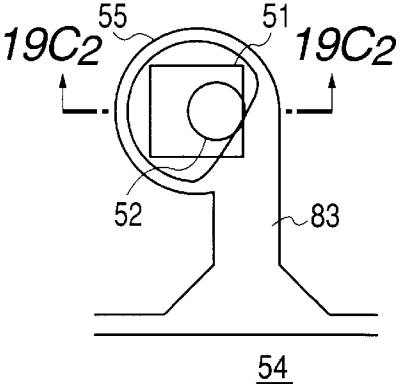
FIG. 19C2
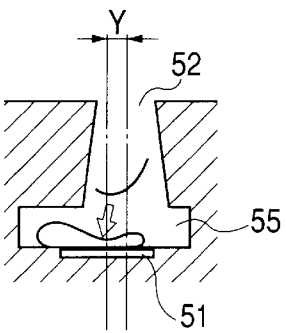

FIG. 20A3
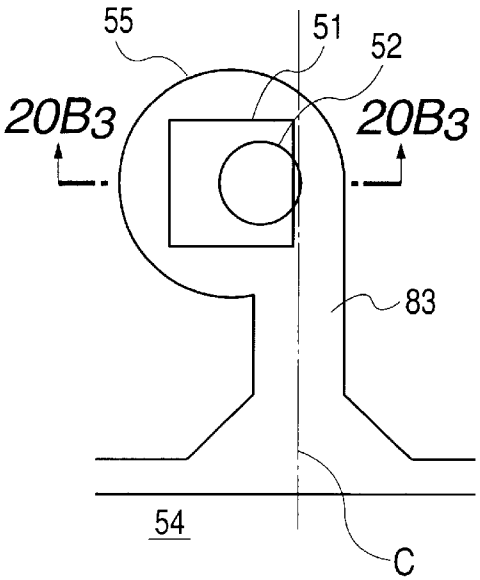
FIG. 20A2
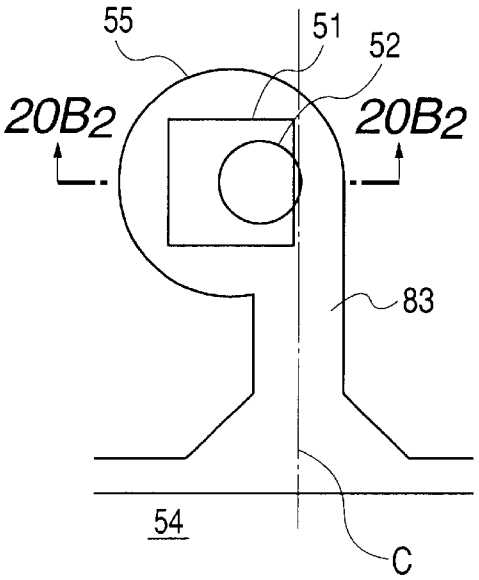
FIG. 20A1
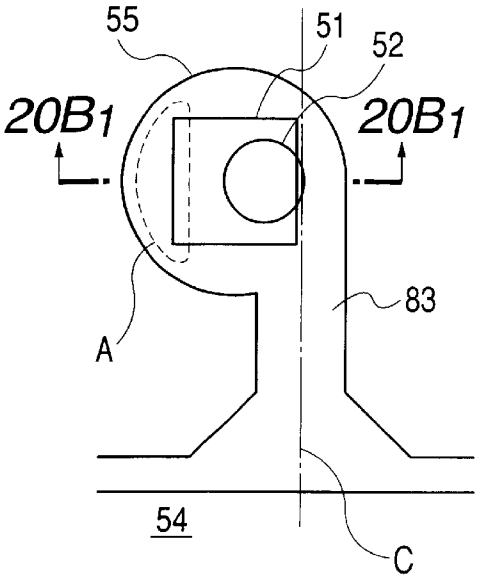

FIG. 20B3
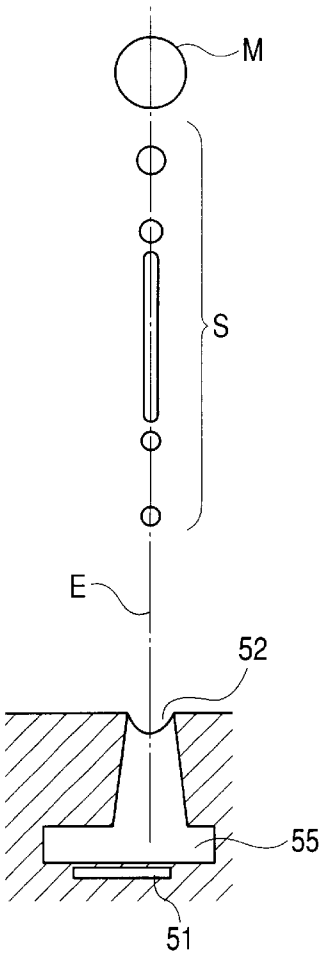
FIG. 20B2
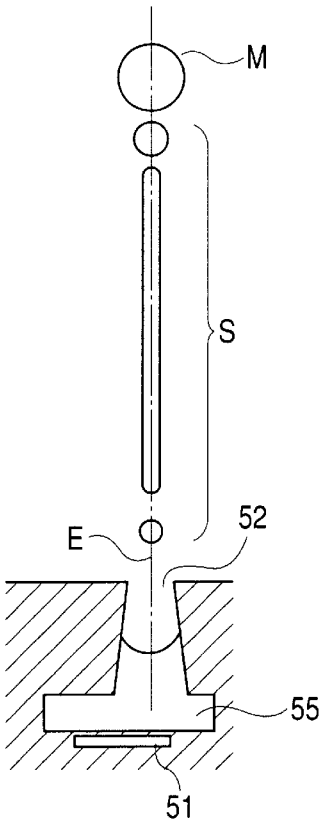
FIG. 20B1
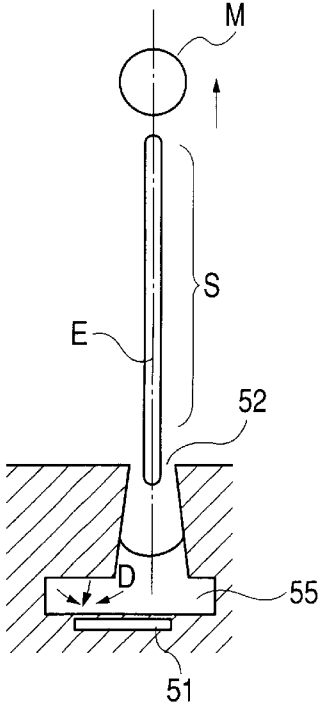

INK JET RECORDING HEAD WITH EXTENDED ELECTROTHERMAL CONVERSION ELEMENT LIFE AND METHOD OF MANUFACTURING THE SAME

BACKGROUND OF THE INVENTION

1. Field of the Invention

The present invention relates to an ink jet recording head, which is used in a recording apparatus for discharging recording liquid such as ink from a discharge port to form liquid droplets and perform recording operation, and a method of manufacturing the same. Incidentally, the ink jet recording head of the present invention can be applied to an apparatus such as a copying machine, a facsimile machine having a communication system and a wordprocessor having a printing unit in addition to a general printing apparatus, and further to an industrial recording apparatus that is compositely combined with various processing apparatuses.

2. Related Background Art

An ink jet recording apparatus is a recording apparatus of a so-called non-impact recording system and has a characteristic that it generates little noise at the time of printing and is capable of performing high-speed recording and recording on various recording media. Thus, the ink jet recording apparatus is widely employed as an apparatus for bearing a recording mechanism for a printer, a copying machine, a facsimile machine, a wordprocessor and the like.

As a representative ink discharge method in a recording head that is mounted in such an ink jet recording apparatus, there are known a method using an electromechanical transducing body such as a piezoelectric element, a method of irradiating an electromagnetic wave such as laser to cause ink to heat and discharging ink droplets by an action of the heating, a method of heating ink by an electrothermal conversion element having a heating resistor and discharging ink droplets by an action of film boiling, or the like.

Among these methods, the ink jet recording head using an electrothermal conversion element has an electrothermal conversion element provided in a recording liquid chamber, supplies an electric pulse being a recording signal to the element to cause it to heat, thereby giving thermal energy to ink, and utilizes a bubble pressure at the time of bubbling (boiling) of recording liquid caused then by phase change of the recording liquid to discharge ink liquid from a micro discharge port and record an image on a medium to be recorded. The ink jet recording head using an electrothermal conversion element generally includes a nozzle in which a discharge port for discharging ink droplets is opened, and an ink flow path and a common liquid chamber for supplying ink to this nozzle.

Such an ink jet recording head is usually mounted on a carriage of a recording apparatus main body. The recording apparatus main body includes conveying means for conveying a medium to be recorded such that it passes a position opposing a discharge port surface of the ink jet recording head mounted on the carriage. The carriage is configured to be movable in a direction perpendicular to a direction of conveying a medium to be recorded.

A recording operation in such a recording apparatus is performed by repeating main scanning for discharging ink at a predetermined period while moving the ink jet recording head and sub-scanning for conveying a medium to be recorded by a predetermined length.

FIGS. 45A and 45B are schematic views showing a nozzle part of a conventional ink jet recording head. FIG. 45A is a plan view showing a discharge port forming member in a transparent state and FIG. 45B is a sectional view cut along the line 45B—45B of FIG. 45A. Reference symbol G denotes a central line of an ink flow path.

The ink jet recording head shown in FIGS. 45A and 45B includes a common liquid chamber 154 connected to an ink supply port 156. On both sides of the common liquid chamber 154, a plurality of electrothermal conversion elements 151 for causing ink to bubble to discharge the ink and a plurality of circular pressure chambers 155 having centers in common with the electrothermal conversion elements 151 are provided side by side. An ink flow path 153 is provided between the common liquid chamber 154 and each pressure chamber 155. A discharge port 152 is opened in a position opposing each electrothermal conversion element 151.

In this ink jet recording head, positions in a printing direction (carriage moving direction) of sets of the discharge port 152 and the electrothermal conversion element 151 that are adjacent to each other are shifted from one another by an offset equivalent to a distance that a carriage (not shown) moves during a lagged time of driving timing between each driving block. For simplicity of illustration, in FIGS. 45A and 45B, an ink jet recording head in which four driving blocks are allocated to each nozzle is shown, and an arrangement of the discharge port 152 in a printing direction periodically changes for every four nozzles in a direction of a row of discharge openings.

Then, if numbers are given to the driving blocks in the ascending order from the one to be driven first, in the example shown in FIGS. 45A and 45B, a driving block 1 is allocated to the discharge port 152 at the upper right and the discharge port 152 apart from it by the number of nozzles of integer times of four, a driving block 2 is allocated to the discharge ports 152 on the left of them, a driving block 3 is allocated to the discharge ports 152 on the left of the driving block 2, and a driving block 4 is allocated to the discharge ports 152 on the left of the driving block 3. With such a configuration, the driving blocks 1 to 4 are sequentially driven in the ascending order, whereby it becomes possible to discharge ink and cause the ink discharged from these discharge ports 152 to be applied on a recording medium in one row.

In a nozzle of the configuration shown in FIGS. 45A and 45B, since a central line of an ink flow path 163 and a central line of the electrothermal conversion element 151 coincide with each other, a flow of ink heading to the pressure chamber 155 from the common liquid chamber 154 through the ink flow path 163 is generated in line symmetry with respect to the central line of the electrothermal conversion element 151. Thus, bubbles generated by heating the ink by the electrothermal conversion element 151 disappear steadily on the electrothermal conversion element 151 in symmetry with respect to its central line. Although bubble disappearance positions are dispersed to corners (four corners in total) of a heating area of the electrothermal conversion element 151 in some cases, each bubble disappearance position is fixed even in such cases.

When the bubbles disappear, an impact force due to collapse of cavitation is generated. In the nozzle structure in which bubble disappearance positions are stable as in the above-mentioned conventional art, since a specific part of the electrothermal conversion element 151 is subject to an impact force due to the collapse of cavitation, the electrothermal conversion element 151 is susceptible to damages and hense its durable life is shortened.

SUMMARY OF THE INVENTION

The present invention has been devised in view of the above-mentioned drawbacks of the prior art, and it is an object of the present invention to provide an ink jet recording head that is capable of avoiding damages due to cavitation of an electrothermal conversion element and thus extending its life.

In order to attain the above-mentioned object, an ink jet recording head according to the present invention is an ink jet recording head comprising: a plurality of ink discharge ports for discharging ink; a plurality of electrothermal conversion elements that are provided to be associated with each of the ink discharge ports, respectively, for bubbling and discharging the ink; a plurality of pressure chambers for containing the electrothermal conversion elements and providing spaces for heating and bubbling the ink; a common liquid chamber for supplying ink to the plurality of pressure chambers; and a plurality of ink flow paths for communicating the pressure chambers with the common liquid chamber, which is characterized in that the ink flow paths are arranged such that central lines in a direction of ink supply to the pressure chambers are offset from central lines of the electrothermal conversion elements in the same direction.

According to this configuration, when bubbles for discharging ink are caused to disappear, the bubbles are washed to a position deviating to sides of the electrothermal conversion element by a flow of the ink refill upon the bubble disappearance. Thus, final bubble disappearance can be performed in this position and an adverse influence on the electrothermal conversion element due to cavitation at the time of bubble disappearance can be reduced.

In particular, in an ink jet recording head having pressure chambers of a substantially cylindrical shape, an ink flow path is arranged in a position offset from a central line of an electrothermal conversion element, whereby final bubble disappearance can take place in a relatively wide area extending vertically in the vicinity of side edges of the pressure chamber to thereby disperse areas of cavitation generation to reduce the influence of cavitation.

Moreover, an ink discharge port is arranged such that its center is positioned offset from the center of the electrothermal conversion element, whereby a direction of a velocity vector at the time when ink, which remains between the discharge port and a bubble after the bubbling and discharging an ink droplet from the discharge port (hereinafter referred to as ink on the discharge port side), moves toward the electrothermal conversion element following contraction of a bubble at the time of bubble disappearance can be fluctuated unstably or the velocity vector may be slanted with respect to the electrothermal conversion element rather than being perpendicular thereto. Moreover, it becomes possible to cover a portion on which the ink on the discharge port side collides against the electrothermal conversion element by ink flowing in from the common liquid chamber side (hereinafter referred to as ink on the liquid chamber side) before the ink on the discharge port side collides against the electrothermal conversion element.

As a result, the bubble disappearance process ends without the ink on the discharge port side vertically colliding against a part of the electrothermal conversion element intensively. Therefore, the electrothermal conversion element is not subject to a strong impact force in the bubble disappearance process and is hardly susceptible to damages. As a result, it becomes possible to remarkably improve durability performance of the electrothermal conversion element.

In addition, the ink jet recording head may have a configuration in which the center of the ink discharge port is arranged at a position offset to the ink flow path side from the center of the electrothermal conversion element. Thus, a direction of a velocity vector at the time when the ink on the discharge port side moves toward the electrothermal conversion element following contraction of a bubble at the time of bubble disappearance can be fluctuated unstably or the velocity vector may be made to be slanted with respect to the electrothermal conversion element rather than being perpendicular thereto. Moreover, it becomes possible to cover a portion on which the ink on the discharge port side collides against the electrothermal conversion element by the ink on the liquid chamber side flowing in from the common liquid chamber side before the ink on the discharge port side collides against the electrothermal conversion element.

Furthermore, it is preferable that the ink jet recording head has a configuration in which an amount of offset in the ink discharge port is 1 to 10 $\mu$m. More preferably, the amount of offset is 3 to 7 $\mu$m.

In addition, the ink jet recording head may have a configuration in which the center of the electrothermal conversion element is arranged to be positioned offset from the center of the pressure chamber. Thus, it becomes possible to set an offset amount between the center of the discharge port and the center of the electrothermal conversion element large while holding an offset amount of the center of the discharge port form the center of the pressure chamber small. As a result, a discharge direction of ink liquid droplets is maintained appropriately and a bubble collection generated in the pressure chamber is suppressed, whereby it becomes possible to prevent an ink accumulation from being formed on an outside surface in the vicinity of the discharge port and to keep a grade of a recorded image high.

In the ink jet recording head of the present invention, a bubble tends to be driven to the outside of an edge of a part of the ink discharge port communicating to the pressure chamber in the bubble disappearance process. Thus, it is also preferable that the ink jet recording head has a configuration in which an area occupied by the electrothermal conversion element is included in an area surrounded by the edge of the part of the ink discharge port communicating to the pressure chamber when it is viewed on a plane parallel with the surface of the pressure chamber to which the ink discharge port communicates. That is, with such a configuration, a bubble disappearance can occur in an area outside the electrothermal conversion element more surely and the influence of cavitation on the electrothermal conversion element can be further reduced.

In the case of this configuration, it is preferable to provide a taper on the side surface of the ink discharge port such that the cross section area increases toward the pressure chamber side. In this way, the area occupied by the electrothermal conversion element can be included in the area surrounded by the edge of the part of the ink discharge port communicating to the pressure chamber while holding a size of an opening on an ink discharge surface of the ink discharge port small as desired.

Moreover, if the ink discharge port has a taper as described above, it is preferable that a distance from the edge of the opening on the ink discharge surface side of the ink discharge port to the edge of the electrothermal conversion element is substantially equal at an arbitrary position in a part where the area occupied by the electrothermal conversion element goes over the edge of the opening on the ink discharge surface side of the ink discharge port when it is viewed on a plane parallel to a surface of the pressure chamber to which the ink discharge port communicates. In this way, a taper angle can be minimized.

In addition, if the center of the ink discharge port is arranged to be positioned offset from the center of the electrothermal conversion element, the ink discharge port preferably has a shape long in the direction offset from the electrothermal conversion element. In this case, the ink discharge port may be any of rectangular, ellipse or oval shape. In this way, the area occupied by the electrothermal conversion element can be included in the area surrounded by the edge of the part of the ink discharge port communicating to the pressure chamber while holding the size of the ink discharge port or its taper angle minimum.

In addition, the ink discharge port preferably has a shape long in the direction in which wiring for supplying electric power to the electrothermal conversion element is connected. In this case, the ink discharge port may be any of rectangular, ellipse or oval shape. According to this configuration, a connection part of the electrothermal conversion element and the wiring can be included in the area surrounded by the edge of the part of the ink discharge port communicating to the pressure chamber. Therefore, the influence of cavitation on the connection part can be reduced.

In addition, it is preferable that the ink jet recording head has a configuration in which the offset direction of the ink flow path from the central line of the electrothermal conversion element is the same for the plurality of ink flow paths arranged in one row. With this configuration, even if a position of formation of a member forming the ink flow path and the pressure chamber deviates from its original position due to production variance, a relative position of the ink flow path with respect to the electrothermal conversion element and the discharge port deviates similarly for any of a plurality of nozzles, whereby it becomes possible to make deviation not to occur in the ink discharge amount or the ink discharge direction among the plurality of nozzles and to make adverse influence on a formed image not to occur so frequently.

Similarly, it is preferable that the ink jet recording head has a configuration in which the ink flow path is formed in two rows side by side, opposingly on both sides of the common liquid chamber and the offset direction of the ink flow path belonging to the opposing ink flow path rows from the central line of the electrothermal conversion element is line symmetry with respect to a line parallel with a row direction of the opposing ink flow path rows.

In addition, in the ink jet recording head of the present invention, a flow resistance is made substantially equal in the plurality of ink flow paths with different lengths, whereby a refill property of the plurality of ink flow paths can be made substantially the same.

It is desirable to keep a difference of the flow resistances in the plurality of ink flow paths within 10% such that a satisfactory image with substantially no unevenness of density can be formed by making the refill property of the plurality of ink flow paths substantially the same and making a discharge amount of ink from the plurality of nozzles substantially equal at the time when ink is continuously discharged at a predetermined frequency.

The flow resistance of the plurality of ink flow paths with different lengths can be made substantially equal as described above by varying cross section areas of the plurality of ink flow paths with different lengths. In order to change the cross section areas of the ink flow paths, it is sufficient to change widths or heights of the ink flow paths or provide a rib in at least any one of the plurality of ink flow paths.

In the ink jet recording head of the present invention, if an area, in which a flow resistance per a unit length is smaller than the flow resistance of an area in the discharge port side of the ink flow path, is provided in an area on the common liquid chamber side of the ink flow path, even if a width of the common liquid chamber or the like deviates from an original width due to production variance, it is possible to make the flow resistances of the plurality of ink flow paths substantially equal. That is, since the flow resistance of the entire ink flow path is a sum of the flow resistance of each part, the flow resistance of the ink flow path is generally determined by the flow resistance of an area on the discharge port side where the flow resistance is relatively large. Thus, even if a length of the ink flow path of the common liquid chamber having a relatively small flow resistance changes a little, the flow resistance of the entire ink flow path hardly changes.

The above-mentioned ink jet recording head with different lengths of the plurality of ink flow paths, in particular, allocates an electrothermal conversion element to a plurality of driving blocks and drives the electrothermal conversion element at timing staggered for each driving block. Thus, the ink jet recording head is typically used as an ink jet recording head in which the plurality of ink discharge ports are arranged offset in a printing direction, and the present invention can be preferably applicable to such an ink jet recording head.

A method of manufacturing an ink jet recording head according to the present invention is characterized by having a step for finding a flow resistance R of an ink flow path by expressions shown below and determining a shape of the ink flow path such that the flow resistances are equal in the plurality of ink flow paths based on the obtained flow resistance;

$$R = \eta \int_0^L \frac{D(x)}{S(x)^2}\, dx$$

$$D(x) = 12.0 \times \left(0.33 + 1.02 \times \left(\frac{a(x)}{b(x)} + \frac{b(x)}{a(x)}\right)\right)$$

where, x is a distance from the common liquid chamber;

S(x) is a cross section area of the ink flow path in a position of the distance x;

D(x) is a cross section coefficient of the ink flow path in the position of the distance x;

a(x) is a height of the ink flow path in the position of the distance x;

b(x) is a width of the ink flow path in the position of the distance x; and

η is an ink viscosity.

In addition, the method of manufacturing the ink jet recording head in accordance with the present invention may find the flow resistance R of the ink flow path by expressions shown below:

$$R = \eta \sum_{n=1}^{k} \frac{D(x_n)(x_n - x_{n-1})}{S(x_n)^2}$$

$$D(x_n) = 12.0 \times \left(0.33 + 1.02 \times \left(\frac{a(x_n)}{b(x_n)} + \frac{b(x_n)}{a(x_n)}\right)\right)$$

where, k is the number of division of the ink flow path;

xn is a distance to an nth divided position when the ink flow path is divided into k parts;

S(xn) is a cross section area of the ink flow path in the position of the distance xn from the common liquid chamber;

D(xn) is a cross section coefficient of the ink flow path in the position of the distance xn from the common liquid chamber;

a(xn) is a height of the ink flow path in the position of the distance xn from the common liquid chamber;

b(xn) is a width of the ink flow path in the position of the distance xn from the common liquid chamber; and $\eta$ is an ink viscosity.

In this case, it is preferable that the multiplications and the additions are performed along a path in which a main flow of ink is generated and S(x), S(xn), D(x) and D(xn) are obtained on a cross section perpendicular to the path.

Moreover, it is preferable to perform the multiplications and the additions over the path from the common liquid chamber to the center of the electrothermal conversion element.

BRIEF DESCRIPTION OF THE DRAWINGS

The accompanying drawings, which are incorporated in and constitute a part of the specification, illustrate embodiments of the invention and, together with the description, serve to explain the principles of the invention, in which:

FIGS. 1A, 1B and 1C are schematic views of a nozzle portion of an ink jet recording head of a first reference example, wherein FIG. 1A is a plan view showing a discharge port forming member in its removed state, FIG. 1B is a plan view of the discharge port forming member viewed from above it, and FIG. 1C is a sectional view cut along the line 1C—1C of FIG. 1A;

FIGS. 2A, 2B and 2C are schematic views of a nozzle portion of an ink jet recording head of a second reference example, wherein FIG. 2A is a plan view showing a discharge port forming member in its removed state, FIG. 2B is a plan view of the discharge port forming member viewed from above it and FIG. 2C is a sectional view cut along the line 2C—2C of FIG. 2A;

FIGS. 3A, 3B, and 3C are schematic views of a nozzle portion of an ink jet recording head of a third reference example, wherein FIG. 3A is a plan view showing a discharge port forming member in its removed state, FIG. 3B is a plan view of the discharge port forming member viewed from above it and FIG. 3C is a sectional view cut along the line 3C—3C of FIG. 3A;

FIGS. 4A and 4B are schematic views of a nozzle portion of an ink jet recording head of a first embodiment of the present invention, wherein FIG. 4A is a plan view showing a discharge port forming member in a state it is looked through and FIG. 4B is a sectional view cut along the line 4B—4B of FIG. 4A;

FIGS. 12$A_1$, 12$A_2$, 12$B_1$, 12$B_2$, 12$C_1$ and 12$C_2$ are views showing a cross section of the nozzle in each transition state extracted from the bubble disappearance process shown in FIGS. 11A to 11C;

FIGS. 13$A_1$, 13$B_1$, 13$A_2$, 13$B_2$, 13$A_3$ and 13$B_3$ are views showing a bubble disappearance process of an ink jet recording head of a comparative example with respect to the second embodiment, wherein FIGS. 13$A_1$, 13$A_2$ and 13$A_3$ are plan views showing a discharge port forming member in a state in which it is looked through and FIGS. 13$B_1$, 13$B_2$ and 13$B_3$ are sectional views cut along the lines 13$B_1$—13$B_1$, 13$B_2$—13$B_2$ and 13$B_3$—13$B_3$ of FIGS. 13$A_1$, 13$A_2$ and 13$A_3$;

FIGS. 14$A_1$, 14$B_1$, 14$A_2$, 14$B_2$, 14$A_3$ and 14$B_3$ are views showing an ink discharge process of the ink jet recording head of the comparative example with respect to the second embodiment, wherein FIGS. 14$A_1$, 14$A_2$ and 14$A_3$ are plan views showing the discharge port forming member in a state it is looked through and FIGS. 14$B_1$, 14$B_2$ and 14$B_3$ are sectional views cut along the lines 14$B_1$—14$B_1$, 14$B_2$—14$B_2$ and 14$B_3$—14$B_3$ of FIGS. 14$A_1$, 14$A_2$ and 14$A_3$;

FIGS. 15A, 15B, 15C, 15D, 15E and 15F are plan views showing a bubble disappearance process of a modified example of the second embodiment of the ink jet recording head of the present invention and showing a discharge port forming member in a state in which it is looked through;

FIG. 17$A_1$, 17$B_1$, 17$A_2$, 17$B_2$, 17$A_3$ and 17$B_3$ are views showing the ink discharge process in the ink jet recording head in FIGS. 15A to 15F, wherein FIGS. 17$A_1$, 17$A_2$ and 17$A_3$ are plan views showing the discharge port forming member in a state in which it is looked through and FIGS. 17$B_1$, 17$B_2$ and 17$B_3$ are sectional views cut along the lines 17$B_1$—17$B_1$, 17$B_2$—17$B_2$ and 17$B_3$—17$B_3$ of FIGS. 17$A_1$, 17$A_2$ and 17$A_3$;

FIGS. 19$A_1$, 19$A_2$, 19$B_1$, 19$B_2$, 19$C_1$ and 19$C_2$ are views showing a bubble disappearance process of a bubble after an ink liquid droplet is discharged from the nozzle of the ink jet recording head shown in FIGS. 18A and 18B;

FIGS. 20$A_1$, 20$B_1$, 20$A_2$, 20$B_2$, 20$A_3$ and 20$B_3$ are schematic views showing an ink discharge process of the ink jet recording head shown in FIGS. 18A and 18B, wherein FIGS. 20$A_1$, 20$A_2$ and 20$A_3$ are plan views showing a discharge port forming member in a state in which it is looked through and FIGS. 20$B_1$, 20$B_2$ and 20$B_3$ are sectional views cut along the lines 20$B_1$—20$B_1$, 20$B_2$—20$B_2$ and 20$B_3$—20$B_3$ of FIGS. 20$A_1$, 20$A_2$ and 20$A_3$;

FIGS. 24A, 24B, 24C, 24D, 24E and 24F are plan views showing a bubble disappearance process of the ink jet recording head of FIGS. 23A and 23B and showing a discharge port forming member in a state in which it is looked through;

DETAILED DESCRIPTION OF THE PREFERRED EMBODIMENTS

Figure 2C:
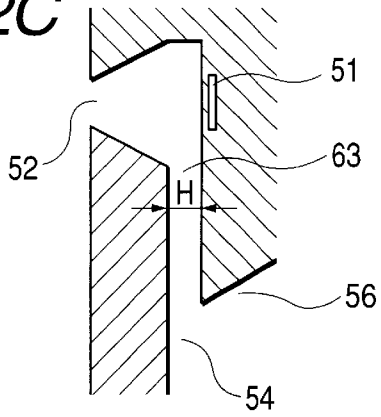

Preferred embodiments of the present invention will be hereinafter described with reference to the drawings.

In addition, in the accompanying drawings, like reference numerals and reference symbols designate the same or similar parts throughout the figures thereof.

(Configuration of a recording head cartridge)

FIGS. 28A and 28B through FIG. 35 are views illustrating relations among a preferred head cartridge, recording head and ink tank, respectively, in which the present invention is embodied or to which the present invention is applied. Each element will be described with reference to these figures.

Figure 28A:
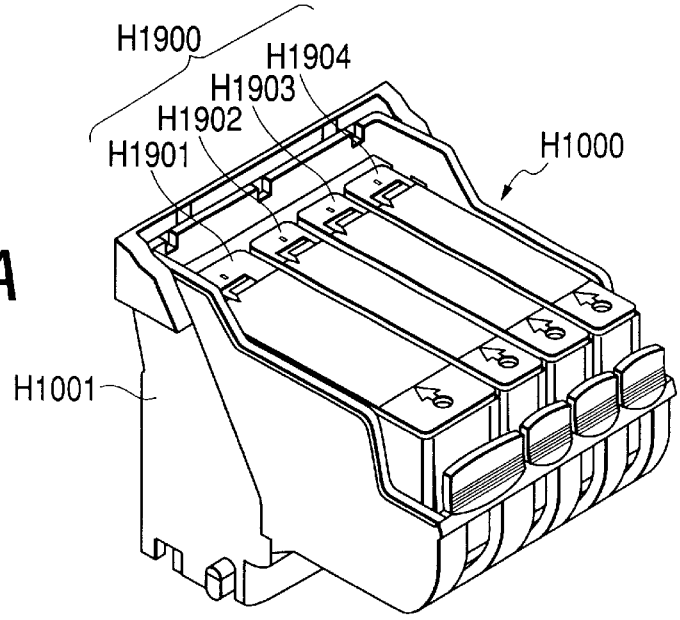
FIG. 28A is a perspective view of a preferred recording head cartridge on which the ink jet recording head of the present invention can be mounted.
Figure 28B:
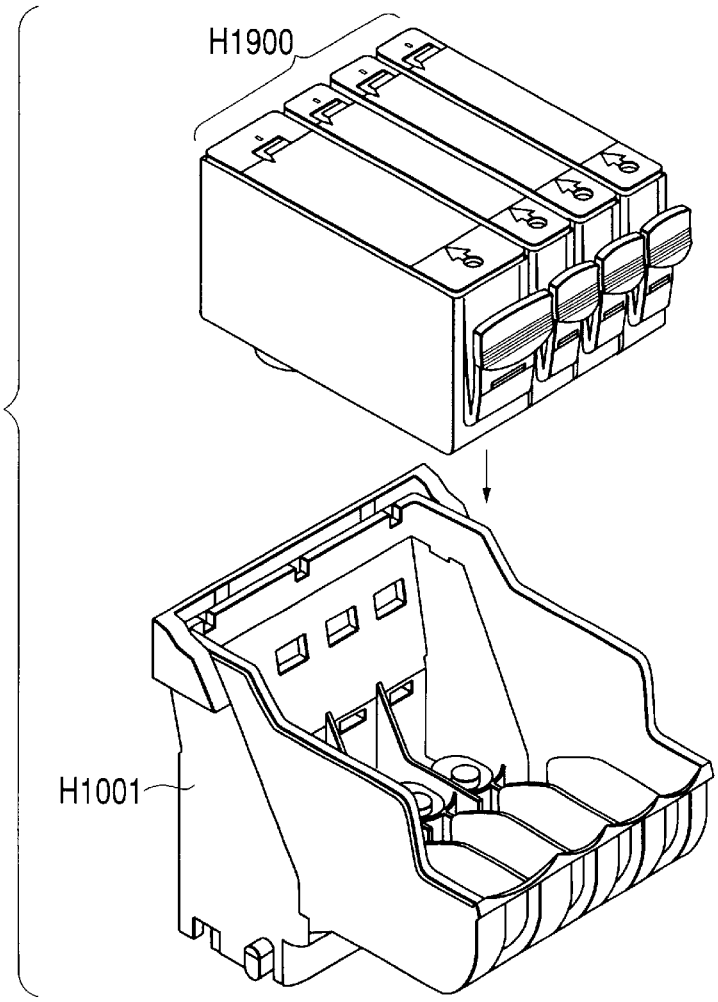
FIG. 28B is a disassembled perspective view of the head cartridge shown in FIG. 28A.

As it is seen from perspective views of FIGS. 28A and 28B, a recording head (ink jet recording head) H1001 of this embodiment is an element forming a recording head cartridge H1000. The recording head cartridge H1000 is composed of the recording head H1001 and ink tanks H1900 (H1901, H1902, H1903 and H1904) detachably provided in the recording head H1001. The recording head H1001 discharges ink (recording liquid), which is supplied from the ink tanks H1900, from a discharge port according to recording information.

This recording head cartridge H1000 is fixedly supported by positioning means and an electric contact of a carriage (not shown) mounted on an ink jet recording apparatus main body and is also detachably mountable on the carriage. The ink tank H1901 is for black ink, the ink tank H1902 is for cyan ink, the ink tank H1903 is for magenta ink and the ink tank H1904 is for yellow ink. Since each of the ink tanks H1901, H1902, H1903 and H1904 is detachably mountable on a sealing rubber H1800 side with respect to the recording head H1001 and is replaceable, running costs of printing in an ink jet recording apparatus are reduced.

Next, each of elements forming the recording head H1001 will be described in detail in order.

(1) Recording Head

The recording head H1001 is a recording head of a side shooter type of a bubble jet method that records an image using an electrothermal conversion element (recording element) for generating thermal energy for causing film boiling in ink according to an electric signal.

Figure 29:
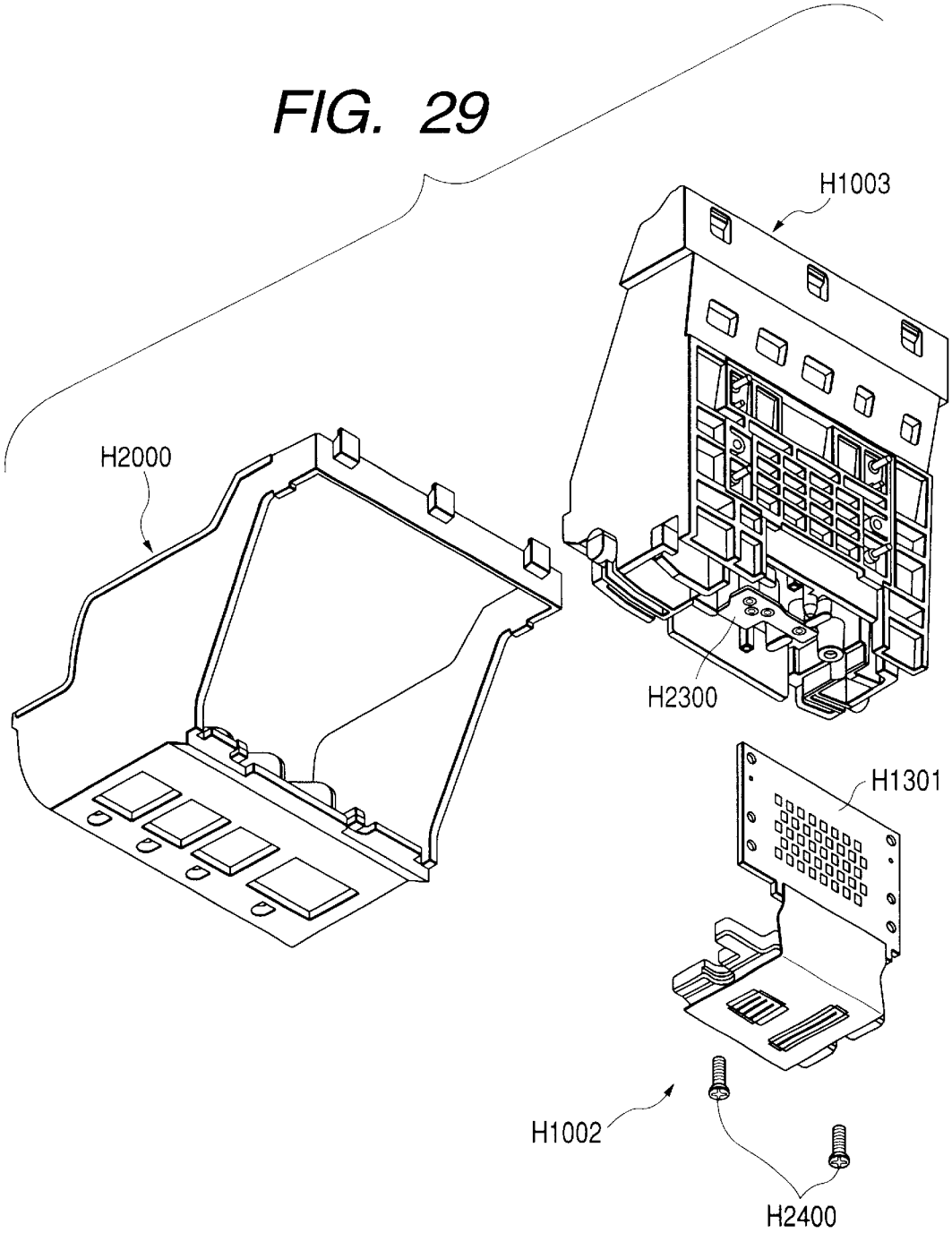
FIG. 29 is a disassembled perspective view showing a configuration of the ink jet recording head shown in FIGS. 28A and 28B.

As shown in a disassembled perspective view of FIG. 29, the recording head H1001 is composed of a recording element unit H1002, an ink supply unit H1003 and a tank holder H2000.

Figure 30:
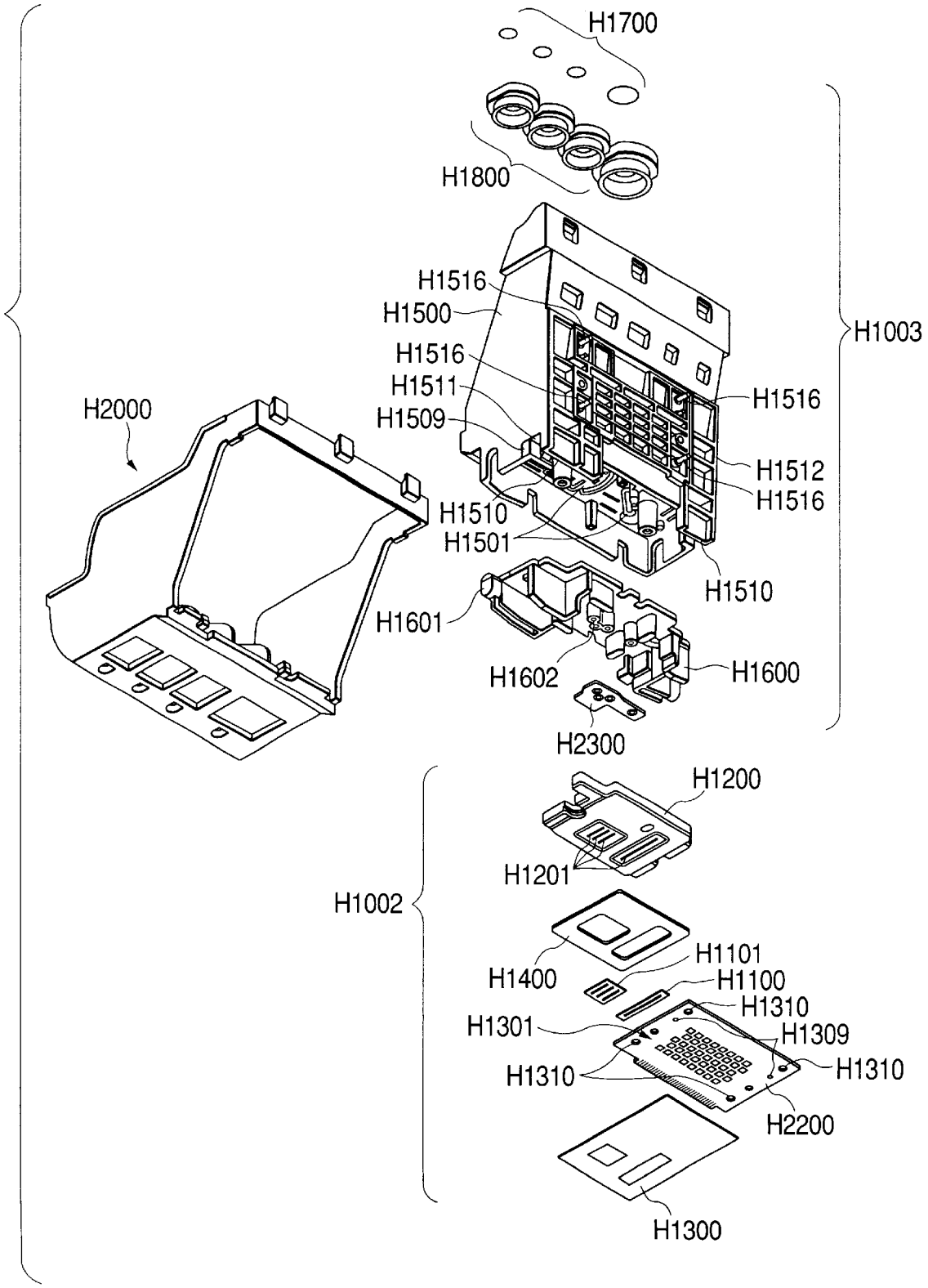
FIG. 30 is a disassembled perspective view showing the ink jet recording head shown in FIGS. 28A and 28B in a state in which it is further disassembled.

Moreover, as shown in a disassembled perspective view of FIG. 30, the recording element unit H1002 is composed of a first recording element substrate H1100, a second recording element substrate 1101, a first plate (first supporting member) H1200, an electric wiring tape (flexible wiring substrate) H1300, an electric contact substrate H2200 and a second plate (second supporting member) H1400. In addition, the ink supply unit H1003 is composed of an ink supply member H1500, a flow path forming member H1600, a joint sealing member H2300, a filter H1700 and a sealing rubber H1800.

(1-1) Recording Element Unit (Ink Jet Recording Head)

Figure 31:
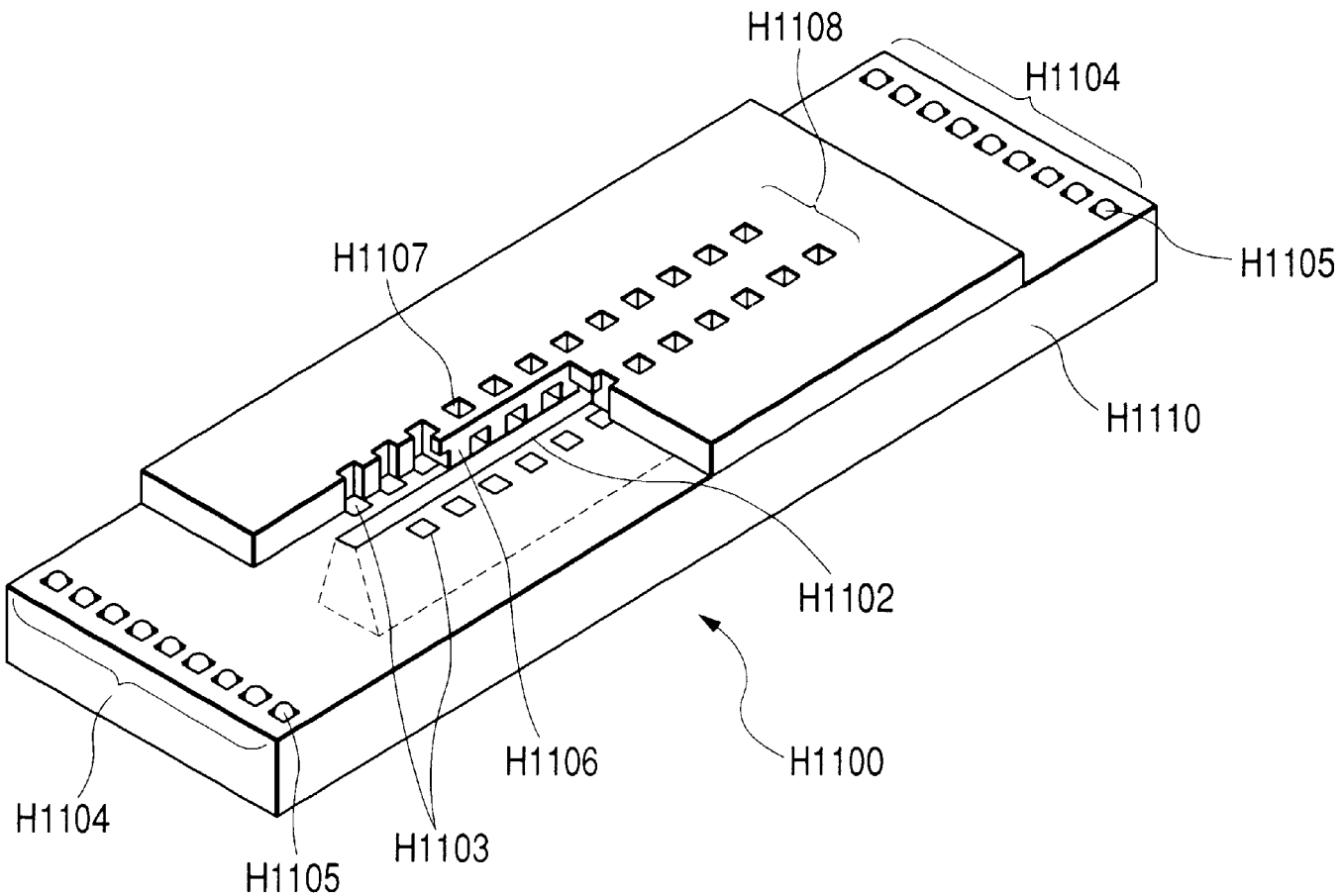
FIG. 31 is a partly cut-away illustrative perspective view showing a configuration of a recording element substrate of the recording head cartridge of FIGS. 28A and 28B.

FIG. 31 is a perspective view partly disassembled for illustrating a configuration of the first recording element substrate H1100. The first recording element substrate H1100 has a plurality of recording elements (electrothermal conversion elements) for discharging ink and an electric wiring made of Al or the like for supplying electric power to each electrothermal conversion element H1103 formed on one side of an Si substrate H1110 having the thickness of 0.5 to 1 mm by a film formation technology. Further, a plurality of ink flow paths and a plurality of discharge ports H1107 corresponding to the electrothermal conversion elements 1103 are formed by a photolithography technology, and an ink supply port H1102 for supplying ink to the plurality of ink flow paths is formed to open on the opposite side (back side). In addition, the recording element substrate H1100 is adhered and fixed to the first plate H1200, where the ink supply port 1102 is formed. Moreover, the second plate H1400 having an opening is adhered and fixed to the first plate H1200. The electric wiring tape H1300 is held to be electrically connected to the recording element substrate H1100 via the second plate H1400. This electric wiring tape H1300 is for applying an electric signal for discharging ink to the recording element substrate H1100 and has an electric wiring corresponding to the recording element substrate H1100 and an external signal input terminal H1301 that lies in this electric wiring portion and receives an electric signal from a printer main body. The external signal input terminal H1301 is positioned and fixed on the back side of the ink supply member H1500.

The ink supply port H1102 is formed by a method such as anisotropic etching utilizing a crystal orientation of Si or sandblast. That is, if the Si substrate H1110 has crystal orientations of <100> in the wafer surface direction and <111> in the thickness direction, etching can be progressed at an angle of approximately 54.7 degrees using the anisotropic etching by alkaline system (KOH, TMAH, hydrazine and the like). Thus, the etching is performed to a predetermined depth to form the ink supply port H1102 consisting of a long groove-like through-hole. The electrothermal conversions elements H1103 are arranged in zig-zag in one row each on both the sides of the ink supply port H1102. The electrothermal conversion elements H1103 and the electric wiring made of Al or the like supplying electric power to the electrothermal conversion element H1103 are formed by the film formation technology. Moreover, electrodes H1104 for supplying electric power to the electric wiring are arranged on both outer sides of the electrothermal conversion elements H1103. Bumps H1105 made of Au or the like are formed on the electrodes H1104 by a thermal ultrasonic compression bonding method. Further, an ink flow path wall H1106 and the discharge ports H1107 for forming ink flow paths corresponding to the electrothermal conversion elements H1103 are formed of a resin material by the photolithography technology, whereby a discharge port group H1108 is formed. Since the discharge ports H1107 are provided opposing the electrothermal conversion elements H1103, ink supplied from the ink supply port H1102 is discharged from the discharge ports H1107 by bubbles generated by a heating action of the electrothermal conversion elements H1103.

Figure 32:
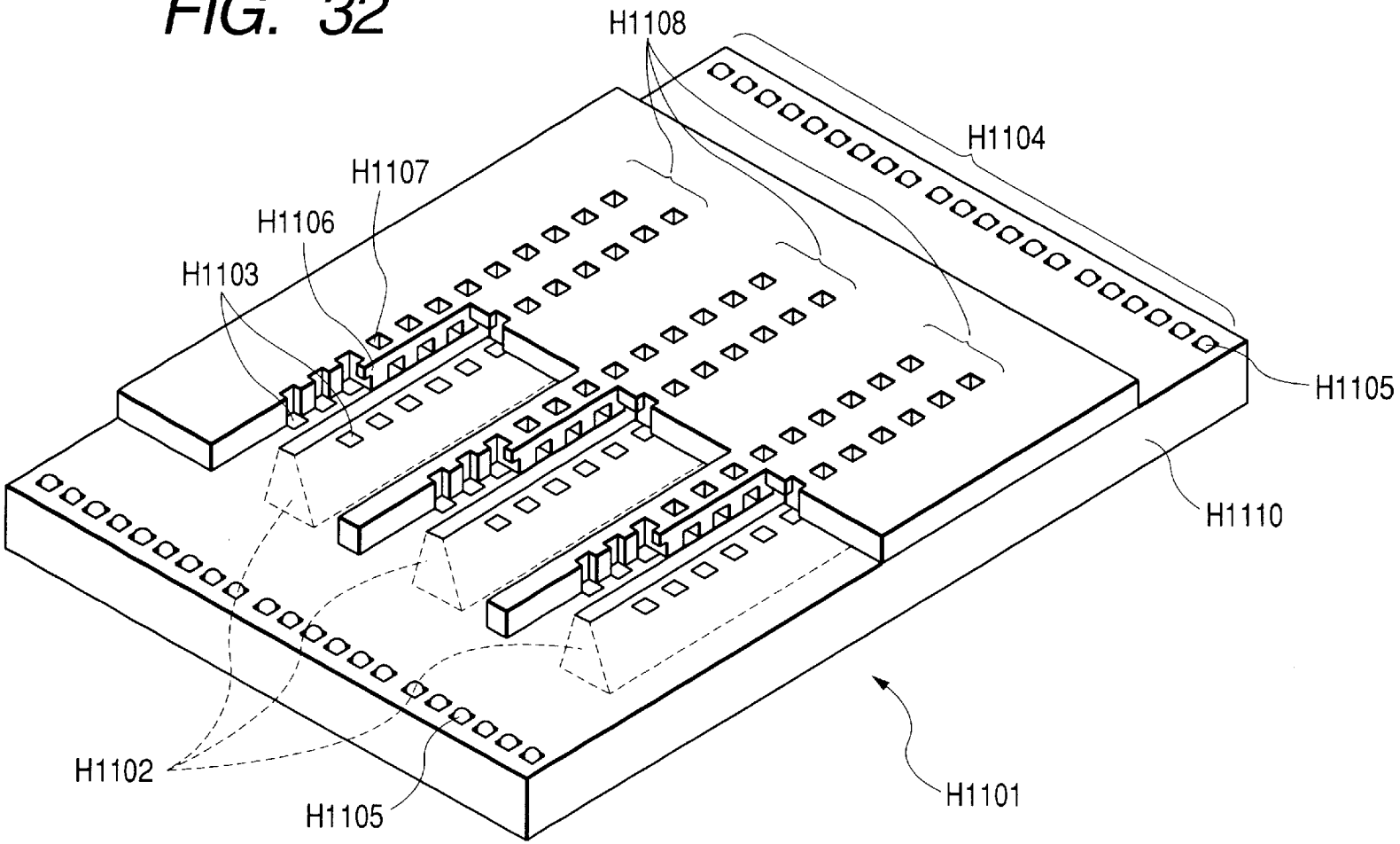
FIG. 32 is a partly cut-away illustrative perspective view showing a configuration of another recording element substrate of the recording head cartridge of FIGS. 28A and 28B.

In addition, FIG. 32 is a perspective view partly disassembled for illustrating a configuration of the second recording element substrate H1101. The second recording element substrate H1101 is a recording element substrate for discharging ink of three colors, on which three ink supply ports H1102 are formed in parallel. The electrothermal conversion elements H1103 and the ink discharge ports H1107 are formed on the both sides of each ink supply port H1102. The ink supply ports H1102, the electrothermal conversion elements H1103, an electric wiring, the electrodes H1104 and the like are formed on the Si substrate H1110 as in the first recording element substrate H1100. Ink flow paths and the ink discharge ports H1107 are formed of a resin material over them by the photolithography technology. Further, the bumps H1105 made of Au or the like are formed on the electrodes H1104 for supplying electric power to the electric wiring as in the first recording element substrate H1100.

The first plate H1200 is formed of, for example, an aluminum ($Al_2O_3$) material having the thickness of 0.5 to 10 mm. Further, a material for the first plate H1200 is not limited to aluminum and may be made of a material having a linear expansivity equal to that of a material for the recording element substrate H1100 and having a thermal conductivity equal to or more than that of the material for the recording element substrate H1100. A material for the first plate H1200 may be any of, for example, silicon (Si), aluminum nitride (AlN), zirconia, silicon nitride ($Si_3N_4$), silicon carbide (SiC), molybdenum (Mo) and tungsten (W). Ink communication ports H1201 for supplying black ink to the first recording element substrate H1100 and ink communication ports H1201 for supplying cyan, magenta and yellow ink to the second recording element substrate H1101 are formed on the first plate H1200. The ink supply ports H1102 of the recording element substrates correspond to the ink communication ports H1201 of the first plate H1200, respectively, and the first recording element substrate H1100 and the second recording element substrate H1101 are adhered and fixed to the first plate H1200 with good positional accuracy. A first adhesive used for adhesion is desirably an adhesive that is low in viscosity and setting temperature, sets in a short time, has relatively high hardness after setting and has ink resistance. The first adhesive is desirably a thermosetting adhesive with an epoxy resin as a main component, and a thickness of a first adhesive layer H1202 is desirably 50 $\mu$m or less.

The electric wiring tape H1300 is for applying an electric signal for discharging ink to the first recording element substrate H1100 and the second recording element substrate H1101. This electric wiring tape H1300 has a plurality of device holes (opening) H1 and H2 for incorporating each of the recording element substrates H1100 and H1101, electrode terminals H1302 corresponding to the electrodes H1104 of each of the recording element substrates H1100 and H1101, and an electrode terminal portion for performing electric connection with the electric contact substrate H2200 having the external signal input terminal H1301 that lies at the end of the electric wiring tape H1300 and receives an electric signal from the printer main body apparatus. This electrode terminal portion and the electrode leads H1302 are connected by continuous wiring patterns of copper foil. This electric wiring tape H1300 consists of, for example, a flexible wiring substrate in which wiring is in two layer structure and a surface layer is covered with a resist film. In this case, a reinforcing plate is adhered to the back side (external side) of the external signal input terminal H1301 to improve planarity. As the reinforcing plate, for example, a material having heat resistance such as glass epoxy and aluminum of 0.5 to 2 mm thickness is used.

The electric wiring tape H1300, the first recording element substrate H1100 and the second recording element substrate H1101 are electrically connected to each other. As a method of connection, for example, the bumps H1105 on the electrodes H1104 of the recording element substrates and the electrode leads H1302 of the electric wiring tape H1300 are electrically joined by the thermal ultrasonic compression bonding method.

The second plate H1400 is, for example, a sheet of a plate-like member of 0.5 to 1 mm thickness and is formed of, for example, ceramic such as aluminum ($Al_2O_3$) or a metal material such as Al and SUS. However, a material of the second plate H1400 is not limited to these and may be a material having a linear expansivity equal to the recording element substrates H1100 and H1101 and the first plate H1200 and having a thermal conductivity equal to or more than that of them.

Further, the second plate H1400 is formed in a shape having openings larger than the external dimensions of the first recording element substrate H1100 and the second recording element substrate H1101, respectively, that are adhered and fixed to the first plate H1200. In addition, the first recording element substrate H1100 and the second recording element substrate H1101 are adhered to the first plate H1200 by a second adhesive layer H1203 and the back side of the electric wiring tape H1300 is adhered and fixed to the second plate H1400 by a third adhesive layer such that the first recording element substrate H1100 and the second recording element substrate H1101 and the electric wiring tape H1300 are electrically connected two-dimensionally.

The electrical connection part of the first recording element substrate H1100 and the second recording element substrate H1101 and the electric wiring tape H1300 is sealed by a first sealing agent (not shown) and a second sealing agent and protected from corrosion by ink or external impacts. The first sealing agent mainly seals the back sides of the connecting parts of the electrode terminals H1302 of the electric wiring tape and the bumps H1105 of the recording element substrates and the external circumference parts of the recording element substrates, and the second sealing agent seals the front side of the connecting parts.

Moreover, the electric contact substrate H2200 having the external signal input terminal H1301 for receiving an electric signal from the printer main body apparatus is thermally compressed and electrically connected using an anisotropic conductive film or the like to the end of the electric wiring tape H1300.

Further, the electric wiring tape H1300 is adhered to the second plate H1400 and at the same time is folded along one side of the first plate H1200 and one side of the second plate H1400 to be adhered to the side of the first plate H1200 by a third adhesive layer H1306. The second adhesive agent is preferably an adhesive agent that is low in viscosity and can form the thin second adhesive layer H1203 on a contact surface and also has ink resistance. In addition, the third adhesive layer H1306 is, for example, a thermosetting adhesive layer having the thickness of 100 $\mu$m or less with an epoxy resin as a main component.

(1-2) Ink Supply Unit

The ink supply member H1500 is, for example, formed by resin formation. For the resin formation, it is desirable to use a resin material with a mixture of 5 to 40% of glass filler for improving formal rigidity.

Figure 33:
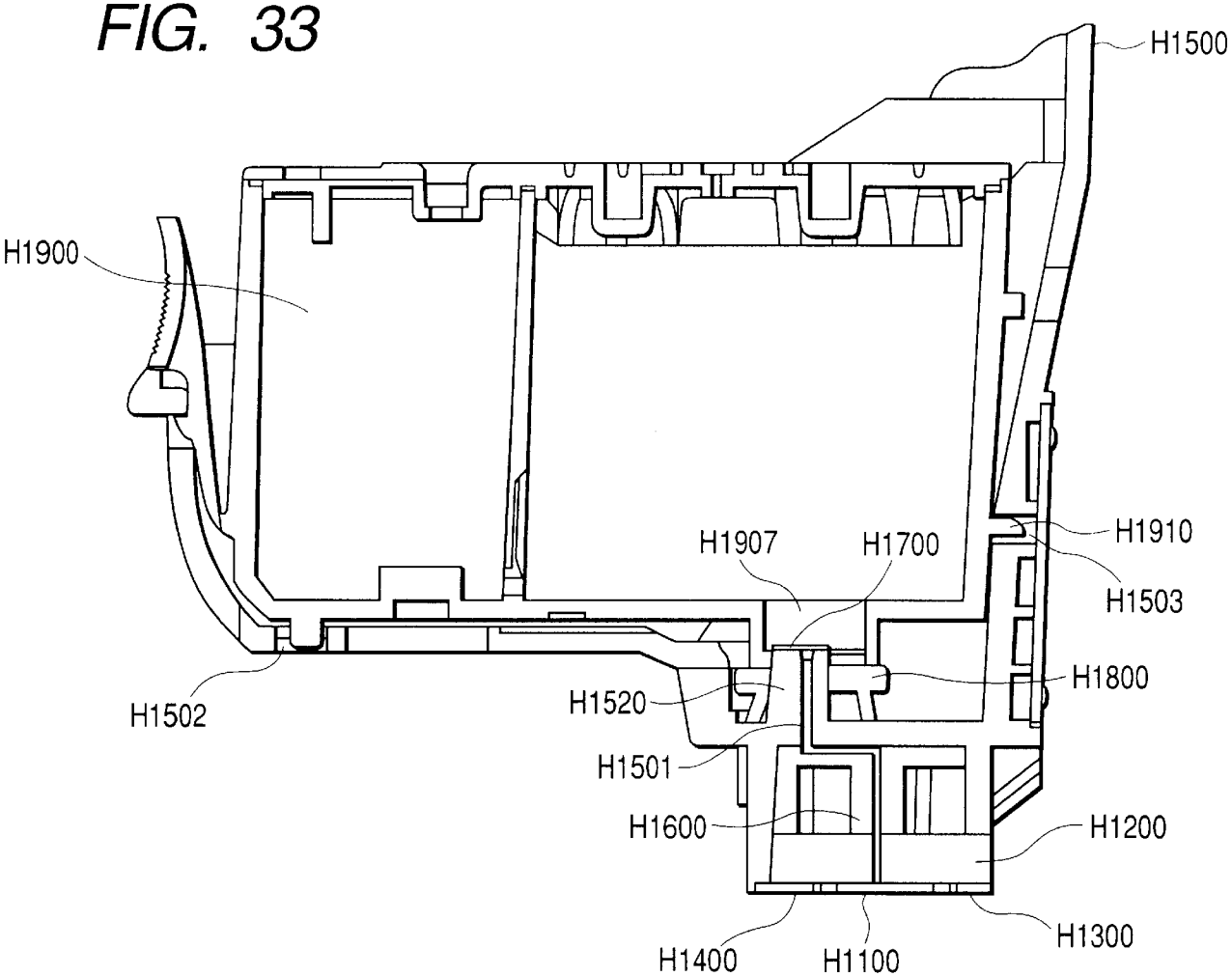
FIG. 33 is a main part sectional view of the recording head cartridge of FIGS. 28A and 28B.

As shown in FIGS. 30 and 33, the ink supply member H1500 for detachably holding the ink tanks H1900 is a component of the ink supply unit H1003 for guiding ink from the ink tank H1900 to the recording element unit H1002. The flow path forming member H1600 is ultrasonic welded to the ink supply member H1500 to form the ink flow path H1501 extending from the ink tank H1900 to the first plate H1200. In addition, the filter H1700 for preventing dusts from entering from the outside is joined to a joint portion H1520, that is engaged with the ink tank H1900, by welding. Moreover, the sealing rubber H1800 is attached to the join portion H1520 in order to prevent ink from evaporating from it.

In addition, the ink supply member H1500 has a function of holding the detachable ink tank H1900 and also has a first hold H1503 for engaging a second pawl H1910 of the ink tank H1900.

In addition, the ink supply member H1500 is also provided with a mounting guide H1601 for guiding the recording head cartridge H1000 to a mounting position of a carriage of the ink jet recording apparatus main body, an engaging portion for mounting and fixing the recording head cartridge H1000 to the carriage by a head set lever, stopping portions H1509 in the X direction (carriage scanning direction), stopping portions H1510 in the Y direction (recording medium carrying direction) and stopping portions H1511 in the Z direction (ink discharging direction) for positioning the recording head cartridge H1000 in a predetermine mounting position of the carriage. In addition, the recording head cartridge H1000 has terminal fixing portions H1512 for positioning and fixing the electric contact substrate H2200 of the recording element unit H1002. A plurality of ribs are provided on the terminal fixing portion H1512 and around it, whereby rigidity of a surface having the terminal fixing portion H1512 is increased.

(1-3) Combination of the Recording Element Unit and the Ink Supply Unit

As shown in FIG. 29 described above, the recording head H1001 is completed by combining the recording element unit H1002 with the ink supply unit H1003 and further combining them with the tank holder H2000. The combination is carried out as described below.

In order to communicate an ink communication port of the recording element unit H1002 (the ink communication port H1201 of the first plate H1200) and an ink communication port of the ink supply unit H1003 (the ink communication port H1602 of the flow path forming member H1600) such that ink does not leak, each of these members are fixed by screws H2400 to be compressed and bonded each other via the joint sealing member H2300. In doing so, the recording element unit H1002 is accurately positioned and fixed with respect to reference positions in the X, Y and Z directions of the ink supply unit.

Figure 34:
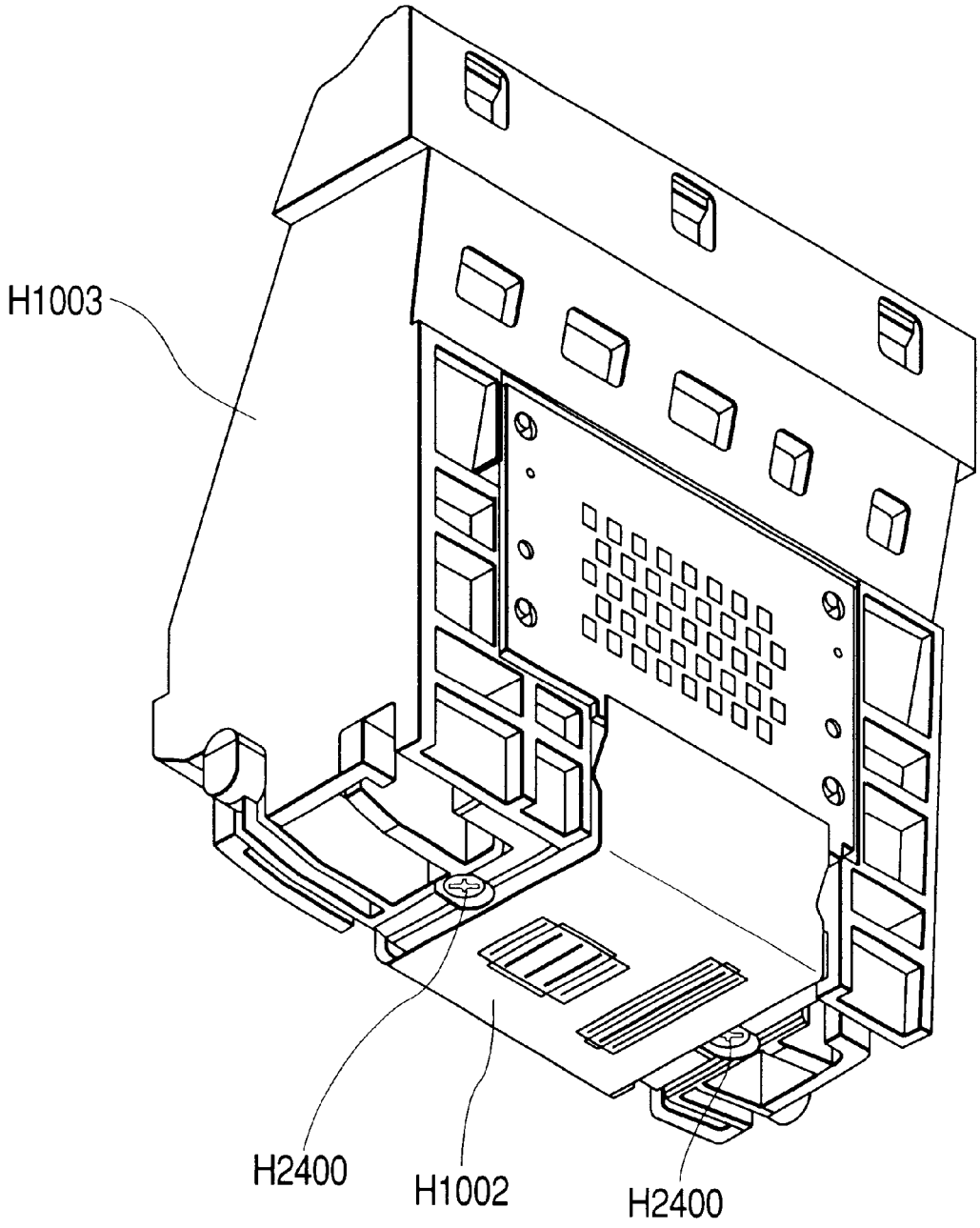
FIG. 34 is a perspective view showing an assembled recording element unit and ink supply unit of the recording head cartridge of FIGS. 28A and 28B.

Further, the electric contact substrate H2200 of the recording element unit H1002 is positioned and fixed to one side of the ink supply member H1500 by two terminal positioning pins H1515 and two terminal positioning holes H1309. As a method of fixing, the electric contact substrate H2200 is fixed, for example, by tightening the terminal positioning pins H1515 provided in the ink supply member H1500 and may be fixed using other fixing means. The combined electric contact substrate H2200 and ink supply member H1500 are shown in FIG. 34.

Figure 35:
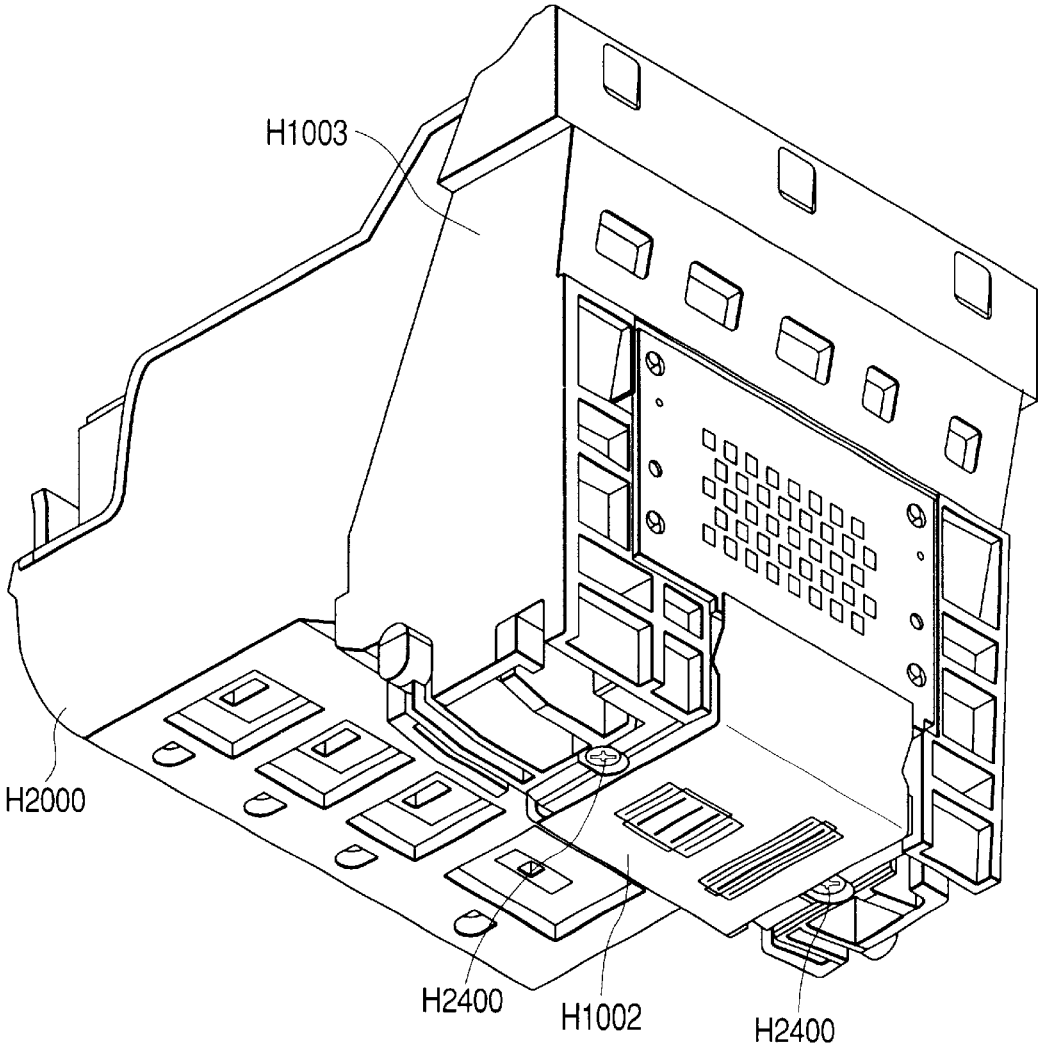
FIG. 35 is a perspective view showing a bottom side of the recording head cartridge of FIGS. 28A and 28B.

Moreover, combination holes and combination portions of the ink supply member H1500 with the tank holder H2000 are fit in and combined with the tank holder H2000, whereby the recording head H1001 is completed. That is, a tank holder portion composed of the ink supply member H1500, the flow path forming member H1600, the filter H1700 and the sealing rubber H1800 and a recording element portion composed of the recording element substrates H1100 and H1101, the first plate H1200, the wiring substrate H1300 and the second plate H1400 are combined by adhesion or the like, whereby the recording head H1001 is configured. The completed recording head H1001 is shown in FIG. 35.

(2) Description of the Recording Head Cartridge

The above-mentioned FIGS. 28A and 28B illustrate mounting of the recording head H1001 and the ink tanks H1901, H1902, H1903 and H1904 that configure the recording head cartridge H1000. Ink of corresponding colors is contained inside the ink tanks H1901, H1902, H1903 and H1904. In addition, as shown in FIG. 33, an ink communication port H1907 for supplying the ink in the ink tanks to the recording head H1001 is formed in each ink tank. For example, when the ink tank H1901 is mounted on the recording head H1001, the ink communication port H1907 of the ink tank H1901 is pressurized to contact the filter H1700 provided in the joint portion H1520 of the recording head H1001. Then, black ink in the ink tank H1901 is supplied to the recording element substrate H1100 from the ink communication port H1907 via the ink flow path H1501 of the recording head H1001.

Then, the ink is supplied to a bubbling chamber including the electrothermal conversion elements H1103 and the discharge ports H1107 and discharged to a recording sheet being a medium to be recorded by thermal energy given to the electrothermal conversion elements H1103.

(Configuration of the Ink Jet Recording Apparatus)

Figure 36:
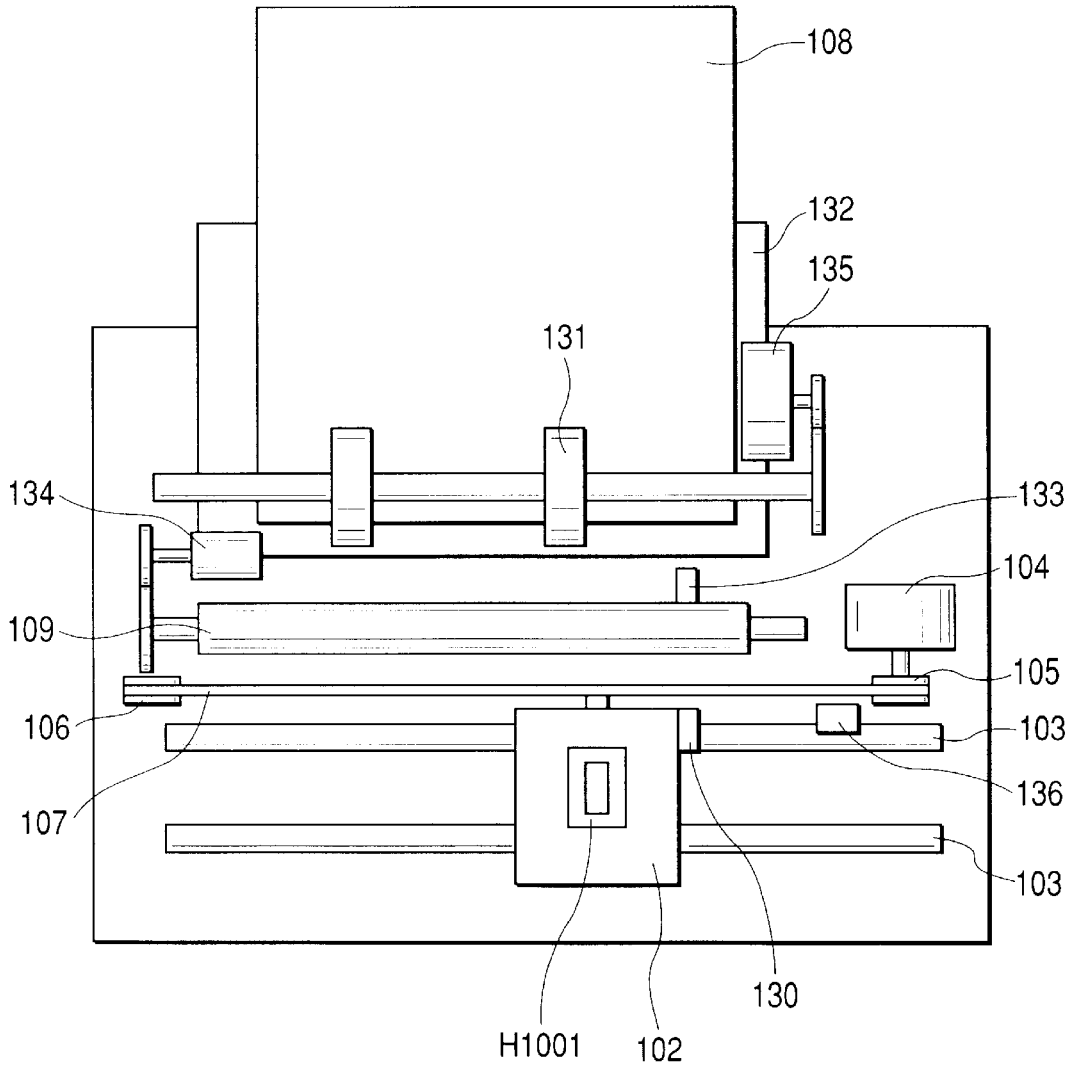
FIG. 36 is a schematic plan view of a preferred ink jet recording apparatus on which the recording head cartridge of FIGS. 28A and 28B can be mounted.

Next, a configuration of a representative ink jet recording apparatus on which the above-mentioned recording head cartridge is mounted will be described with reference to a schematic plan view shown in FIG. 36.

The recording head cartridge H1001 is replaceably mounted on this recording apparatus while being positioned with respect to the carriage 102. An electrical connection portion for transmitting a driving signal or the like to the electrothermal converting elements H1103 in each discharge port row via the external signal input terminal H1301 on the recording head cartridge H1001 is provided in the carriage 102.

The carriage 102 is reciprocatingly guided and supported along a guide shaft 103 that is provided in the apparatus main body extending in the main scanning direction. Then, the carriage 102 is driven and its position and movement are controlled by a main scanning motor 104 via a driving mechanism such as a motor pulley 105, a following pulley 106 and a timing belt 107. The carriage 102 is provided with a home position sensor 130. Upon passing a position of a shielding plate 136 disposed in a predetermined position, the home position sensor 130 on the carriage 102 can sense the shielding plate 136 and detect that the carriage 102 is in the home position.

A pick-up roller 131 is rotated and driven by a sheet feeding motor 135 via a gear, whereby a medium to be recorded 108 such as a sheet and a plastic thin plate is separated from an auto sheet feeder (hereinafter referred to as ASF) 132 one by one. Moreover, a conveying roller 109 is rotated and driven by an LF motor 134 via a gear, whereby the medium to be recorded 108 is conveyed through a position (printing portion) opposing to the discharge port surface of the recording head cartridge H1001. In this case, determination on whether a sheet has been supplied and confirmation of head positioning in feeding a sheet are performed at the point when the medium to be recorded 108 passes over a paper end sensor 133. Moreover, the paper end sensor 133 is also used for detecting where the rear end of the medium to be recorded 108 actually being and finally finding a current recording position from the actual rear end.

Further, the medium to be recorded 108 is supported by a platen (not shown) on its back to form a flat recording surface in a recording portion. The recording head cartridge H1001 mounted on the carriage 102 is held to be in parallel with the medium to be recorded 108 between two pairs of conveying rollers (in FIG. 36, only one conveying roller 109 is shown among them) such that its discharge port surface protrudes downward from the carriage 102. The head cartridge H1001 is mounted on the carriage 102 such that a row direction of the discharge ports H1107 of each discharge port row is perpendicular to the main scanning direction of the carriage.

The recording apparatus conveys the medium to be recorded 108 to a predetermined position opposing to the discharge port surface of the head cartridge H1001 and then causes ink to arrive at a predetermined position of the medium to be recorded 108 by discharging the ink from the head cartridge H1001 while moving the carriage 102 in the main scanning direction, thereby performing the recording operation.

(Method of Driving the Ink Jet Recording Head)

A method of driving the ink jet recording head of this embodiment controls a plurality of electrothermal conversion elements H1103 not to be driven all at once such that a small capacity of a driving power source is enough and unevenness does not occur on a recorded image. That is, the method allocates a plurality of driving blocks to each electrothermal conversion element H1103 and drives each nozzle allocated to the same driving block simultaneously while staggering driving timing of each driving block.

Figure 37A:
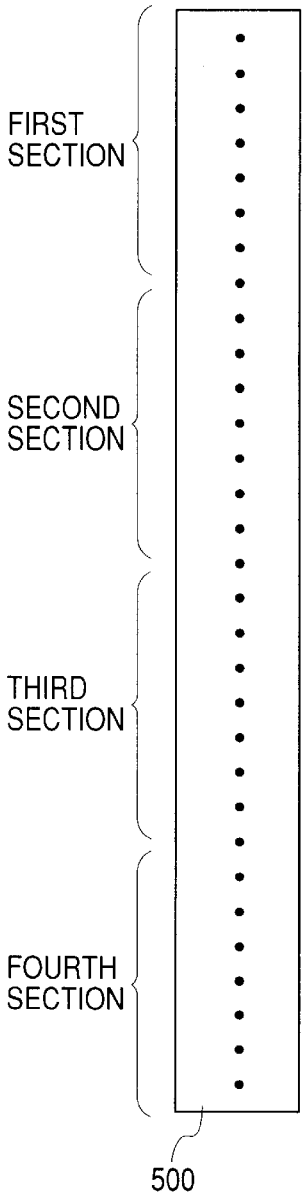
FIGS. 37A, 37B and 37C are diagrams schematically showing a nozzle row, a driving signal of each nozzle and an ink droplet discharged from each nozzle.
Figure 37B:
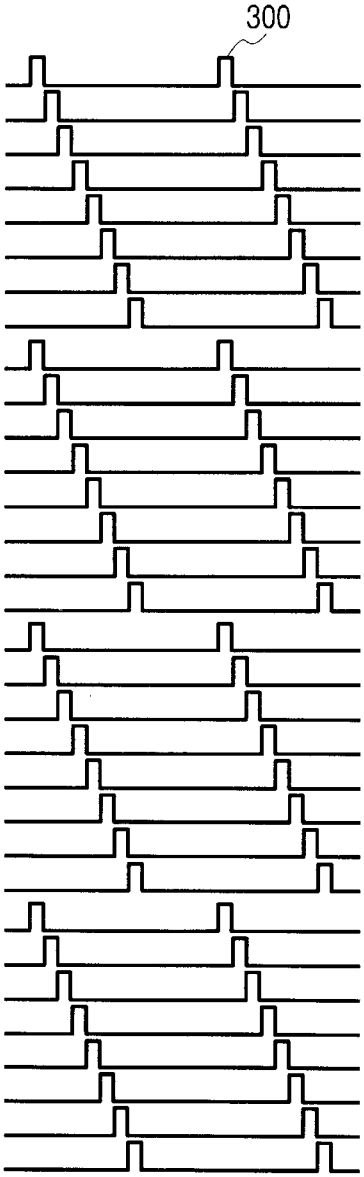
Figure 37C:
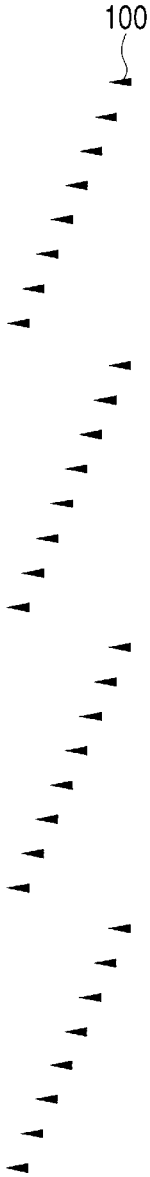

This will be described with reference to FIGS. 37A to 37C. FIG. 37A schematically shows a row of nozzles (nozzle row 500) provided with the discharge ports H1107 and the electrothermal conversion elements H1103 of the ink jet recording head, FIG. 37B schematically shows a driving signal 300 of each nozzle, and FIG. 37C schematically shows a flown ink droplet 100 discharged from each nozzle. In this figure, in order to simplify description, a row of thirty-two nozzles are shown as the nozzle row 500, and nozzle numbers 1 to 32 are given in order from the top of FIGS. 37A to 37C.

In an example shown in FIGS. 37A to 37C, each nozzle is classified into four sections, namely a first section to a fourth section, by a unit of eight in order from the top. Then, each of the eight nozzles in each section is allocated one of the eight driving blocks. In this example, the nozzles in each section are allocated the driving blocks 1 to 8 in order from the top, that is, as shown in Table 1.

TABLE 1

| | | | | | | | | | | | | | | | | |
|---|---|---|---|---|---|---|---|---|---|---|---|---|---|---|---|---|
| Nozzle number | 1 | 2 | 3 | 4 | 5 | 6 | 7 | 8 | 9 | 10 | 11 | 12 | 13 | 14 | 15 | 16 |
| Driving block number | 1 | 2 | 3 | 4 | 5 | 6 | 7 | 8 | 1 | 2 | 3 | 4 | 5 | 6 | 7 | 8 |
| Nozzle number | 17 | 18 | 19 | 20 | 21 | 22 | 23 | 24 | 25 | 26 | 27 | 28 | 29 | 30 | 31 | 32 |
| Driving block number | 1 | 2 | 3 | 4 | 5 | 6 | 7 | 8 | 1 | 2 | 3 | 4 | 5 | 6 | 7 | 8 |

Then, as shown in FIG. 37B, the first driving block to the eighth driving block are sequentially driven in an ascending order by the periodical pulse-like driving signals 300 of each driving block, whereby the ink droplets 100 are discharged as shown in FIG. 37C.

In addition, although each nozzle is basically made the same, a discharge direction, an amount of discharge and the like of ink are subtly different, respectively, due to differences in displaced positions, formation tolerances and the like. Such differences of property of each nozzle are likely to affect a recorded image adversely and to be factors for causing streak, unevenness or the like. Thus, in this embodiment, a multi-path recording method for causing ink droplets form two or more different nozzles to arrive on an identical raster is performed in order to reduce such adverse effects. That is, after performing recording for a width equivalent to the width of the nozzle row 500 in one main scanning, sub-scanning for conveying the medium to be recorded 108 by a fixed width is performed and then the next main scanning is performed, when the medium to be recorded 108 is not conveyed by the entire width of the nozzle row 500 but conveyed by the width of a few nozzles. In this way, recording is performed by nozzles, which deviates by a few nozzles from nozzles that performed recording on a rater in the previous main scanning, on the raster.

For example, if recording is performed by the ink jet recording head having thirty-two nozzles as shown in FIGS. 37A to 37C, the medium to be recorded 108 is conveyed by the width of eight nozzles in one sub-scanning and recording is performed with respect to one rater in four times of main scanning.

Incidentally, in discharge of ink, fluctuation of pressure due to the discharge of ink may vibrate ink in a nozzle adjacent via the common liquid chamber. When such vibration of ink occurs, if the ink is discharged in a state in which a meniscus formed in the discharge port H1107 is in a protruded shape, an amount of discharge becomes relatively large, and if the ink is discharged in a state in which a meniscus is in a recessed shape, an amount of discharge becomes relatively small. Thus, it is likely that unevenness of shading is generated in a recorded image. The more the number of nozzles the more conspicuous such change in an amount of discharge.

Figure 38:
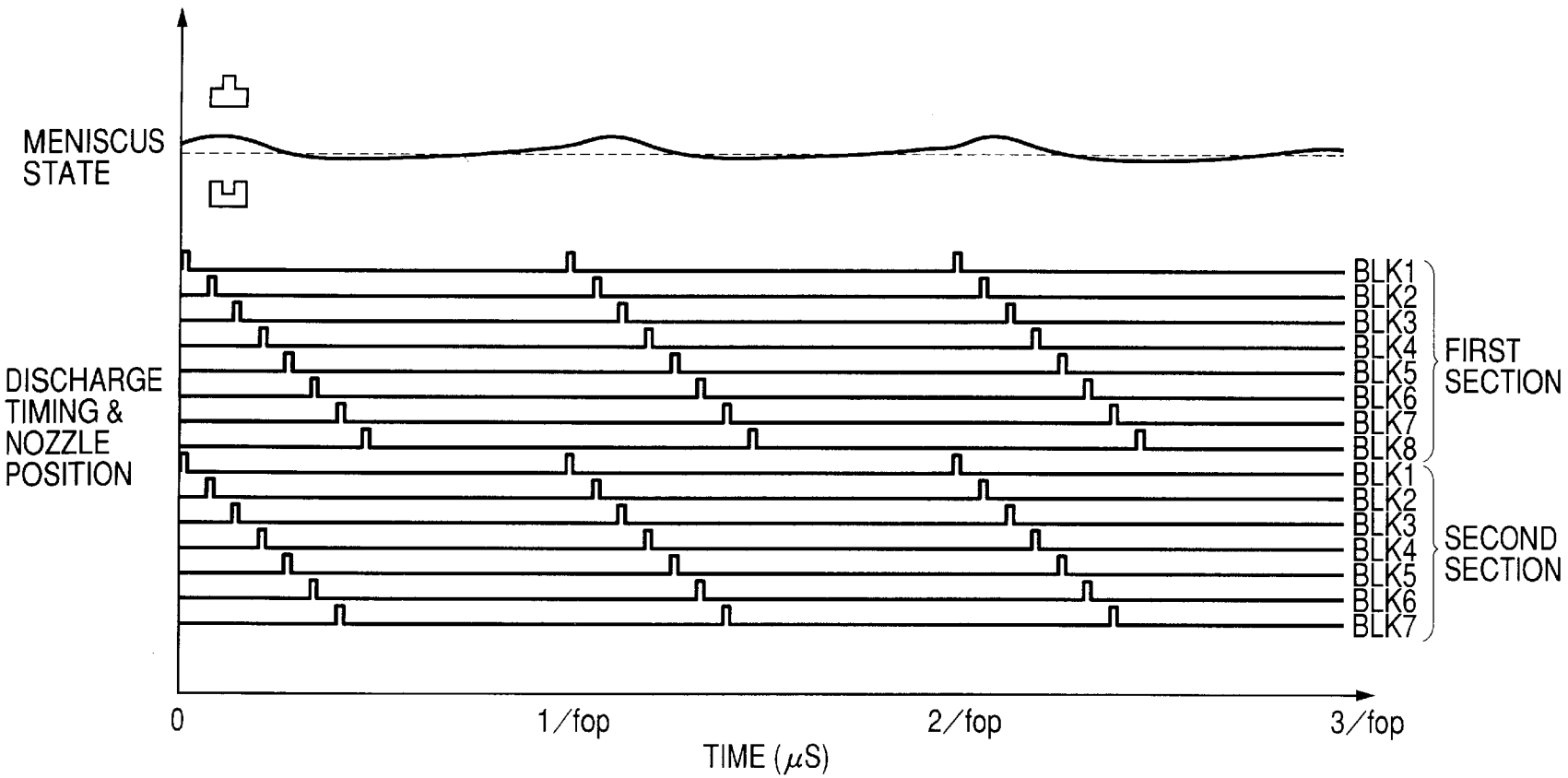
FIG. 38 is a schematic diagram showing a driving signal for periodically discharging an ink droplet from all the nozzles and changes over time of a state on a meniscus surface when the ink droplet is discharged.

Further, when discharge of ink is performed periodically as described above, vibration common to each nozzle that occurs at the same period as the driving period of each driving block appears on a surface of a meniscus. FIG. 38 is a result of an experiment indicating this and shows driving signals at the time when ink droplets are periodically discharged from all the nozzles at a fixed interval and vibration of the surface of the meniscus at that point. In this way, when vibration on the surface of the meniscus with a vibration period substantially the same as the driving period of each driving block occurs, a difference of an amount of ink discharge for each driving block is caused. That is, in an example shown in FIG. 38, an mount of discharge is relatively large in blocks (BLKs) 1, 2 and 3 to be driven in the former half because the surface of the meniscus is in a protruded shape at the time of ink discharge, an amount of discharge is relatively small in BLKs 6 and 7 to be driven in the latter half because the surface of the meniscus is in a recessed shape.

Thus, as described above, if a multi-path recording is performed conveying the medium to be recorded 108 by the same number as the driving blocks, that is, by the width of eight nozzles in one sub-scanning, all nozzles for performing recording on a certain raster belong to the same driving block. Then, it is likely that the above-mentioned difference of an amount of discharge of each driving block is accumulated and significantly affects a recorded image and causes unevenness of density. Therefore, in a method of discharging liquid of the embodiment of the present invention, nozzle feed in sub-scanning is performed by the width of the number of nozzles that is different from the number of driving blocks.

Figure 39:
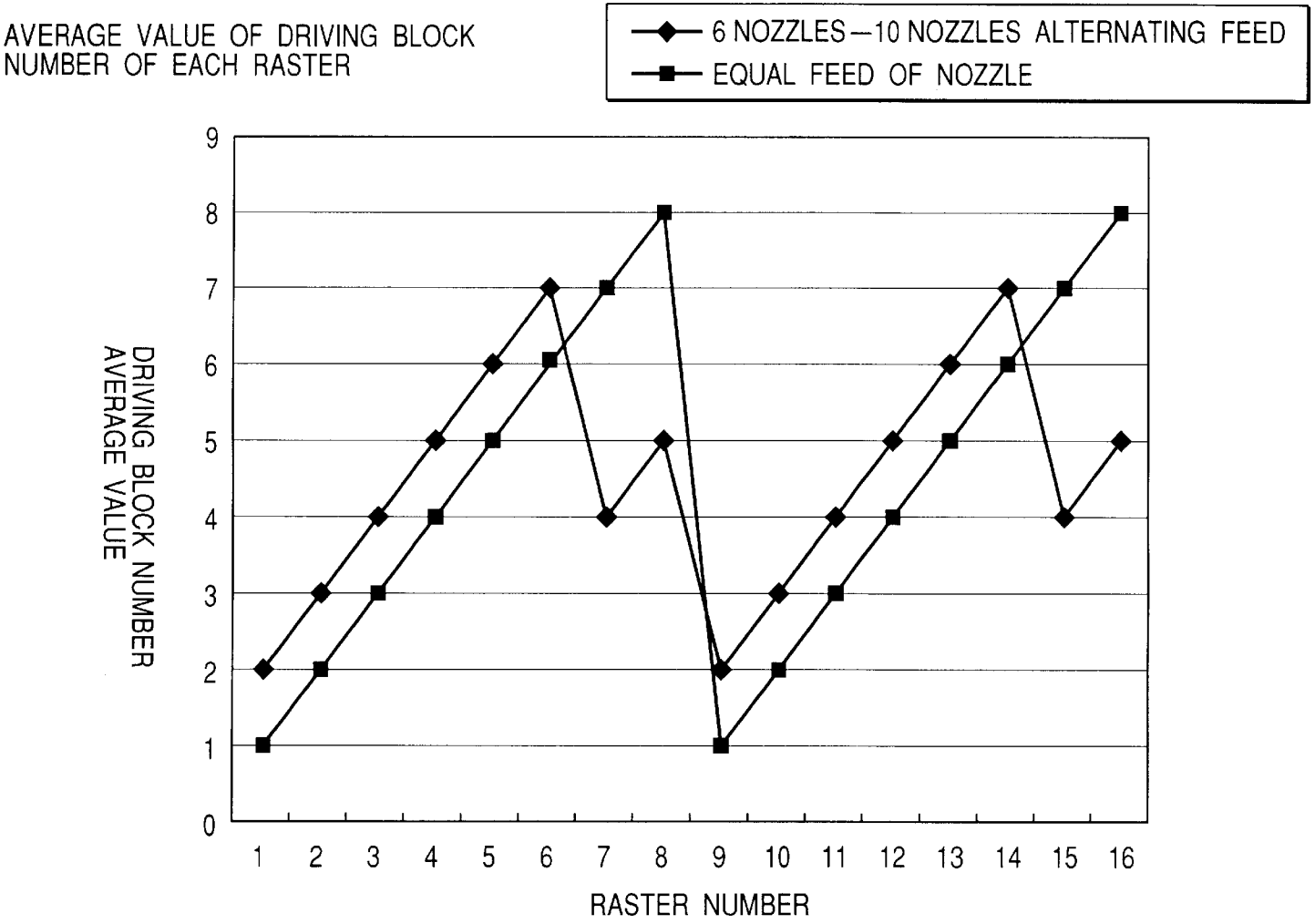
FIG. 39 is a graph showing an average value of driving blocks used in recording to each raster in a recording method for allocating a plurality of driving blocks to a plurality of nozzles and recording an image by a plurality of times of main scanning with respect to one raster.

As such a method, a method of alternately performing nozzle feed by the width of six nozzles and by the width of ten nozzles will be described. In this case, numbers of driving blocks used in recording on each raster in each main scanning of four times and their average values are shown in Table 2 together with average values in the case in which nozzle feed is performed by the width of eight nozzles equally. In addition, a graph indicating a difference of these average values for each raster is shown in FIG. 39.

TABLE 2

| | | | | | | | | | | | | | | | | |
|---|---|---|---|---|---|---|---|---|---|---|---|---|---|---|---|---|
| Raster number | | 1 | 2 | 3 | 4 | 5 | 6 | 7 | 8 | 9 | 10 | 11 | 12 | 13 | 14 | 15 | 16 |
| Driving | First | 1 | 2 | 3 | 4 | 5 | 6 | 7 | 8 | 1 | 2 | 3 | 4 | 5 | 6 | 7 | 8 |

TABLE 2-continued

| | | | | | | | | | | | | | | | | | |
|---|---|---|---|---|---|---|---|---|---|---|---|---|---|---|---|---|---|
| block | Second | 3 | 4 | 5 | 6 | 7 | 8 | 1 | 2 | 3 | 4 | 5 | 6 | 7 | 8 | 1 | 2 |
| number | Third | 1 | 2 | 3 | 4 | 5 | 6 | 7 | 8 | 1 | 2 | 3 | 4 | 5 | 6 | 7 | 8 |
| | Fourth | 3 | 4 | 5 | 6 | 7 | 8 | 1 | 2 | 3 | 4 | 5 | 6 | 7 | 8 | 1 | 2 |
| | average | 2 | 3 | 4 | 5 | 6 | 7 | 4 | 5 | 2 | 3 | 4 | 5 | 6 | 7 | 4 | 5 |
| Equal nozzle feed driving block number | | 1 | 2 | 3 | 4 | 5 | 6 | 7 | 8 | 1 | 2 | 3 | 4 | 5 | 6 | 7 | 8 |
| Raster number | | 17 | 18 | 19 | 20 | 21 | 22 | 23 | 24 | 25 | 26 | 27 | 28 | 29 | 30 | 31 | 32 |
| Driving | First | 1 | 2 | 3 | 4 | 5 | 6 | 7 | 8 | 1 | 2 | 3 | 4 | 5 | 6 | 7 | 8 |
| block | Second | 3 | 4 | 5 | 6 | 7 | 8 | 1 | 2 | 3 | 4 | 5 | 6 | 7 | 8 | 1 | 2 |
| number | Third | 1 | 2 | 3 | 4 | 5 | 6 | 7 | 8 | 1 | 2 | 3 | 4 | 5 | 6 | 7 | 8 |
| | Fourth | 3 | 4 | 5 | 6 | 7 | 8 | 1 | 2 | 3 | 4 | 5 | 6 | 7 | 8 | 1 | 2 |
| | average | 2 | 3 | 4 | 5 | 6 | 7 | 4 | 5 | 2 | 3 | 4 | 5 | 6 | 7 | 4 | 5 |
| Equal nozzle feed driving block number | | 1 | 2 | 3 | 4 | 5 | 6 | 7 | 8 | 1 | 2 | 3 | 4 | 5 | 6 | 7 | 8 |

As shown in Table 2 and FIG. 39, in the case in which the 10 nozzle-6 nozzle alternating feed is performed, a width of fluctuation of an average of numbers of driving blocks used on each raster becomes smaller compared with the case in which equal feed is performed. That is, whereas fluctuation in the equal feed is 1 to 8, fluctuation in the 10 nozzle-6 nozzle alternating feed is 2 to 7, which means that a width of fluctuation is reduced by approximately 25%. As described above, since there is a difference in an amount of ink discharge from each driving block, it can be evaluated that a driving block number generally represents an amount of ink discharge, and it can be considered that an average of driving block numbers generally indicates an average amount of discharge of ink in four times of main scanning. In fact, since the numbers of driving nozzles is not proportional to an amount of ink discharge, fluctuation of an average of discharge amounts in four times of main scanning from one raster to another becomes smaller than that shown in FIG. 39. The fact that a width of fluctuation of an average of driving block numbers from one raster to another becomes smaller indicates that an average of discharge amounts in four times of main scanning is equalized in every raster. That is, according to the method of discharging liquid of this embodiment, unevenness of density of a recorded image can be reduced.

Figure 40:
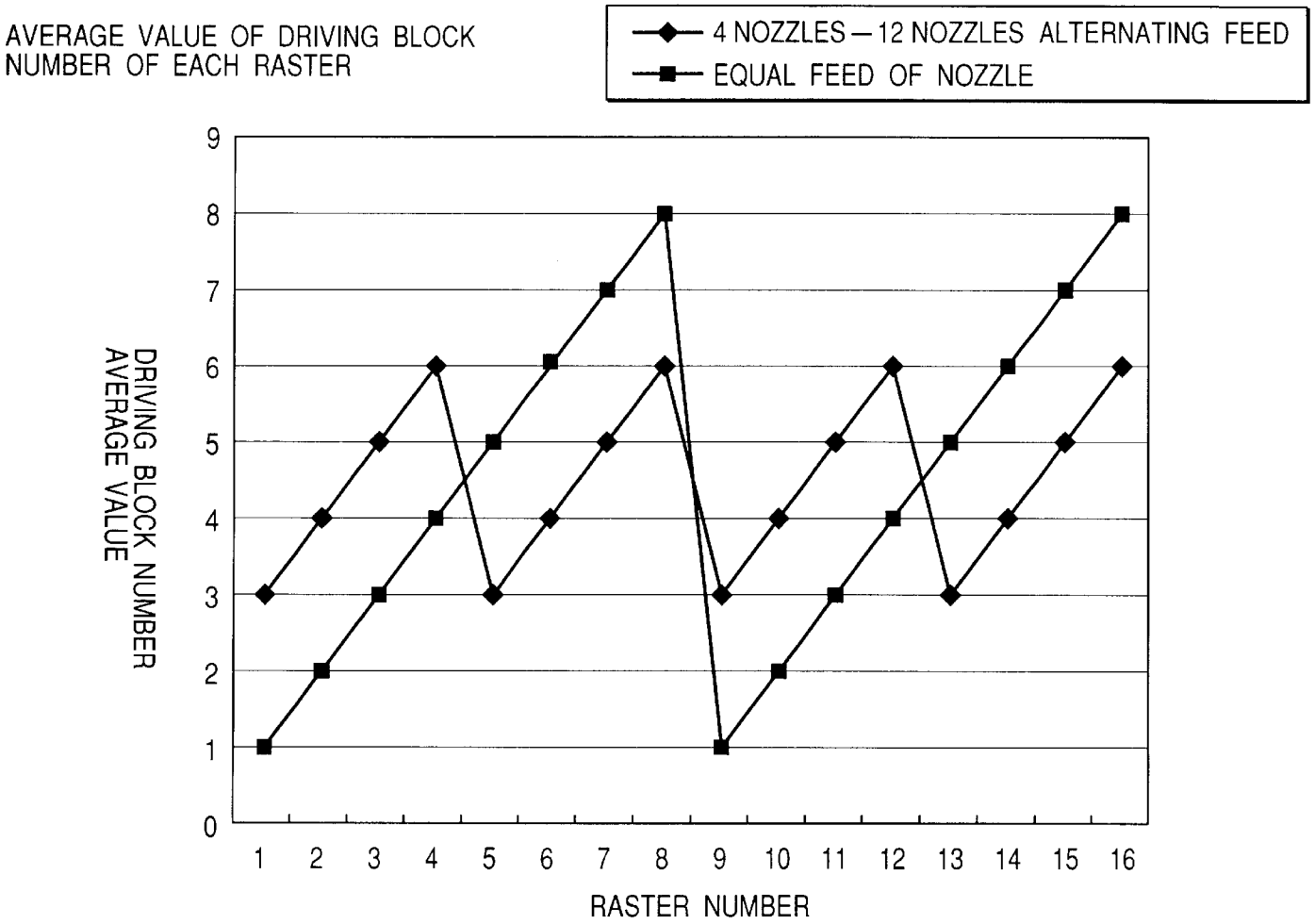
FIG. 40 is a graph showing an average value of driving blocks used in recording to each raster in another recording method for allocating a plurality of driving blocks to a plurality of nozzles and recording an image by a plurality of times of main scanning with respect to one raster.

In addition, as another example of a recording method, average values of driving block numbers of each raster is shown in Table 3 and their graph is shown in FIG. 40 with respect to the case in which 4 nozzle-12 nozzle alternating feed is performed.

Fluctuation of an average value of driving block numbers from one raster to another in the case in which the 4 nozzle-12 nozzle alternating feed is performed is 3 to 6, and a width of fluctuation is further smaller by approximately 25% than the case in which the 10 nozzle-6 nozzle alternating feed is performed and approximately 50% than the case in which the equal feed is performed. In this way, unevenness of density can be made further smaller in the case in which the 4 nozzle-12 nozzle alternating feed is performed than the case in which the 10 nozzle-6 nozzle alternating feed is performed.

As can be seen from the above, feed of the number of nozzles obtained by subtracting a half of the number of driving blocks from a number obtained by dividing the total number of driving blocks by the number of times of main scanning for performing recording on one raster and feed of the number of nozzles obtained by adding the half of the number of driving blocks to the quotient are alternatingly performed, whereby the action of reducing unevenness of density can be obtained more effectively. This is the same for the case in which recording is performed on one raster by two times of main scanning.

Next, an ink jet recording head with the number of nozzles of 320 will be described with reference to the case in which the nozzles are driven by allocating them to 16 blocks×20 sections and recording is performed by four times of main scanning with respect to one raster.

As to a section, nozzles are divided into a set of sixteen nozzles from the end of a row of the nozzles to form a section. Driving blocks are allocated to each nozzle in each section in an ascending order from the end as shown in Table 4.

TABLE 3

| | | | | | | | | | | | | | | | | | |
|---|---|---|---|---|---|---|---|---|---|---|---|---|---|---|---|---|---|
| Raster number | | 1 | 2 | 3 | 4 | 5 | 6 | 7 | 8 | 9 | 10 | 11 | 12 | 13 | 14 | 15 | 16 |
| Driving | First | 1 | 2 | 3 | 4 | 5 | 6 | 7 | 8 | 1 | 2 | 3 | 4 | 5 | 6 | 7 | 8 |
| block | Second | 5 | 6 | 7 | 8 | 1 | 2 | 3 | 4 | 5 | 6 | 7 | 8 | 1 | 2 | 3 | 4 |
| number | Third | 1 | 2 | 3 | 4 | 5 | 6 | 7 | 8 | 1 | 2 | 3 | 4 | 5 | 6 | 7 | 8 |
| | Fourth | 5 | 6 | 7 | 8 | 1 | 2 | 3 | 4 | 5 | 6 | 7 | 8 | 1 | 2 | 3 | 4 |
| | average | 3 | 4 | 5 | 6 | 3 | 4 | 5 | 6 | 3 | 4 | 5 | 6 | 3 | 4 | 5 | 6 |
| Equal nozzle feed driving block number | | 1 | 2 | 3 | 4 | 5 | 6 | 7 | 8 | 1 | 2 | 3 | 4 | 5 | 6 | 7 | 8 |
| Raster number | | 17 | 18 | 19 | 20 | 21 | 22 | 23 | 24 | 25 | 26 | 27 | 28 | 29 | 30 | 31 | 32 |
| Driving | First | 1 | 2 | 3 | 4 | 5 | 6 | 7 | 8 | 1 | 2 | 3 | 4 | 5 | 6 | 7 | 8 |
| block | Second | 5 | 6 | 7 | 8 | 1 | 2 | 3 | 4 | 5 | 6 | 7 | 8 | 1 | 2 | 3 | 4 |
| number | Third | 1 | 2 | 3 | 4 | 5 | 6 | 7 | 8 | 1 | 2 | 3 | 4 | 5 | 6 | 7 | 8 |
| | Fourth | 5 | 6 | 7 | 8 | 1 | 2 | 3 | 4 | 5 | 6 | 7 | 8 | 1 | 2 | 3 | 4 |
| | average | 3 | 4 | 5 | 6 | 3 | 4 | 5 | 6 | 3 | 4 | 5 | 6 | 3 | 4 | 5 | 6 |
| Equal nozzle feed driving block number | | 1 | 2 | 3 | 4 | 5 | 6 | 7 | 8 | 1 | 2 | 3 | 4 | 5 | 6 | 7 | 8 |

TABLE 4

| | | | | | | | | | | | | | | | | |
|---|---|---|---|---|---|---|---|---|---|---|---|---|---|---|---|---|
| Nozzle number | 1 | 2 | 3 | 4 | 5 | 6 | 7 | 8 | 9 | 10 | 11 | 12 | 13 | 14 | 15 | 16 |
| Driving block number | 1 | 2 | 3 | 4 | 5 | 6 | 7 | 8 | 9 | 10 | 11 | 12 | 13 | 14 | 15 | 16 |
| Nozzle number | 17 | 18 | 19 | 20 | 21 | 22 | 23 | 24 | 25 | 26 | 27 | 28 | 29 | 30 | 31 | 32 |
| Driving block number | 1 | 2 | 3 | 4 | 5 | 6 | 7 | 8 | 9 | 10 | 11 | 12 | 13 | 14 | 15 | 16 |

Further, in Table 4, nozzles up to the nozzle number 32 among three hundred twenty nozzles are written. Since the same relations as those of these thirty-two nozzles are repeated for the other nozzles, these nozzles are omitted from the table.

Figure 41:
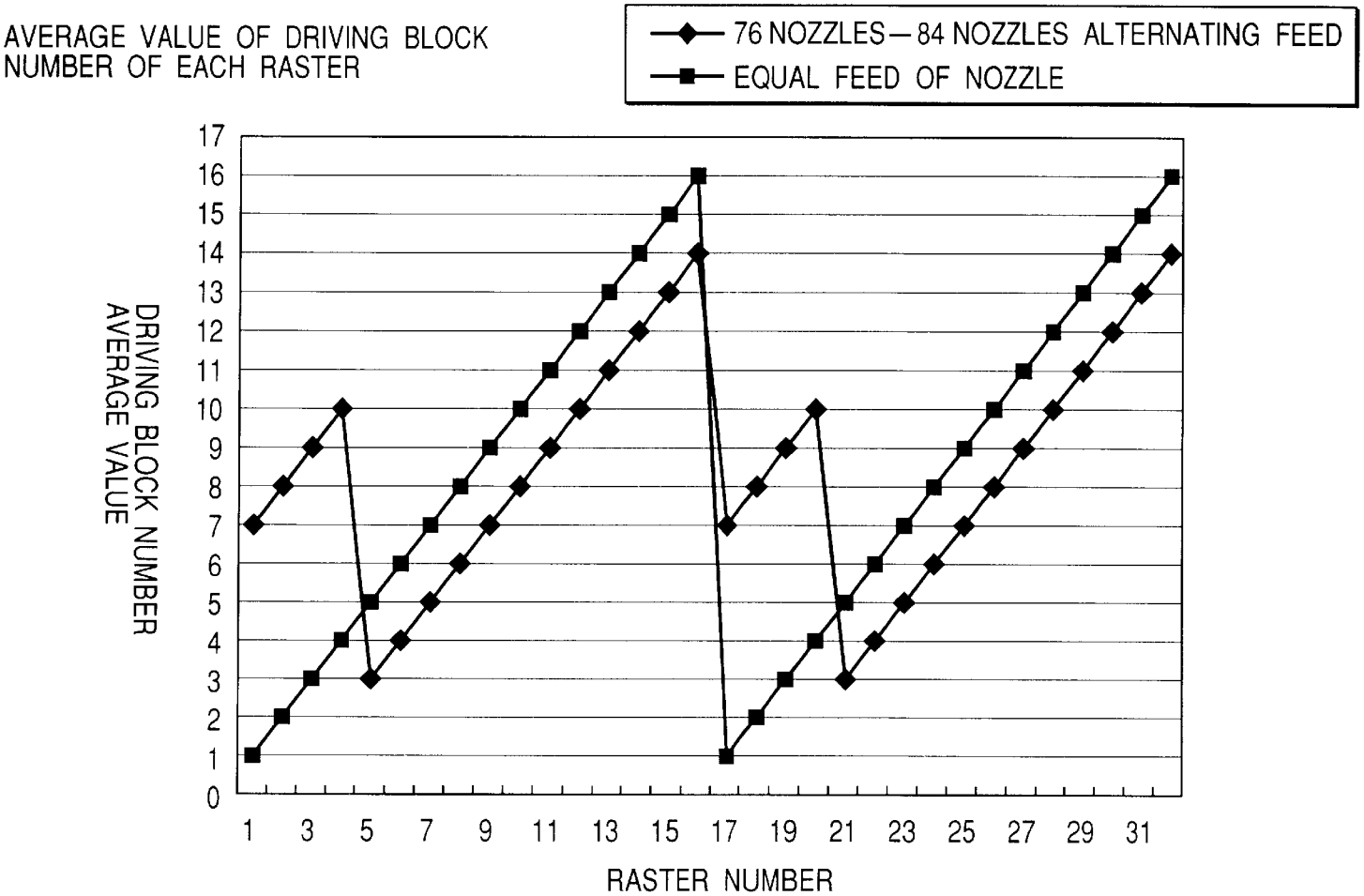
FIG. 41 is a graph showing an average value of driving blocks used in recording to each raster in yet another recording method for allocating a plurality of driving blocks to a plurality of nozzles and recording an image by a plurality of times of main scanning with respect to one raster.

An average value of the driving block numbers of each raster is shown in Table 5 and its graph is shown in FIG. 41 for the case in which 76 nozzle-84 nozzle alternating feed is performed.

Figure 42:
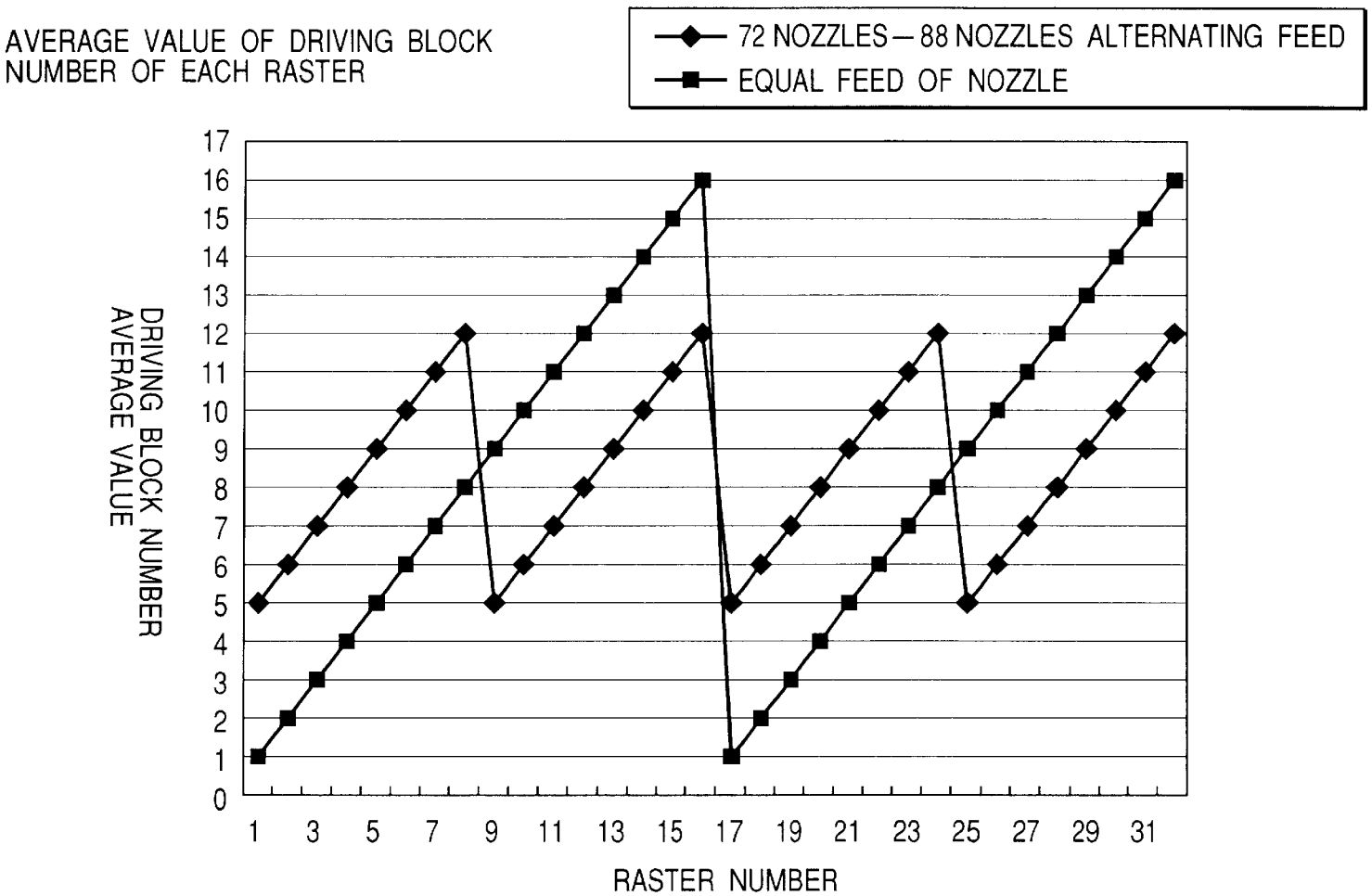
FIG. 42 is a graph showing an average value of driving blocks used in recording to each raster in yet another recording method for allocating a plurality of driving blocks to a plurality of nozzles and recording an image by a plurality of times of main scanning with respect to one raster.

It is seen from Tables 5 and 6 and FIGS. 41 and 42 that a fluctuation width of the average value of the driving block numbers can be made smaller, that is, unevenness of density of an recorded image can be made smaller in the case in which feed for the number of nozzles different from the number of driving blocks is performed compared with the case in which the equal nozzle feed is performed. In addition, as described above, it is seen that, if feed of the number of nozzles obtained by subtracting a half of the number of driving blocks from a number obtained by dividing the total number of driving blocks by the number of times of main scanning for performing recording on one raster and feed of the number of nozzles obtained by adding

TABLE 5

| | | | | | | | | | | | | | | | | | |
|---|---|---|---|---|---|---|---|---|---|---|---|---|---|---|---|---|---|
| Raster number | | 1 | 2 | 3 | 4 | 5 | 6 | 7 | 8 | 9 | 10 | 11 | 12 | 13 | 14 | 15 | 16 |
| Driving block number | First | 1 | 2 | 3 | 4 | 5 | 6 | 7 | 8 | 9 | 10 | 11 | 12 | 13 | 14 | 15 | 16 |
| | Second | 13 | 14 | 15 | 16 | 1 | 2 | 3 | 4 | 5 | 6 | 7 | 8 | 9 | 10 | 11 | 12 |
| | Third | 1 | 2 | 3 | 4 | 5 | 6 | 7 | 8 | 9 | 10 | 11 | 12 | 13 | 14 | 15 | 16 |
| | Fourth | 13 | 14 | 15 | 16 | 1 | 2 | 3 | 4 | 5 | 6 | 7 | 8 | 9 | 10 | 11 | 12 |
| | average | 7 | 8 | 9 | 10 | 3 | 4 | 5 | 6 | 7 | 8 | 9 | 10 | 11 | 12 | 13 | 14 |
| Equal nozzle feed driving block number | | 1 | 2 | 3 | 4 | 5 | 6 | 7 | 8 | 9 | 10 | 11 | 12 | 13 | 14 | 15 | 16 |
| Raster number | | 17 | 18 | 19 | 20 | 21 | 22 | 23 | 24 | 25 | 26 | 27 | 28 | 29 | 30 | 31 | 32 |
| Driving block number | First | 1 | 2 | 3 | 4 | 5 | 6 | 7 | 8 | 9 | 10 | 11 | 12 | 13 | 14 | 15 | 16 |
| | Second | 13 | 14 | 15 | 16 | 1 | 2 | 3 | 4 | 5 | 6 | 7 | 8 | 9 | 10 | 11 | 12 |
| | Third | 1 | 2 | 3 | 4 | 5 | 6 | 7 | 8 | 9 | 10 | 11 | 12 | 13 | 14 | 15 | 16 |
| | Fourth | 13 | 14 | 15 | 16 | 1 | 2 | 3 | 4 | 5 | 6 | 7 | 8 | 9 | 10 | 11 | 12 |
| | average | 7 | 8 | 9 | 10 | 3 | 4 | 5 | 6 | 7 | 8 | 9 | 10 | 11 | 12 | 13 | 14 |
| Equal nozzle feed driving block number | | 1 | 2 | 3 | 4 | 5 | 6 | 7 | 8 | 9 | 10 | 11 | 12 | 13 | 14 | 15 | 16 |

In addition, an average value of the driving block numbers is shown in Table 6 and its graph is shown in FIG. 42 for the case in which 72 nozzle-88 nozzle feed is performed.

TABLE 6

| | | | | | | | | | | | | | | | | | |
|---|---|---|---|---|---|---|---|---|---|---|---|---|---|---|---|---|---|
| Raster number | | 1 | 2 | 3 | 4 | 5 | 6 | 7 | 8 | 9 | 10 | 11 | 12 | 13 | 14 | 15 | 16 |
| Driving block number | First | 1 | 2 | 3 | 4 | 5 | 6 | 7 | 8 | 9 | 10 | 11 | 12 | 13 | 14 | 15 | 16 |
| | Second | 9 | 10 | 11 | 12 | 13 | 14 | 15 | 16 | 1 | 2 | 3 | 4 | 5 | 6 | 7 | 8 |
| | Third | 1 | 2 | 3 | 4 | 5 | 6 | 7 | 8 | 9 | 10 | 11 | 12 | 13 | 14 | 15 | 16 |
| | Fourth | 9 | 10 | 11 | 12 | 13 | 14 | 15 | 16 | 1 | 2 | 3 | 4 | 5 | 6 | 7 | 8 |
| | average | 5 | 6 | 7 | 8 | 9 | 10 | 11 | 12 | 5 | 6 | 7 | 8 | 9 | 10 | 11 | 12 |
| Equal nozzle feed driving block number | | 1 | 2 | 3 | 4 | 5 | 6 | 7 | 8 | 9 | 10 | 11 | 12 | 13 | 14 | 15 | 16 |
| Raster number | | 17 | 18 | 19 | 20 | 21 | 22 | 23 | 24 | 25 | 26 | 27 | 28 | 29 | 30 | 31 | 32 |
| Driving block number | First | 1 | 2 | 3 | 4 | 5 | 6 | 7 | 8 | 9 | 10 | 11 | 12 | 13 | 14 | 15 | 16 |
| | Second | 9 | 10 | 11 | 12 | 13 | 14 | 15 | 16 | 1 | 2 | 3 | 4 | 5 | 6 | 7 | 8 |
| | Third | 1 | 2 | 3 | 4 | 5 | 6 | 7 | 8 | 9 | 10 | 11 | 12 | 13 | 14 | 15 | 16 |
| | Fourth | 9 | 10 | 11 | 12 | 13 | 14 | 15 | 16 | 1 | 2 | 3 | 4 | 5 | 6 | 7 | 8 |
| | average | 5 | 6 | 7 | 8 | 9 | 10 | 11 | 12 | 5 | 6 | 7 | 8 | 9 | 10 | 11 | 12 |
| Equal nozzle feed driving block number | | 1 | 2 | 3 | 4 | 5 | 6 | 7 | 8 | 9 | 10 | 11 | 12 | 13 | 14 | 15 | 16 |

the half of the number of driving blocks to the quotient are alternatingly performed, that is, the 72 nozzle-88 nozzle alternating feed is performed, a fluctuation width of the average value of the driving block numbers can be made smaller, that is, unevenness of density of an recorded image can be made smaller.

Next, the case in which driving blocks are dispersed and allocated to each nozzle in each section as described in Table 7 will be described.

TABLE 7

| | | | | | | | | | | | | | | | | |
|---|---|---|---|---|---|---|---|---|---|---|---|---|---|---|---|---|
| Nozzle number | 1 | 2 | 3 | 4 | 5 | 6 | 7 | 8 | 9 | 10 | 11 | 12 | 13 | 14 | 15 | 16 |
| Driving block number | 1 | 11 | 5 | 15 | 9 | 3 | 13 | 7 | 2 | 12 | 6 | 16 | 10 | 4 | 14 | 8 |
| Nozzle number | 17 | 18 | 19 | 20 | 21 | 22 | 23 | 24 | 25 | 26 | 27 | 28 | 29 | 30 | 31 | 32 |
| Driving block number | 1 | 11 | 5 | 15 | 9 | 3 | 13 | 7 | 2 | 12 | 6 | 16 | 10 | 4 | 14 | 8 |

Further, in Table 7, nozzles up to the nozzle number 64 among three hundred twenty nozzles are written. Since the same relations as those of these thirty-two nozzles are repeated for the other nozzles, these nozzles are omitted from the table.

Figure 43:
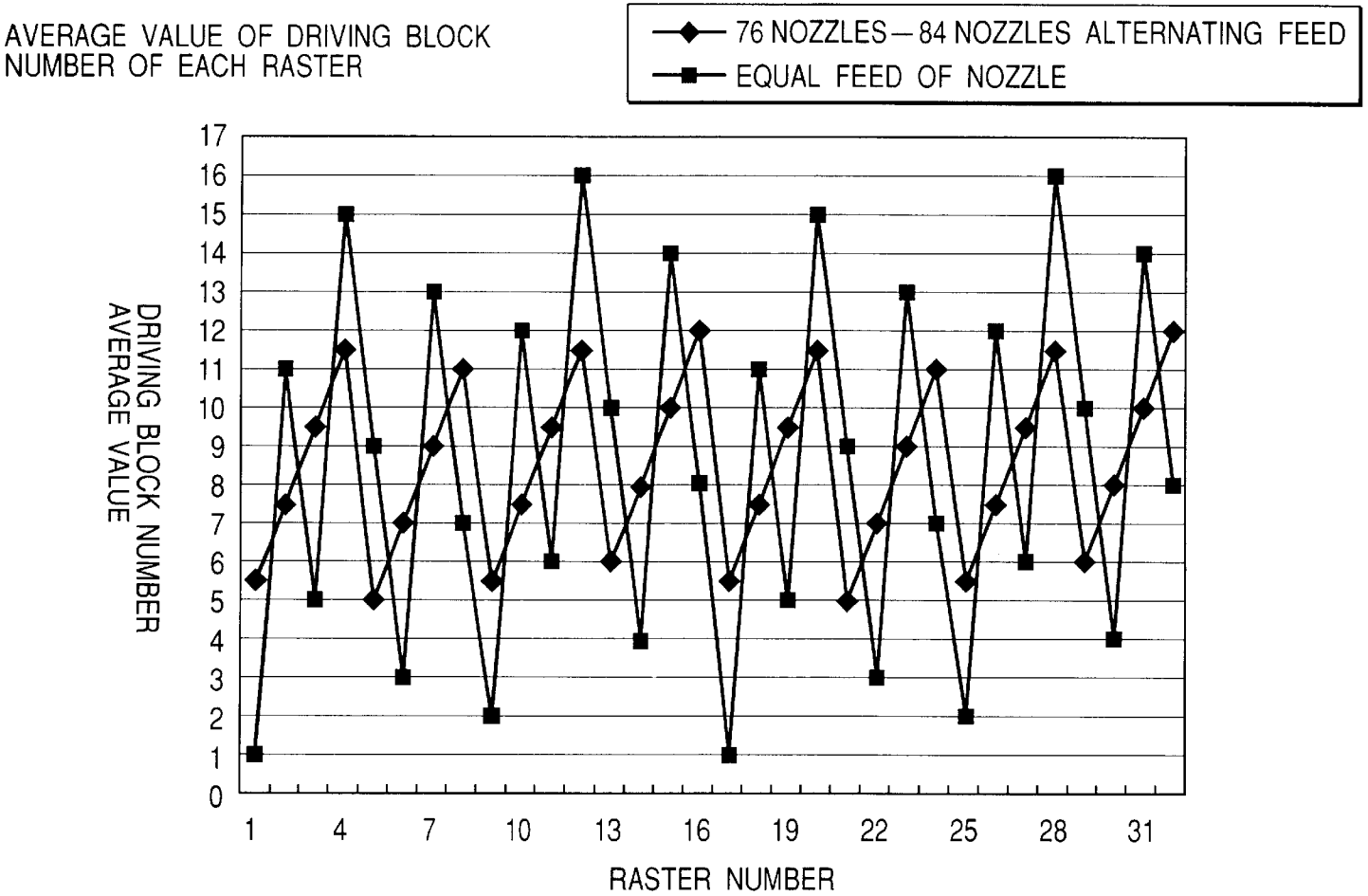
FIG. 43 is a graph showing an average value of driving blocks used in recording to each raster in yet another recording method for allocating a plurality of driving blocks to a plurality of nozzles and recording an image by a plurality of times of main scanning with respect to one raster.

An average value of the driving block numbers of each raster is shown in Table 8 and its graph is shown in FIG. 43 for the case in which 76 nozzle-84 nozzle alternating feed is performed in the above-mentioned case.

Figure 44:
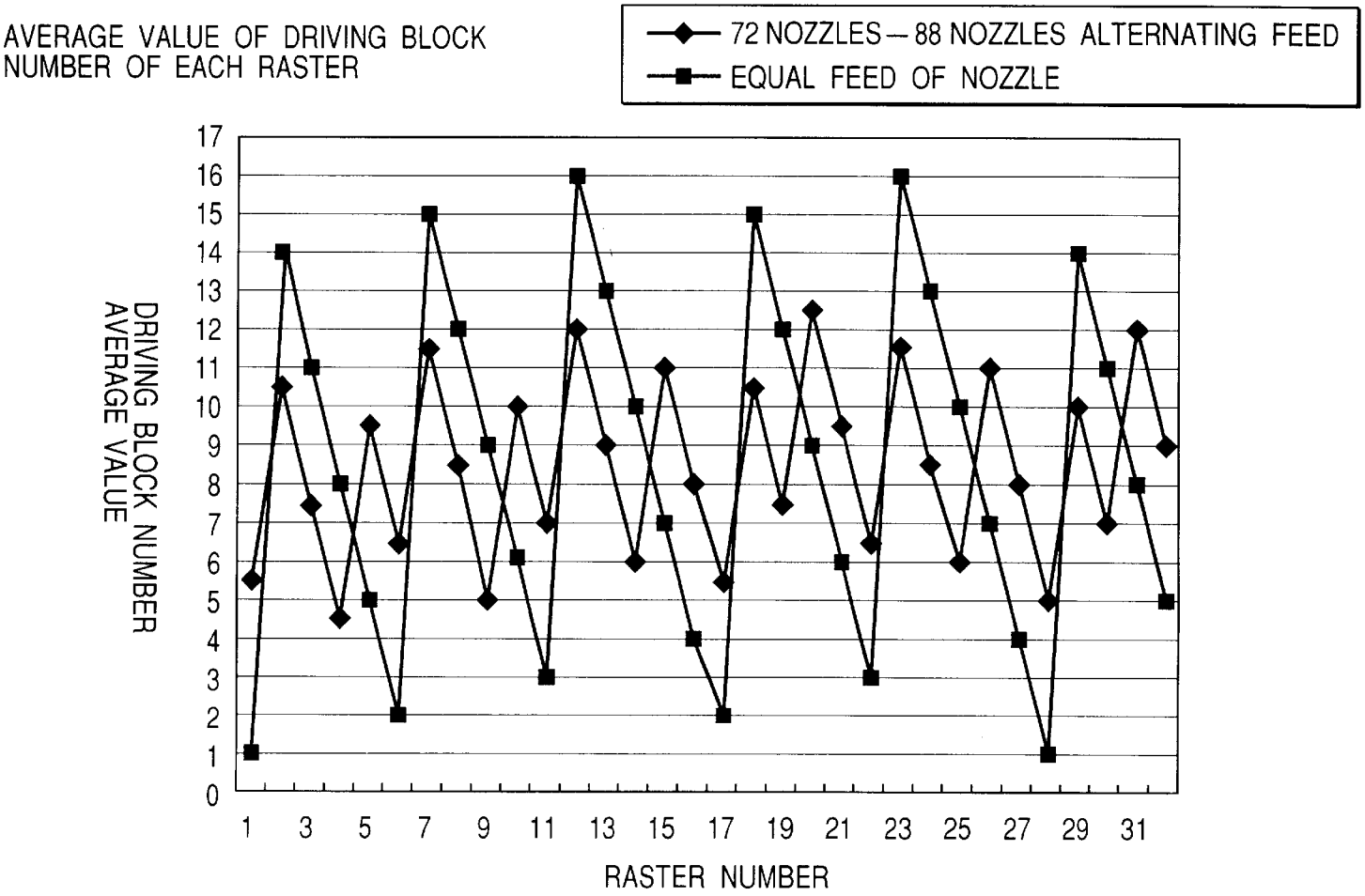
FIG. 44 is a graph showing an average value of driving blocks used in recording to each raster in yet another recording method for allocating a plurality of driving blocks to a plurality of nozzles and recording an image by a plurality of times of main scanning with respect to one raster.

In addition, an average value of the driving block numbers of each raster is shown in Table 10 and its graph is shown in FIG. 44 for the case in which the driving blocks are allocated to each nozzle as shown in Table. 9 and 72 nozzle-88 nozzle alternating feed is performed.

TABLE 8

| | | | | | | | | | | | | | | | | | |
|---|---|---|---|---|---|---|---|---|---|---|---|---|---|---|---|---|---|
| Raster number | | 1 | 2 | 3 | 4 | 5 | 6 | 7 | 8 | 9 | 10 | 11 | 12 | 13 | 14 | 15 | 16 |
| Driving block number | First | 1 | 11 | 5 | 15 | 9 | 3 | 13 | 7 | 2 | 12 | 6 | 16 | 10 | 4 | 14 | 8 |
| | Second | 10 | 4 | 14 | 8 | 1 | 11 | 5 | 15 | 9 | 3 | 13 | 7 | 2 | 12 | 6 | 16 |
| | Third | 1 | 11 | 5 | 15 | 9 | 3 | 13 | 7 | 2 | 12 | 6 | 16 | 10 | 4 | 14 | 8 |
| | Fourth | 10 | 4 | 14 | 8 | 1 | 11 | 5 | 15 | 9 | 3 | 13 | 7 | 2 | 12 | 6 | 16 |
| | Average | 5.5 | 7.5 | 9.5 | 12 | 5 | 7 | 9 | 11 | 5.5 | 7.5 | 9.5 | 12 | 6 | 8 | 10 | 12 |
| Equal nozzle feed driving block number | | 1 | 11 | 5 | 15 | 9 | 3 | 13 | 7 | 2 | 12 | 6 | 16 | 10 | 4 | 14 | 8 |
| Raster number | | 17 | 18 | 19 | 20 | 21 | 22 | 23 | 24 | 25 | 26 | 27 | 28 | 29 | 30 | 31 | 32 |
| Driving block number | First | 1 | 11 | 5 | 15 | 9 | 3 | 13 | 7 | 2 | 12 | 6 | 16 | 10 | 4 | 14 | 8 |
| | Second | 10 | 4 | 14 | 8 | 1 | 11 | 5 | 15 | 9 | 3 | 13 | 7 | 2 | 12 | 6 | 16 |
| | Third | 1 | 11 | 5 | 15 | 9 | 3 | 13 | 7 | 2 | 12 | 6 | 16 | 10 | 4 | 14 | 8 |
| | Fourth | 10 | 4 | 14 | 8 | 1 | 11 | 5 | 15 | 9 | 3 | 13 | 7 | 2 | 12 | 6 | 16 |
| | Average | 5.5 | 7.5 | 9.5 | 12 | 5 | 7 | 9 | 11 | 5.5 | 7.5 | 9.5 | 12 | 6 | 8 | 10 | 12 |
| Equal nozzle feed driving block number | | 1 | 11 | 5 | 15 | 9 | 3 | 13 | 7 | 2 | 12 | 6 | 16 | 10 | 4 | 14 | 8 |

TABLE 9

| | | | | | | | | | | | | | | | | |
|---|---|---|---|---|---|---|---|---|---|---|---|---|---|---|---|---|
| Nozzle number | 1 | 2 | 3 | 4 | 5 | 6 | 7 | 8 | 9 | 10 | 11 | 12 | 13 | 14 | 15 | 16 |
| Driving block number | 1 | 14 | 11 | 8 | 5 | 2 | 15 | 12 | 9 | 6 | 3 | 16 | 13 | 10 | 7 | 4 |
| Nozzle number | 17 | 18 | 19 | 20 | 21 | 22 | 23 | 24 | 25 | 26 | 27 | 28 | 29 | 30 | 31 | 32 |
| Driving block number | 2 | 15 | 12 | 9 | 6 | 3 | 16 | 13 | 10 | 7 | 4 | 1 | 14 | 11 | 8 | 5 |
| Nozzle number | 33 | 34 | 35 | 36 | 37 | 38 | 39 | 40 | 41 | 42 | 43 | 44 | 45 | 46 | 47 | 48 |
| Driving block number | 1 | 14 | 11 | 8 | 5 | 2 | 15 | 12 | 9 | 6 | 3 | 16 | 13 | 10 | 7 | 4 |
| Nozzle number | 49 | 50 | 51 | 52 | 53 | 54 | 55 | 56 | 57 | 58 | 59 | 60 | 61 | 62 | 63 | 64 |
| Driving block number | 2 | 15 | 12 | 9 | 6 | 3 | 16 | 13 | 10 | 7 | 4 | 1 | 14 | 11 | 8 | 5 |

TABLE 10

| | | | | | | | | | | | | | | | | | |
|---|---|---|---|---|---|---|---|---|---|---|---|---|---|---|---|---|---|
| Raster number | | 1 | 2 | 3 | 4 | 5 | 6 | 7 | 8 | 9 | 10 | 11 | 12 | 13 | 14 | 15 | 16 |
| Driving | First | 1 | 14 | 11 | 8 | 5 | 2 | 15 | 12 | 9 | 6 | 3 | 16 | 13 | 10 | 7 | 4 |
| block | Second | 10 | 7 | 4 | 1 | 14 | 11 | 8 | 5 | 1 | 14 | 11 | 8 | 5 | 2 | 15 | 12 |
| number | Third | 1 | 14 | 11 | 8 | 5 | 2 | 15 | 12 | 9 | 6 | 3 | 16 | 13 | 10 | 7 | 4 |
| | Fourth | 10 | 7 | 4 | 1 | 14 | 11 | 8 | 5 | 1 | 14 | 11 | 8 | 5 | 2 | 15 | 12 |
| | average | 5.5 | 11 | 7.5 | 4.5 | 9.5 | 6.5 | 12 | 8.5 | 5 | 10 | 7 | 12 | 9 | 6 | 11 | 8 |
| Equal nozzle feed driving block number | | 1 | 14 | 11 | 8 | 5 | 2 | 15 | 12 | 9 | 6 | 3 | 16 | 13 | 10 | 7 | 4 |
| Raster number | | 17 | 18 | 19 | 20 | 21 | 22 | 23 | 24 | 25 | 26 | 27 | 28 | 29 | 30 | 31 | 32 |
| Driving | First | 2 | 15 | 12 | 9 | 6 | 3 | 16 | 13 | 10 | 7 | 4 | 1 | 14 | 11 | 8 | 5 |
| block | Second | 9 | 6 | 3 | 16 | 13 | 10 | 7 | 4 | 2 | 15 | 12 | 9 | 6 | 3 | 16 | 13 |
| number | Third | 2 | 15 | 12 | 9 | 6 | 3 | 16 | 13 | 10 | 7 | 4 | 1 | 14 | 11 | 8 | 5 |
| | Fourth | 9 | 6 | 3 | 16 | 13 | 10 | 7 | 4 | 2 | 15 | 12 | 9 | 6 | 3 | 16 | 13 |
| | average | 5.5 | 11 | 7.5 | 13 | 9.5 | 6.5 | 12 | 8.5 | 6 | 11 | 8 | 5 | 10 | 7 | 12 | 9 |
| Equal nozzle feed driving block number | | 2 | 15 | 12 | 9 | 6 | 3 | 16 | 13 | 10 | 7 | 4 | 1 | 14 | 11 | 8 | 5 |

It is seen from Tables 8 and 9 and FIGS. 43 and 44 that a fluctuation width of the average value of the driving block numbers can be made smaller, that is, unevenness of density of an recorded image can be made smaller in the case in which feed for the number of nozzles different from the number of driving blocks is performed compared with the case in which the equal nozzle feed is performed. In addition, as described above, it is seen that, if feed of the number of nozzles obtained by subtracting a half of the number of driving blocks from a number obtained by dividing the total number of driving blocks by the number of times of main scanning for performing recording on one raster and feed of the number of nozzles obtained by adding the half of the number of driving blocks to the quotient are alternatingly performed, that is, the 72 nozzle-88 nozzle alternating feed is performed, compared to the case where the 76 nozzle-84 nozzle alternating feed is performed, a period of a fluctuation of the average value of the driving block numbers can be set in higher frequency. This generally corresponds to the fact that a period of unevenness of density of an recorded image can be set in higher frequency, whereby unevenness of density can be less conspicuous.

(Configuration of a Nozzle of an Ink Jet Recording Head)

Next, a configuration of the nozzle of the ink jet recording head will be described. Initially, a reference example showing an example of a configuration of an ink jet recording head that can reduce occurrence of unevenness of density of a recorded image by eliminating a difference of the flow resistances in an ink flow path is described.

(First Reference Example)

A schematic view of a nozzle portion of an ink jet recording head of this reference example is shown in FIGS. 1A to 1C. FIG. 1A is a plan view showing a discharge port forming member in its removed state, FIG. 1B is a plan view of the discharge port forming member viewed from above it, and FIG. 1C is a sectional view cut along the line 1C—1C of FIG. 1A.

This ink jet recording head includes a common liquid chamber 54 connected to an ink supply port 56. On both sides of the common liquid chamber 54, a plurality of electrothermal converting elements 51 for causing ink to bubble and discharging the ink and a plurality of cylindrical pressure chambers 55 having centers in common with the electrothermal converting elements 51 are provided side by side. An ink flow path 53 is provided between each common liquid chamber 54 and each pressure chamber 55. A discharge port 52 is opened in a position opposing each electrothermal converting element 51.

In this ink jet recording head, positions in a printing direction (carriage moving direction) of a set of the discharge port 52 and the electrothermal converting element 51 and another set of them that are adjacent each other deviate by an offset equivalent to a distance that a carriage 102 moves during a lagged time of driving timing between each driving block. For simplicity of illustration, in FIGS. 1A to 1C, an ink jet recording head in which four driving blocks are allocated to each nozzle is shown and an arrangement of the discharge port 52 in a printing direction periodically changes for every four nozzles in a direction of a row of discharge ports.

Then, if numbers are given to the driving blocks in the ascending order of driving timing, in the example shown in FIGS. 1A to 1C, a driving block 1 is allocated to the discharge port 52 at the upper right and the discharge port 52 apart from it by the number of nozzles of integer times of four, a driving block 2 is allocated to the discharge ports 52 on the left of them, a driving block 3 is allocated to the discharge ports 52 on the left of the driving block 2, and a driving block 4 is allocated to the discharge ports 52 on the left of the driving block 3. With such a configuration, the driving blocks 1 to 4 is sequentially driven in the ascending order, whereby it becomes possible to discharge ink and cause the ink discharged from these discharge ports 152 to arrive on a recording medium in one row.

As described above, since the positions of the discharge port 52 and the electrothermal converting elements 51 are different between the adjacent nozzles, the lengths of the ink flow paths 53 of the adjacent nozzles are different. The ink jet recording head of this reference example is characterized in that it is configured such that the flow resistance becomes the same between the nozzles with different lengths of ink flow paths 53. This will be hereinafter described with an ink flow path A and an ink flow path B shown in FIG. 1A as an example.

A length LB of the ink flow path B is longer than a length LA of the ink flow path A. Thus, in this embodiment, the ink jet recording head is configured such that a width WB of the ink flow path B is made wider than a width WA of the ink flow path A, whereby a flow resistance Ra of the ink flow path A and a flow resistance Rb of the ink flow path B are equal.

In this case, the flow resistance Ra of the ink flow path A and the flow resistance Rb of the ink flow path B are obtained by the following Expression 1 to Expression 4:

$$Ra = \eta \int_0^{La} \frac{Da(x)}{Sa(x)^2} dx \quad \text{Expression 1}$$

$$Rb = \eta \int_0^{Lb} \frac{Db(x)}{Sb(x)^2} dx \quad \text{Expression 2}$$

$$Da(x) = 12.0 \times \left(0.33 + 1.02 \times \left(\frac{a1(x)}{b1(x)} + \frac{b1(x)}{a1(x)}\right)\right) \quad \text{Expression 3}$$

$$Db(x) = 12.0 \times \left(0.33 + 1.02 \times \left(\frac{a2(x)}{b2(x)} + \frac{b2(x)}{a2(x)}\right)\right) \quad \text{Expression 4}$$

where, x is a distance from the common liquid chamber;

Sa(x) is a cross section area ($\mu m^2$) of the ink flow path A in the position of the distance x;

Sb(x) is a cross section area ($\mu m^2$) of the ink flow path B in the position of the distance x;

Da(x) is a cross section coefficient of the ink flow path A in the position of the distance x;

Db(x) is a cross section coefficient of the ink flow path B in the position of the distance x;

a1(x) is a height of the ink flow path A in the position of the distance x;

b1(x) is a width of the ink flow path A in the position of the distance x;

a2(x) is a height of the ink flow path B in the position of the distance x;

b2(x) is a width of the ink flow path B in the position of the distance x; and

η is an ink viscosity (N·Pa·s).

Since the ink flow path A and B of this reference example have a substantially rectangular shape from the common liquid chamber 54 to the ends of the electrothermal converting elements 51, rectangular approximation is performed. That is, in Expressions 1 to 4, Da(x) and Db(x) can be regarded as Da and Db, respectively, because x is a constant. In addition, since Sa(x)=WA·H, Sb (x)=WB·H, the following expressions are obtained.

$$Ra \approx \frac{\eta \cdot Da}{(WA \cdot H)^2} \quad \text{Expression 5}$$

$$Rb \approx \frac{\eta \cdot Db}{(WB \cdot H)^2} \quad \text{Expression 6}$$

Thus, when $$WB = \left(\frac{Db \cdot Lb}{Da \cdot La}\right)^{\frac{1}{2}} \cdot WA \quad \text{Expression 7}$$

Ra=Rb.

Therefore, the width WA of the ink flow path A and the width WB of the ink flow path B are set to satisfy the relation of Expression 7, whereby the flow resistances of the ink flow path A and the ink flow path B can be made substantially equal and refill property of the two ink flow paths 53 can be made substantially equal.

In this way, refill property of all the nozzles can be uniform by making the flow resistances of all the ink flow paths 53 equal. Thus, unevenness of density of a recorded image can be suppressed, which is caused by a difference of an amount of ink discharge due to a difference of refill property among each of the ink flow paths 53 when ink is repeatedly discharged at a predetermined frequency. Therefore, according to the present invention, high-grade image recording without unevenness of density can be performed.

Further, in order to allow such high-grade image recording without unevenness of density, it is desirable to keep a difference of a flow resistance among the plurality of ink flow paths 53 within 10%.

In addition, flow resistances of the plurality of ink flow paths 53 with different lengths is made uniform by changing the width of the ink flow path 53 in this reference example. However, since it is sufficient to change the cross section of the ink flow path 53 in order to change the flow resistance, the flow resistance may be made uniform by changing the height of the ink flow path 53, changing both the width and the height of the ink flow path 53 or providing a rib in the ink flow path 53.

In addition, a method of calculating the flow resistance using Expressions 1 to 4 for performing continuous integration is shown in this reference example. However, the flow resistance may be calculated by dividing the ink flow path 53 into a plurality of sections whose shape of cross section is not changed to add up the flow resistance of each section. In this case, expressions for calculating the flow resistance R are represented by Expressions 8 and 9 below:

$$R = \eta \sum_{n=1}^{k} \frac{D(x_n)(x_n - x_{n-1})}{S(x_n)^2} \quad \text{Expression 8}$$

$$D(x_n) = 12.0 \times \left(0.33 + 1.02 \times \left(\frac{a(x_n)}{b(x_n)} + \frac{b(x_n)}{a(x_n)}\right)\right) \quad \text{Expression 9}$$

where, k is the number of division of the ink flow path;

xn is a distance from the common liquid chamber to an nth divided position when the ink flow path is divided into k parts;

S(xn) is a cross section area ($\mu m^2$) of the ink flow path in the position of the distance xn from the common liquid chamber;

D(xn) is a cross section coefficient of the ink flow path in the position of the distance xn;

a(xn) is a height of the ink flow path in the position of the distance xn;

b(xn) is a width of the ink flow path in the position of the distance xn; and

η is an ink viscosity (N·Pa·s)

In addition, the flow resistance of the ink flow path 53 may be obtained by combining Expressions 1 to 4 and Expressions 8 and 9, that is, calculating the flow resistance of a part of the ink flow path 53 based on Expressions 1 to 4, calculating the flow resistance of the other parts of the ink flow path 53 based on Expressions 8 and 9 and adding both the calculated flow resistances.

(Second Reference Example)

Figure 2B:
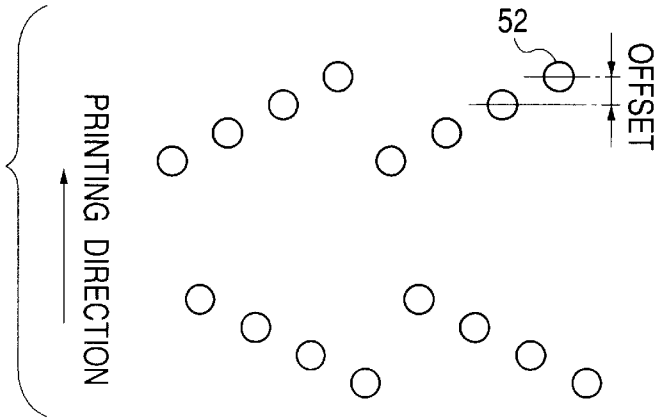
Figure 2A:
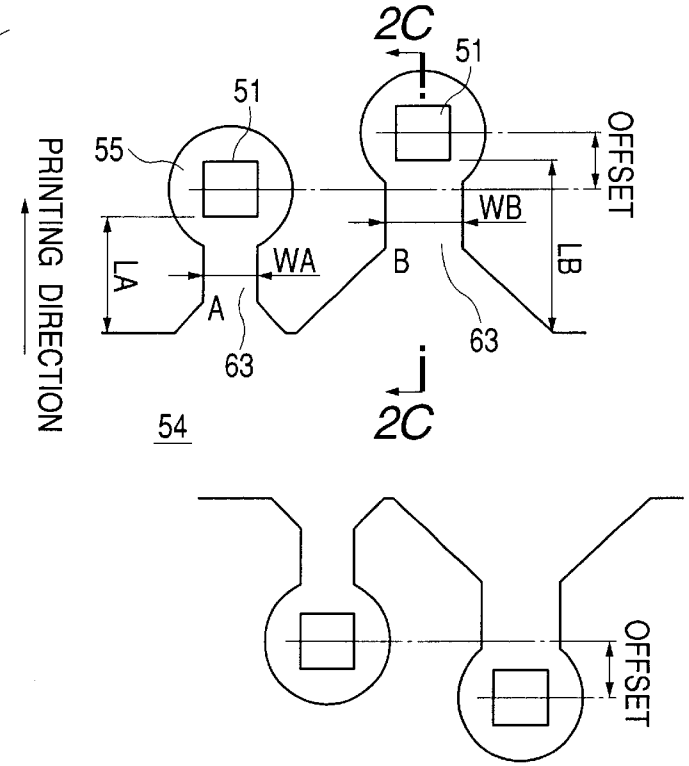

A schematic view of a nozzle portion of an ink jet recording head of this reference example is shown in FIGS. 2A to 2C. FIG. 2A is a plan view showing a discharge port forming member in its removed state, FIG. 2B is a plan view of the discharge port forming member viewed from above it, and FIG. 2C is a sectional view cut along the line 2C—2C of FIG. 2A. In this figure, parts similar to or the same as those in FIGS. 1A to 1C are designated by like reference numerals and reference symbols and description of such parts is omitted.

In the ink jet recording head of this reference example, an ink flow path 63 has a part that widens toward the common liquid chamber 54 on the common liquid chamber 54 side. In this embodiment, the lengths of the adjacent ink flow paths 63 are also different. Flow resistances of a plurality of ink flow paths 63 are calculated as shown in Expressions 1 to 4 or Expressions 8 and 9 to adjust the width and the height of the ink flow path 63 such that the flow resistance is the same in the plurality of ink flow paths 63.

In this configuration, a flow resistance in a part where the width of the ink flow path 54 is wider is smaller than a flow resistance of a part where the width is narrower. Thus, the flow resistance of the part where the width is wider does not affect a flow resistance of the entire ink flow path 54 so significantly, and the flow resistance of the entire ink flow path 54 is generally determined by the flow resistance of the part where the width is narrower.

Note that a part positioned above the ink supply port 56 is the common liquid chamber 54 in this ink jet recording head. The ink supply port 56 is formed by anisotropic etching or the like. A slight dispersion may occur in a width of an opening of the ink supply port 56 facing the common liquid chamber 54, that is, in the width of the common liquid chamber 54 due to dispersion of manufacturing of the ink supply port 56. If dispersion occurs in the width of the common liquid chamber 54 in this way, the length of the ink flow path 63 changes.

When the length of the ink flow path 63 changes as described above, if the ink flow path 63 does not have a part where the width is wider, the flow resistance of the ink flow path 63 changes significantly and refill property of ink changes. Thus, it is likely that, when the ink is repeatedly discharged at a predetermined frequency, a refill state at the time of the ink discharge is different from a designed desired state and an amount of ink discharge increases or decreases or otherwise fluctuates to adversely affect a recording grade.

Further, even if the lengths of the short ink flow path A and the long ink flow path B are changed by the same degree, a rate of change of the length of the ink flow path B is larger than a rate of change of the length of the ink flow path A, whereby a rate of change of the flow resistance of the ink flow path B is larger than a rate of change of the flow resistance of the ink flow path A. Thus, it is likely that, even if the ink flow path A and the ink flow path B are designed such that the flow resistance becomes the same in both the flow paths, a difference is caused in the flow resistances of the ink flow path A and the ink flow path B due to production variance. In this way, when a difference is caused in the flow resistance among the nozzles, a difference is caused in the amount of ink discharge among the nozzles again.

On the other hand, in this reference example, such change of the length of the ink flow path 63 occurs in a part where the width of the ink flow path 63 is wider. Thus, although a flow resistance in a part where the width is wider slightly changes due to the change of the length of the ink flow path 63, this change hardly affects the flow resistance of the entire ink flow path 63 and refill property of ink hardly changes. In addition, a difference among the flow resistances of the plurality of ink flow paths 63 is hardly generated.

As described above, according to this reference example, the part where the width is wider is provided on the common liquid chamber 54 side of the ink flow path 63, whereby refill property of the ink of each nozzle can be made to change little and dispersion of the refill property of the ink from one nozzle to another can be made not to occur even if the width of the common liquid chamber 54 deviates and the length of the ink flow path 63 deviates slightly due to production variance. Thus, it is possible to form a high-grade image.

(Third Reference Example)

Figure 3C:
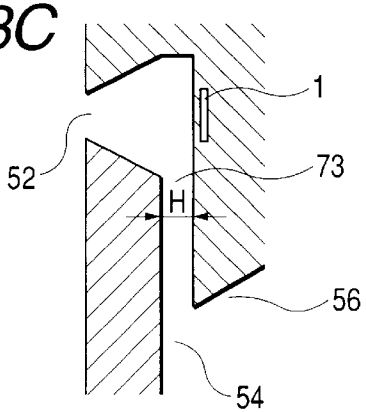
Figure 3B:
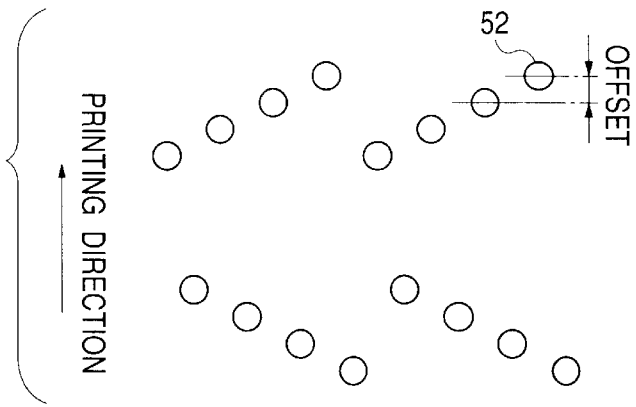
Figure 3A:
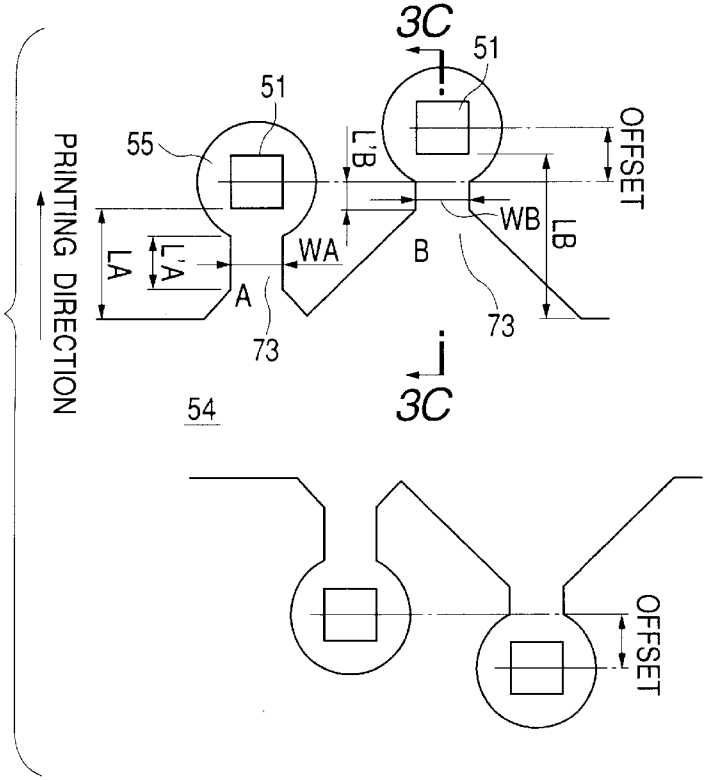

A schematic view of a nozzle portion of an ink jet recording head of this reference example is shown in FIGS. 3A to 3C. FIG. 3A is a plan view showing a discharge port forming member in its removed state, FIG. 3B is a plan view of the discharge port forming member viewed from above it, and FIG. 3C is a sectional view cut along the line 3C—3C of FIG. 3A. In this figure, parts similar to or the same as those in the first and second embodiments are designated by like reference numerals and reference symbols and description of such parts is omitted.

In the ink jet recording head of this reference example, an ink flow path 73 has a part that widens toward the common liquid chamber 54 on the common liquid chamber 54 side as in the second reference example. In this reference example, the width of the part where the width of the ink flow path 73 is narrower is the same in the adjacent nozzles, that is, WA=WB. The flow resistances of the ink flow path A and the ink flow path B of different lengths become the same by changing the lengths of this part L'A and L'B.

Note that in the ink jet recording head, a formed width of the ink flow path 73 may slightly deviate from a designed desired width due to production variance. Thus, if the width WA of the ink flow path A is different from the width WB of the ink flow path B, a rate of change of the width of the ink flow path 73 due to the deviation of the formed width is larger in the narrower ink flow path 73 than in the wider ink flow path 73 even if the deviation of the formed width of the ink flow path 73 occurs in the same way in the ink flow path A and the ink flow path B. Therefore, influence on the ink flow resistance and the refill property by the formed width of the ink flow path is more likely to be generated in the narrower ink flow path 73.

On the other hand, in this reference example, the width of a narrower part where the influence on the flow resistance of the ink flow path 73 is dominant is the same for all the nozzles. Thus, the influence of the deviation of the formed width of the ink flow path 73 due to production variance is generated similarly in all the nozzles, whereby a difference of the flow resistances among the nozzles can be suppressed.

Next, an ink jet recording head of an embodiment of the present invention having a configuration for avoiding damages due to cavitation of electrothermal converting elements will be described.

(First Embodiment)

Figure 4A:
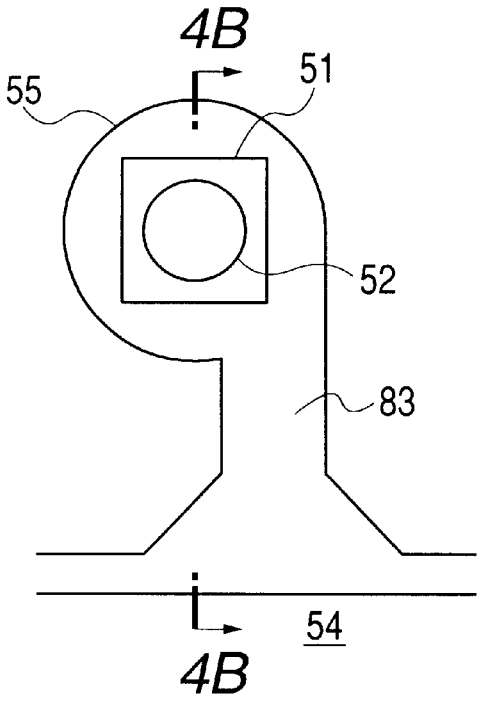
Figure 4B:
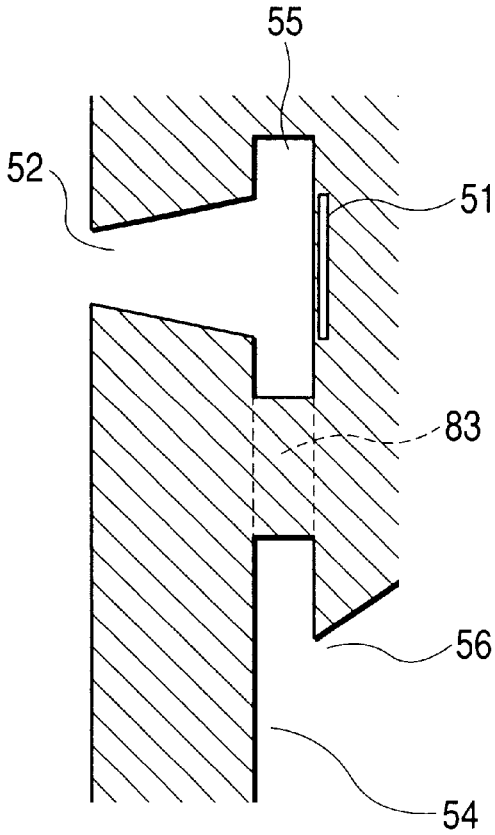

A schematic view of a nozzle portion of an ink jet recording head of this embodiment is shown in FIGS. 4A and 4B. FIG. 4A is a plan view showing a discharge port forming member in its removed state and FIG. 4B is a sectional view cut along the line 4B—4B of FIG. 4A. In this figure, parts similar to or the same as those in the first to the third reference examples are designated by like reference numerals reference symbols and description of such parts is omitted.

In this ink jet recording head, an ink flow path 83 is arranged to be located in a position where its central line is offset from the central line of the electrothermal converting element 51 and the pressure chamber 55 in a direction of supplying ink to the pressure chamber with respect to the electrothermal converting element 51 and the pressure chamber 55 that are arranged such that the center is positioned on the plumb line of the center of the discharge port 52.

This embodiment is for generating a rotating flow component in a flow of refill of ink at the time of bubble disappearance by arranging the ink flow path 83 as described above, thereby reducing influence of cavitation, in particular, influence on the electrothermal converting element 51. This will be described with reference to FIGS. 5A to 5F showing a bubble disappearance process. FIGS. 5A to 5F are schematic plan views of a nozzle and show each transitional state of the bubble disappearance process in the order of FIGS. 5A to 5F.

Figure 5A:
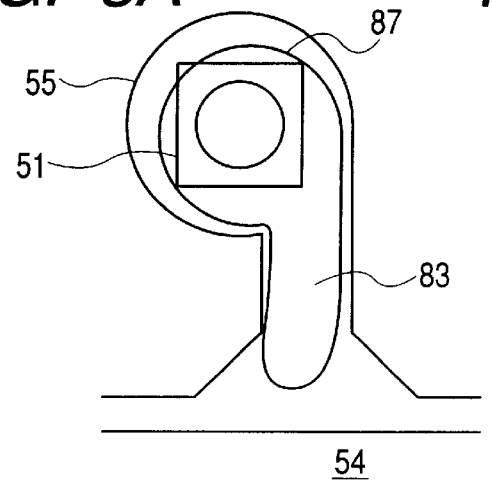
FIGS. 5A, 5B, 5C, 5D, 5E and 5F are plan views of the nozzle portion of the ink jet recording head of FIGS. 4A and 4B and show a bubble disappearance process schematically.
Figure 5D:
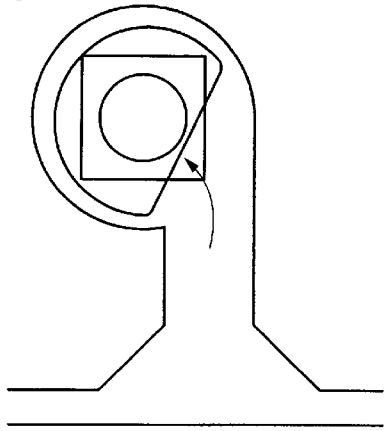
Figure 5B:
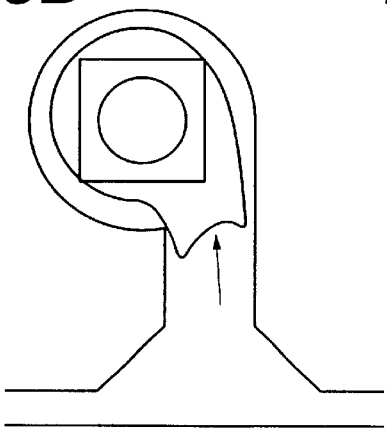

FIG. 5A shows the nozzle part at the time of maximum bubbling when a bubble 87 has a largest size, at which point bubble disappearance is started. Then, as shown in FIG. 5B, a flow of ink from the common liquid chamber 54 is generated simultaneously with the bubble disappearance, and the bubble 87 gets smaller as if a part protruded to the ink flow path 83 subsides.

When the flow of the ink reaches the pressure chamber 55, a flow rate decreases because the space in the center direction of the pressure chamber 55 suddenly expands. As a result, the flow of the ink curves to the center direction of the pressure chamber 55. Consequently, the bubble 87 gets smaller as if it is pressed by the ink in the flowing direction of the ink as shown in FIGS. 5C and 5D.

Figure 5E:
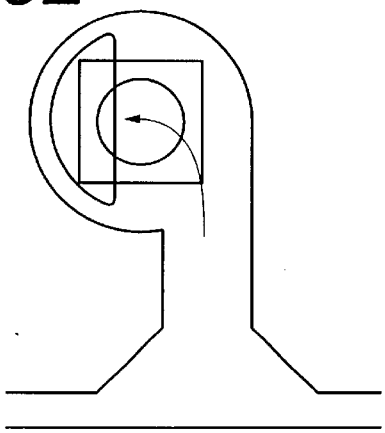
Figure 5C:
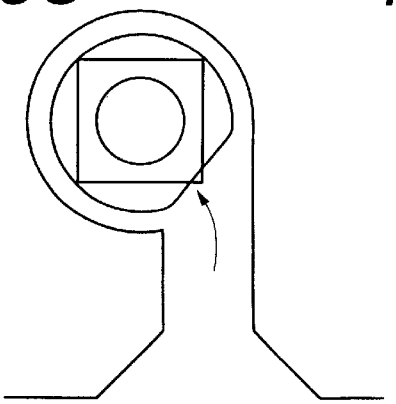
Figure 5F:
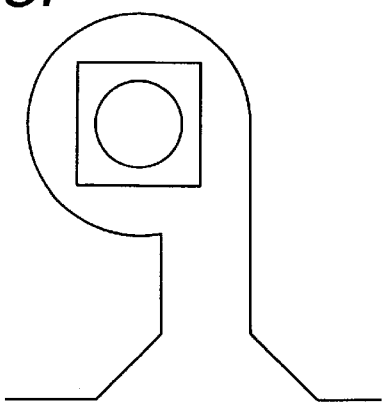

In a process in which the bubble 87 gets even smaller, the bubble 87 is washed away by the flow of the ink to a position slanted to the left side of the pressure camber 55 in FIGS. 5A to 5F. At this point, since the flowing ink has a kinetic moment in a direction from the common liquid chamber 54 to the pressure chamber 55, that is, in a direction to the top of FIGS. 5A to 5F, flow turning over to the bottom of the pressure chamber 55 is small. Thus, the bubble 87 takes a shape extended downward, and takes a crescent-like shape extending vertically as shown in FIG. 5E immediately before bubble disappearance. Then, the final bubble disappearance process shown in FIG. 5F is generated in such a vertically extended area.

As described above, in the ink jet recording head of this embodiment, the flow of the ink in the pressure chamber 55 is unstable as liquid and a bubble disappearance position tends to fluctuate because a rotating component is generated in the flow of the ink at the time of bubble disappearance. Further, since the bubble disappearance occurs while being dispersed in a vertically long area, an impact of cavitation is dispersed in a wide area with respect to the continuous area. As a result, the impact of cavitation does not concentrate in one point and the impact force received by the electrothermal converting element 51 can be reduced.

The bubble disappearance position of FIGS. 5A to 5F is a position where an Al electrode (not shown) supplying electric power to the electrothermal converting element 51 is connected to the electrothermal converting element 51. Although this part is structurally weak due to a step-like shape from the Al electrode toward the electrothermal converting element 51, it was confirmed in a durability test that a trace of cavitation that concentrated in one point in its vicinity was not formed but a long and shallow crack was formed vertically and durability was remarkably improved.

Figure 6:
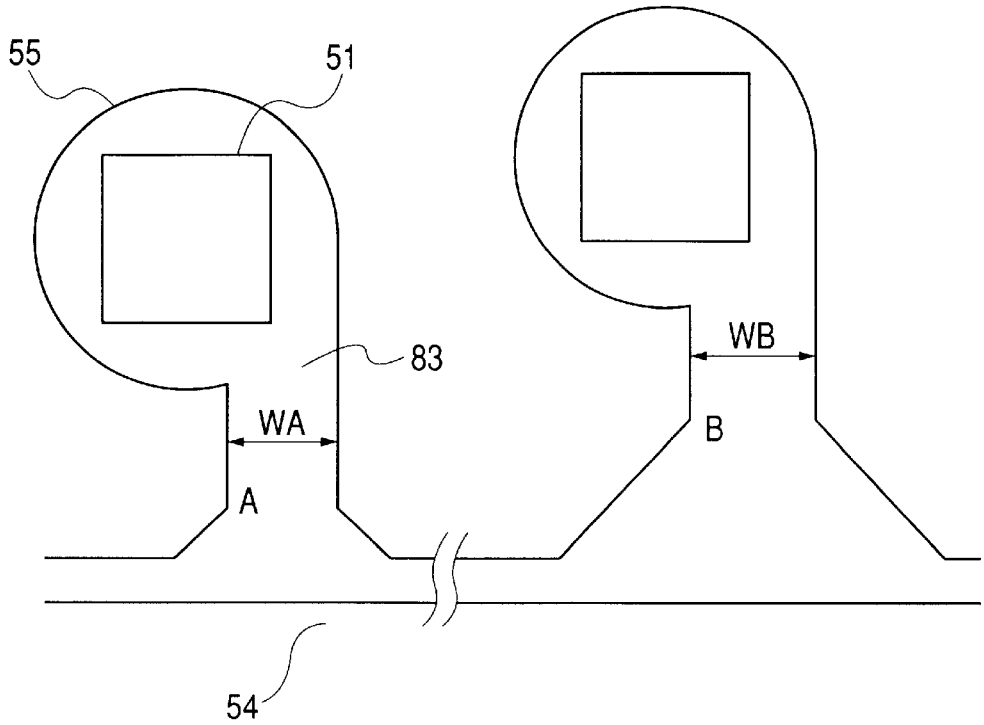
FIG. 6 is a schematic plan view of the nozzle portion of the ink jet recording head of FIGS. 4A and 4B and shows an arrangement of a plurality of nozzles.

In the ink jet recording head of this embodiment, driving timing between the adjacent nozzles is also staggered, the positions of the discharge ports 52 of the adjacent nozzles deviate. As a result, the length of the ink flow path 83 is different among the nozzles as shown in FIG. 6. Further, in order to make the flow resistances of the ink flow paths 83 having different lengths as described above uniform, the width and the length of the ink flow path 83 is changed also in this embodiment.

In this case, since the ink flow path 83 is disposed offset from the central line of the pressure chamber 55, if the width of the ink flow path 83 is different (e.g., WA and WB of FIG. 6), a difference is caused in a positional relation between the electrothermal converting element 51 and the ink flow path 83. Thus, in this embodiment, it is desirable to calculate a flow resistance up to the central position of the electrothermal converting element 51 and make the flow resistance uniform for all the nozzles.

Figure 7:
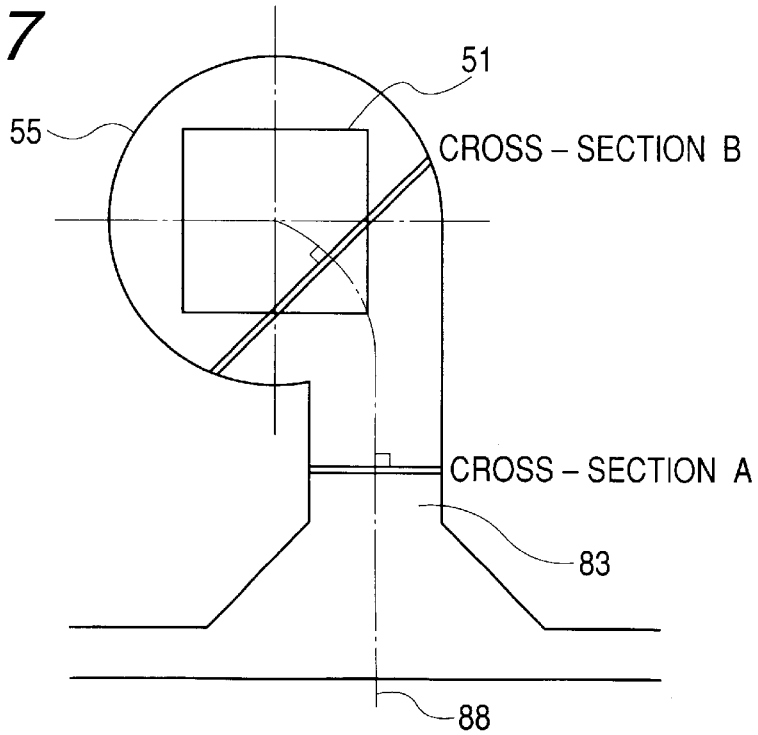
FIG. 7 is a plan view of the nozzle portion of the ink jet recording head of FIGS. 4A and 4B and shows a method of finding a flow resistance schematically.

As shown in FIG. 7, the flow resistance up to the central position of the electrothermal converting element 51 can be obtained by performing the integrations shown in Expressions 1 to 4 or the additions shown in Expressions 8 and 9 along the central axis along the central position of the main flow of the ink. In this case, as a height, a width, an area and the like of the ink flow path at each point, those in a cross section perpendicular to the central axis (e.g., the cross section A and cross section B in FIG. 7) are used.

The refill property of the ink of each nozzle is made uniform by making the flow resistance of each nozzle uniform in this way, whereby the refill state of the ink is substantially the same for every nozzle when the ink is discharged at a predetermined frequency and satisfactory image formation without unevenness of density can be performed.

Figure 8A:
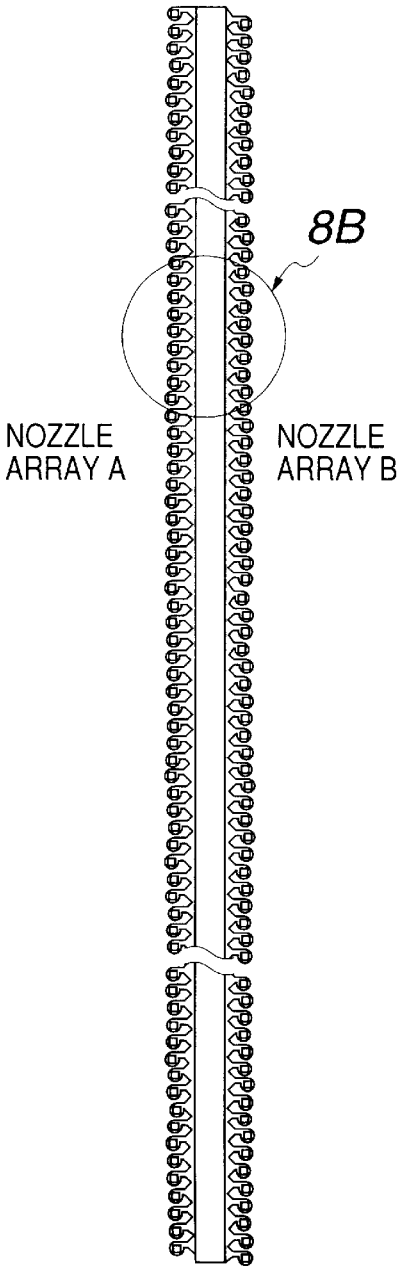
FIG. 8A is a plan view of the entire nozzle portion of the ink jet recording head of FIGS. 4A and 4B.
Figure 8B:
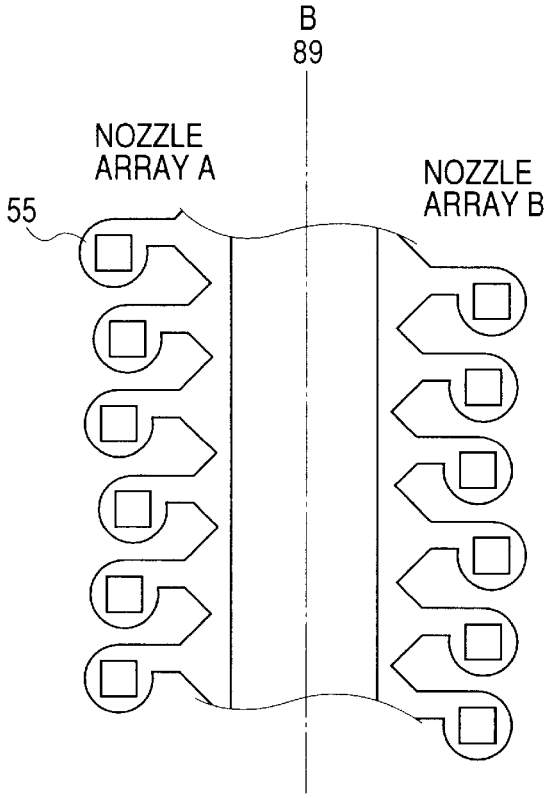
FIG. 8B is an enlarged view of the part 8B in FIG. 8A.

In addition, if the ink flow path 83 is disposed offset with respect to the central line of the pressure chamber 55 and the electrothermal converting element 51 in this way, it is desirable to make the offset direction of the ink flow path 83 with respect to the central line of the electrothermal converting element 51 uniform for all the nozzles included in one nozzle row as shown in an overall view of the nozzle of FIG. 8A and an enlarged view of FIG. 8B. The central axis 8B is designated by reference numeral 89.

Figure 9A:
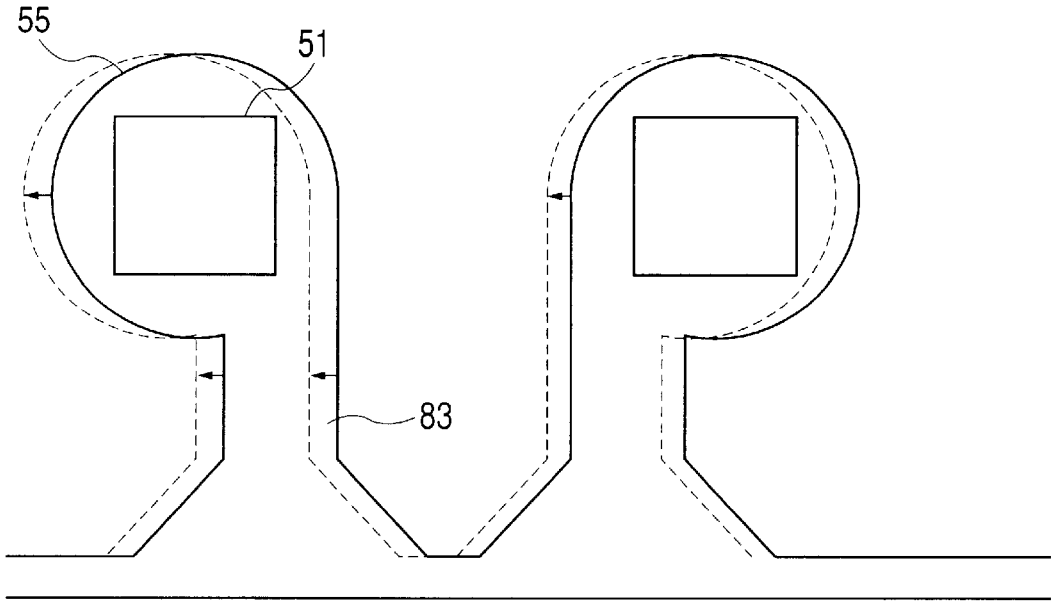
FIGS. 9A and 9B are plan views of the nozzle portion of the ink jet recording head of FIGS. 4A and 4B and show a state in which deviation is generated in a forming position of a nozzle forming member.
Figure 9B:
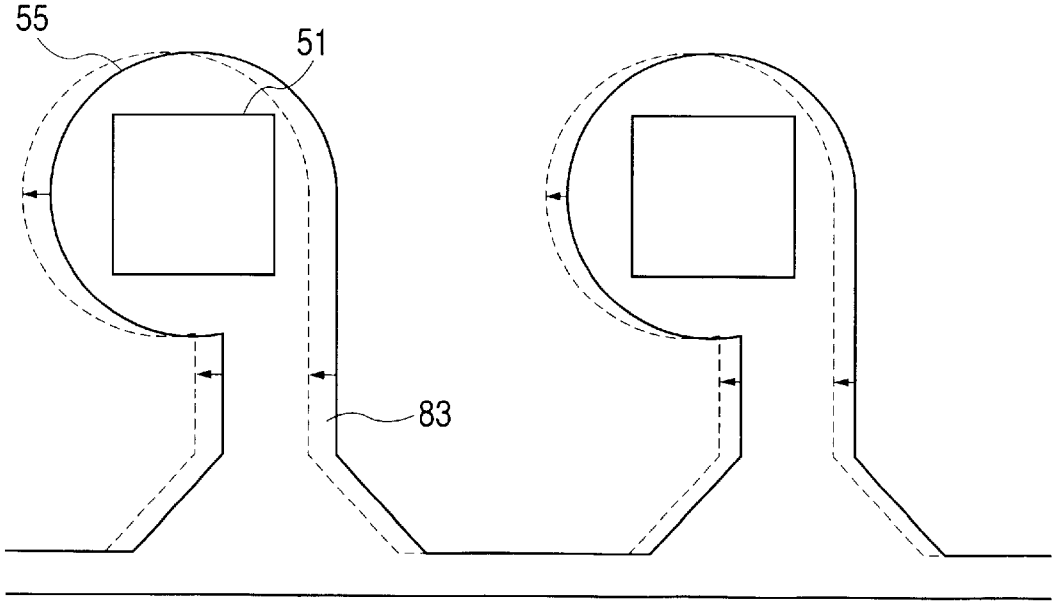

This will be described with reference to FIGS. 9A and 9B showing a plan view of the nozzle. When a member forming the ink flow path 83 and the pressure chamber 55 is patterned on a recording element substrate on which the electrothermal converting element 51 is formed, a mask for patterning may deviate in the nozzle row direction and the ink flow path 83 and the pressure chamber 55 may deviate from their original positions shown by solid lines in FIGS. 9A and 9B to be formed in positions shown by broken lines.

In such a case, as shown in FIG. 9A, if nozzles with different offset directions of the ink flow path 83 with respect to the electrothermal converting element 51 exist, the positional relation between the electrothermal converting element 51 and the ink flow path 83 deviates in different directions in these nozzles. That is, whereas the ink flow path 83 deviates in a direction approaching the electrothermal converting element 51 in the nozzle shown on the left side of FIG. 9A, the ink flow path 83 deviates in a direction separating from the electrothermal converting element 51 in the nozzle on the right side. In addition, this is the same for the positional relation between the discharge port 52 to be disposed in a position opposing the electrothermal converting element 51 and the ink flow path 83. Thus, a difference is caused in the ink discharge property between both the nozzles, and it is likely that a recorded image is disturbed. In addition, even if the width and the height of the ink flow path are adjusted to make the flow resistance uniform between both the nozzles, it is likely that a difference is caused in the flow resistance between both the nozzles.

On the other hand, if offset direction of the ink flow path 83 with respect to the electrothermal converting element 51 is the same as shown in FIG. 9B, since deviation of a positional relation between the electrothermal converting element 51 and the discharge port 52 and the ink flow path 83 occurs in the same way when a formation position of the ink flow path 83 and that of the pressure chamber 55 deviate, the ink discharge property of both the nozzles changes in the same manner. Thus, since the same change occurs in a plurality of nozzles even if a discharge direction and a discharge amount of ink slightly change, influence affecting a recorded image is small.

As described above, the offset direction of the ink flow path 83 with respect to the electrothermal converting element 51 is made the same for each nozzle in one nozzle row, whereby influence on a recorded image due to production variance can be reduced. Similarly, if there are two rows of nozzles on both sides of the common liquid chamber 54, it is desirable to make offset directions of the ink flow path 83 with respect to the electrothermal converting element 51 in the two rows of nozzles line symmetrical with respect to the central axis B 89 parallel to the nozzle rows (see FIG. 8B). That is, with such a configuration, it is possible to cause the deviation of the positional relation between the electrothermal converting element 51 and the ink flow path 83 due to production variance in the same way in both the nozzle rows, whereby influence affecting a recorded image can be reduced.

(Second Embodiment)

Figure 10A:
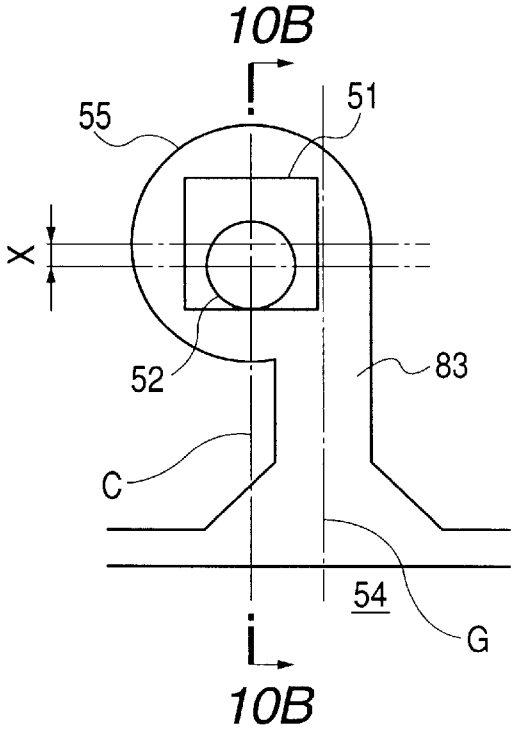
FIGS. 10A and 10B are schematic views showing a nozzle portion in accordance with a second embodiment of the ink jet recording head of the present invention.
Figure 10B:
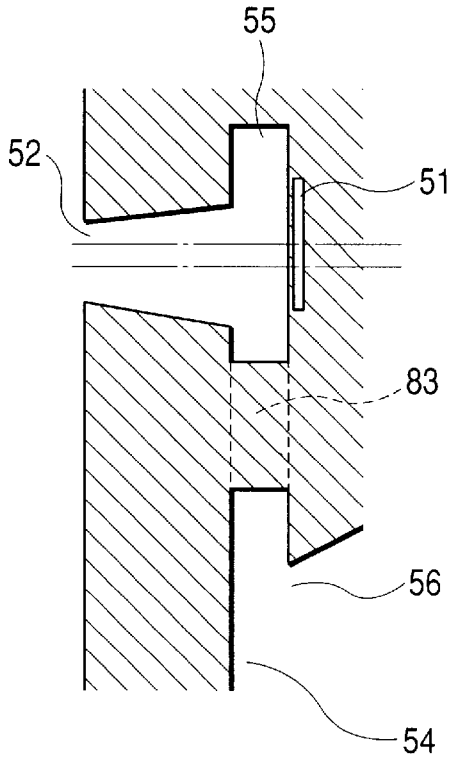

FIGS. 10A and 10B are schematic views showing a nozzle portion in accordance with a second embodiment of the ink jet recording head of the present invention. FIG. 10A is a plan view showing a discharge port forming apparatus in a state in which it is looked through and FIG. 10B is a sectional view cut along the line 10B—10B in FIG. 10A.

In the ink jet recording head of this embodiment, the ink flow path 83 is arranged such that its central line is located in a position offset from the central line of the electrothermal converting element 51 and the discharge port 52 is arranged such that its center is located in a position offset by an amount of offset X in a direction from the center of the electrothermal converting element 51 toward the common liquid chamber 54 on the ink flow path side. Since other configurations of the ink jet recording head of this embodiment are the same as those of the ink jet recording head shown in the first embodiment, detailed description of the configurations is omitted. Reference symbol C denotes a central line of the electrothermal converting element and G denotes a central line of the ink flow path.

FIGS. 11A to 11E show a bubble disappearance process of a bubble after an ink droplet I is discharged from a nozzle of the ink jet recording head shown in FIGS. 10A and 10B in the order of FIGS. 11A to 11E. The states shown in FIGS. 11A to 11E correspond to the states shown in FIGS. 5A to 5E, respectively.

Here, before describing the bubble disappearance process in this embodiment, a bubble disappearance process in the case in which the center of the discharge port 52 is not arranged to be offset from the center of the electrothermal converting element 51 and the centers of the discharge port 52 and the electrothermal converting element 51 are arranged in substantially the same position will be described for a comparison purpose.

Figure 45B:
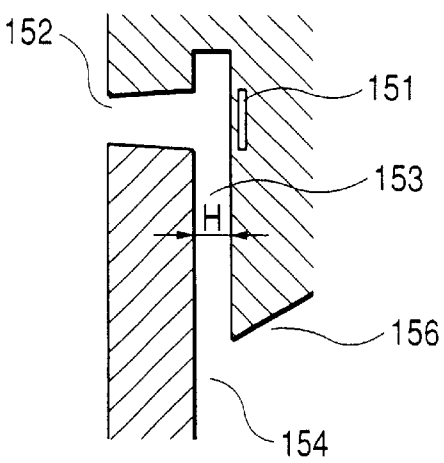
FIG. 45B PRIOR ART
FIGS. 45A and 45B are schematic views showing a nozzle portion of a conventional ink jet recording head.
Figure 45A:
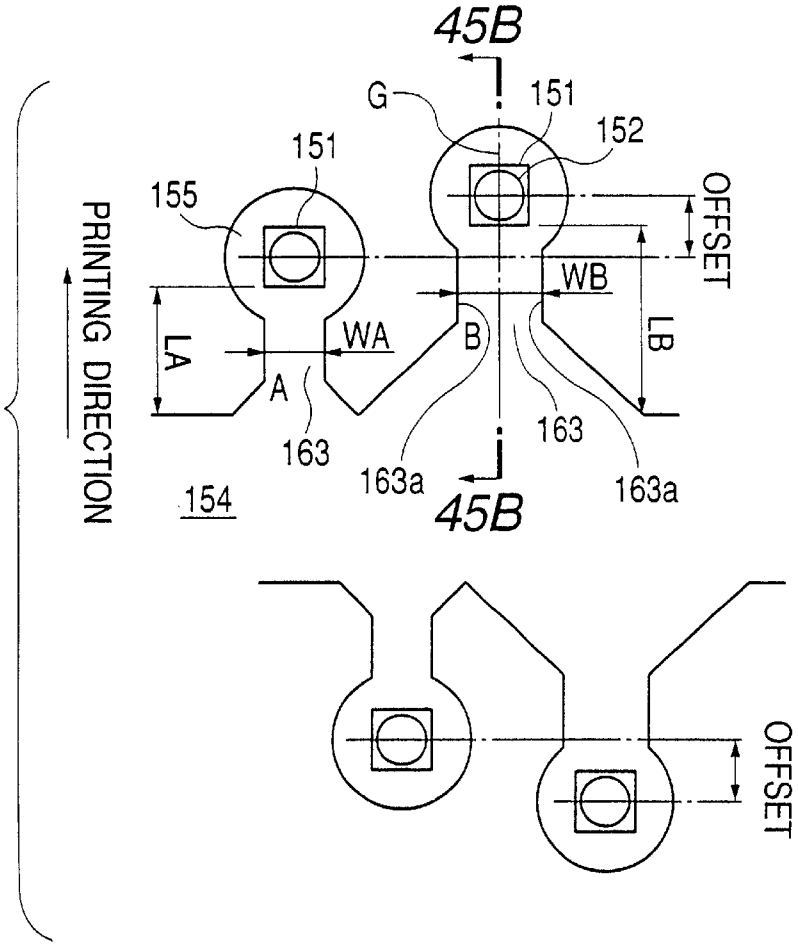
FIG. 45A PRIOR ART

In the an ink jet recording head of a conventional example shown in FIGS. 45A and 45B, ink in the vicinity of a central line of an ink flow path that is apart from an ink flow path wall 163*a* forming an ink flow path 163 most is least susceptible to a liquid friction resistance from the ink flow path wall 163*a* and easy to move. Thus, when the bubble disappearance process starts, the ink in the vicinity of the central line of the ink flow path flows into a pressure chamber 155 in an extremely short time and a bubble turns into a shape with its center recessed down into the pressure chamber 155. As a result, a flow of the ink left between the discharge port 152 and the bubble at the time when it is attracted toward the electrothermal converting element 151 when the bubble is disappeared has a velocity vector in the direction to the inside of the pressure chamber 155 and flows into the inside of the pressure chamber 155 without vertically colliding against the electrothermal converting element 151.

On the other hand, in an ink jet recording head in which the central line of the ink flow path is arranged to be located in a position being offset from the central line of the electrothermal converting element, a phenomenon as described below may occur.

Figures 11A, 11B, 11C, 11D, 11E:
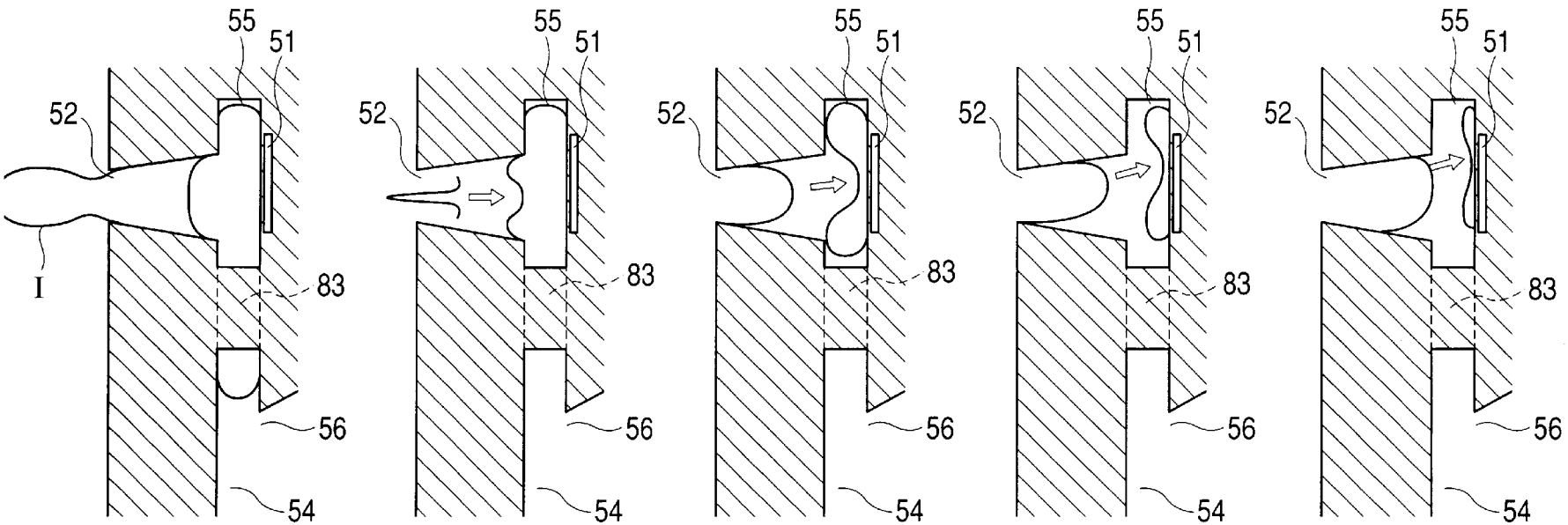
FIGS. 11A, 11B, 11C, 11D and 11E are views showing a bubble disappearance process of a bubble after an ink liquid droplet is discharged from the nozzle of the ink jet recording head shown in FIGS. 10A and 10B.

FIGS. 12$A_1$ and 12$A_2$ through 12$C_1$ and 12$C_2$ are views corresponding to the bubble disappearance process shown in FIGS. 11A to 11C and further show a cross section of a nozzle in each state. In the figures, reference numeral 157 denotes discharged ink and 159 denotes a tail of the discharge ink.

FIGS. 12$A_1$ and 12$A_2$ show a state at the time of maximum bubbling. The bubble 87 generated on the electrothermal converting element 151 grows largely in the direction of the discharge port 152 and an ink droplet 152 protrudes from the discharge port 152.

FIGS. 12$B_1$ and 12$B_2$ show a state in which the bubble starts to contract. At this point, the ink between the discharge port 152 and the bubble is pulled by a negative pressure of the contracting bubble and the central part of the ink starts to take a protruded shape toward the direction of the electrothermal converting element 151. A direction of a velocity vector of the ink at this point is shown by an arrow in FIG. 12$B_2$.

FIGS. 12$C_1$ and 12$C_2$ show a state in which the contraction of the bubble further progresses and the bubble contracts to a size in the same order as the electrothermal converting element 151. The ink between the discharge port 152 and the bubble collides against substantially the center of the electrothermal converting element 151 keeping the velocity vector in the direction toward the electrothermal converting element 151.

As described above, a rotating component is generated in the flow of the ink in the pressure chamber 155 when the bubble is disappeared in a nozzle of a shape in which the central line of the ink flow path is arranged to be located in a position offset from the central line of the electrothermal converting element. Thus, the ink in the vicinity of the central line of the ink flow path never flows in one direction into the center of the bubble in an initial step of contraction of the bubble and the bubble does not become depressed largely. As a result, when the bubble still keeps the size covering the electrothermal converting element 151, the ink existing more on the discharge port 152 side than the bubble substantially vertically falls toward the electrothermal converting element 151 and collides against substantially the center of the electrothermal converting element 151. Although an impact due to this collision is not so large as an impact due to cavitation, if such collision is repeated every time the ink discharge operation is taken, it is possible that the collided position is finally damaged and the electrothermal converting element 151 is destroyed. Although a life of the electrothermal converting element 151 until it is destroyed by this phenomenon is longer than a life of the electrothermal converting element 151 until it is destroyed by cavitation at the time when the bubble is disappeared, this phenomenon becomes an obstacle when it is intended to further improve the durability of the electrothermal converting element 151.

Moreover, a phenomenon as described below also occurs. First, in the conventional ink jet recording head shown in FIGS. 45A and 45B, since the central line of the ink flow path 163 and the central line of the electrothermal converting element 151 coincide with each other as described above, a flow of ink from the common liquid chamber 154 to the pressure chamber 155 through the ink flow path 163 is generated line symmetrically with respect to the central line of the electrothermal converting element 151. Thus, a bubble generated by heating the ink by the electrothermal converting element 151 is steadily disappeared on the electrothermal converting element 151 symmetrically with respect to its central line.

As a result, a micro liquid droplet is generated from a meniscus surface of the ink on the central line of the ink flow path 163 by an impact force of cavitation at the time of bubble disappearance. Since this micro liquid droplet is often generated at substantially the center of the discharge port 152, it is steadily discharged from the discharge port 152 without being blocked by the edge of the discharge port 152.

On the other hand, in an ink jet recording head in which a central line of an ink flow path is arranged to be located in a position offset from a central line of an electrothermal converting element, a phenomenon as described below may occur.

FIGS. 13$A_1$, 13$B_1$, 13$A_2$, 13$B_2$, 13$A_3$ and 13$B_3$ show a situation in which an ink droplet is discharged from a nozzle of the ink jet recording head, in which the central line of the ink flow path is arranged to be located in a position offset from the central line of the electrothermal converting element, in the order of FIGS. 13$A_1$ and 13$B_1$ to FIGS. 13$A_3$ and 13$B_3$. Further, FIGS. 13$A_1$, 13$A_2$ and 13$A_3$ are plan views showing a discharge port forming member in a state in which it is looked through and FIGS. 13$B_1$, 13$B_2$ and 13$B_3$ are sectional views cut along the lines 13$B_1$—13$B_1$, 13$B_2$—13$B_2$ and 13$B_3$—13$B_3$ of FIGS. 13$A_1$, 13$A_2$ and 13$A_3$. In the figures, reference symbol S denotes a satellite, F denotes a micro liquid droplet, M denotes a main droplet and D denotes bubble disappearance.

FIGS. 13$A_1$ and 13$B_1$ show a state immediately after a bubble generated on the electrothermal converting element 151 is disappeared. The main droplet and the satellite droplet following it are discharged from the discharge port 152 along the central axis of the discharge port. As described above, since the central line of the ink flow path 183 is offset from the central lines of the electrothermal converting element 151 and the pressure chamber 155 and a shape of the nozzle is asymmetrical with respect the central line of the ink flow path 183, the bubble disappearance is performed in a bubble disappearance area A shown by a dotted line in the FIG. 13$A_1$. Then, a micro liquid droplet is generated above the bubble disappearance area by an impact at the time of the bubble disappearance. Since the position where the micro liquid droplet is generated deviates from the center of the discharge port 152, the generated micro liquid droplet flies in the vicinity of the edge of the discharge port 152 as shown in FIGS. 13$A_2$ and 13$B_2$.

Since a bubble disappearance position tends to fluctuate in such an asymmetric nozzle, a discharge direction of a micro liquid droplet is unstable. Thus, although the micro liquid droplet is discharged through the discharge port 152 as shown in FIGS. 13$A_3$ and 13$B_3$ in some case, it collides against the edge of the discharge port 152 and deposits on the external surface in the vicinity of the discharge port 152 to form an ink accumulation in many cases.

When the ink accumulation is formed on the external surface in the vicinity of the discharge port and the ink accumulation grows to exceed a certain degree, it interferes with an ink liquid droplet discharged from the discharge port to affect a discharge state of the ink liquid droplet.

FIGS. 14$A_1$, 14$B_1$, 14$A_2$, 14$B_2$, 14$A_3$ and 14$B_3$ show a situation in which an ink liquid droplet I is discharged from a nozzle of an ink jet recording head in a state in which an ink accumulation is formed on an external surface in the vicinity of a discharge port in the order of FIGS. 14$A_1$ and 14$B_1$ to 14$A_3$ and 14$B_3$. Further, FIGS. 14$A_1$, 14$A_2$ and 14$A_3$ show plan views showing a discharge port forming member in a state in which it is looked through and FIGS. 14$B_1$, 14$B_2$ and 14$B_3$ show sectional views cut along the lines 14$B_1$—14$B_1$, 14$B_2$—14$B_2$ and 14$B_3$—14$B_3$ in FIGS. 14$A_1$, 14$A_2$ and 14$A_3$. Reference symbol M denotes a main droplet, I denotes an ink liquid droplet and C denotes a discharge direction.

FIGS. 14$A_1$ and 14$B_1$ show a state in which micro liquid droplets deposit on the external surface in the vicinity of the discharge port 152 and an ink accumulation (T) is formed.

FIGS. 14$A_2$ and 14$B_2$ show a state in which an ink liquid droplet is about to be discharged with the ink accumulation being formed on the external surface in the vicinity of the discharge port 152. When the ink accumulation is formed in the vicinity of the discharge port 152, the ink liquid droplet contacts the ink accumulation when it is discharged from the discharge port 152, being attracted toward the ink accumulation by a surface tension. Then, the ink liquid droplet is discharged to a direction deviating from the central axis of the discharge port.

FIGS. 14$A_3$ and 14$B_3$ show a situation in which formation of an ink liquid droplet ends thereafter and a main droplet and a satellite droplet fly in a direction deviating from the central axis of the discharge port. When a discharge operation is taken in a state in which the ink pool is formed in the vicinity of the discharge port 152 in this way, not only the discharge direction of the ink liquid droplet deviates but also decrease in a discharge speed, an amount of discharge and the like tends to occur simultaneously. As a result, an arriving position of the ink droplet on a recording medium may deviate from an original position to cause "streak," "unevenness" or the like on a recorded image and deteriorate a grade of the recorded image.

Next, the bubble disappearance process in the ink jet recording head of this embodiment will be described with reference to FIGS. 11A to 11E again.

FIG. 11A shows a state at the time of maximum bubbling, when a bubble swells in a discharge direction and an ink liquid droplet starts to be discharged from the discharge port 52.

FIG. 11B shows a state in which the bubble starts to contract thereafter. Ink remaining between the discharge port 52 and the bubble is pulled to the electrothermal converting element 51 by a negative pressure at the time of bubble disappearance and forms a protruded shape toward the direction of the electrothermal converting element 51. At this point, a velocity vector of the ink between the discharge port 52 and the bubble (ink on the discharge port side) points a direction substantially perpendicular to the electrothermal converting element 51 as shown by an arrow in the figure.

FIG. 11C shows a state in which the contraction of the bubble has further progressed thereafter. In a configuration of this embodiment, since the discharge port 52 is arranged relatively on the common liquid chamber 54 side compared with the electrothermal converting element 51, the ink on the discharge port side is subjected to a force pointing an inside direction of the pressure chamber 55 along the central line of the electrothermal converting element 51 in a process in which the bubble contracts. Thus, a velocity vector at the time when the bubble swells to be a size of the same degree as the electrothermal converting element 51 is not perpendicular to the electrothermal converting element 51 but inclines to the inside direction of the pressure chamber 55 as shown by an arrow in FIG. 1C. As a result, even if the bubbling further progresses to be in a state shown in FIG.

11D and further in a state shown in FIG. 1E, the bubble disappearance process ends without the ink on the discharge port side intensively colliding against a position of a part of the electrothermal converting element 51 vertically.

In addition, with a configuration in which the discharge port 52 is offset to the common liquid chamber 54 side as in this embodiment, a state described below can be created in a system in which kinetic energy of the ink on the discharge port side is not slanted to the inside of the pressure chamber 55 at the time of bubble disappearance. That is, since the center of gravity of the ink on the discharge port side approaches the common liquid chamber 54 side, a position where the ink on the discharge port side collides against the electrothermal converting element 51 at the time of bubble disappearance approaches the common liquid chamber 54 side. Thus, timing of the ink on the liquid chamber side flowing from the common liquid chamber 54 side reaching the above-mentioned collision position of the ink on the discharge port side becomes earlier. As a result, the ink on the liquid chamber side flowing from the common liquid chamber 54 side covers a position, where the ink on the discharge port side collides, before the ink on the discharge port side reaches the electrothermal converting element 51 at the time of bubble disappearance. Thus, the ink on the discharge port side does not impact the electrothermal converting element 51 and the electrothermal converting element 51 does not suffer damages.

The bubble disappearance process in this case is shown in FIGS. 15A to 15F and FIGS. 16A to 16E.

Figure 15A:
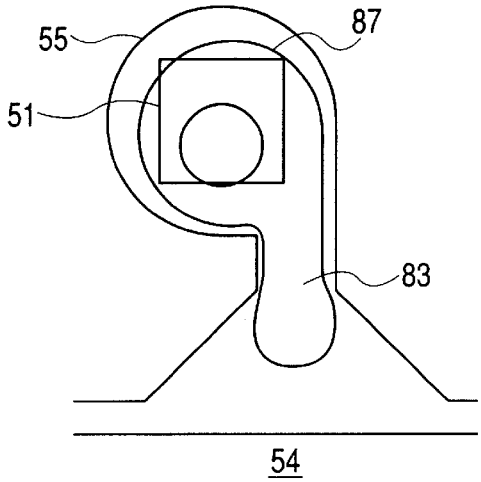
Figure 15D:
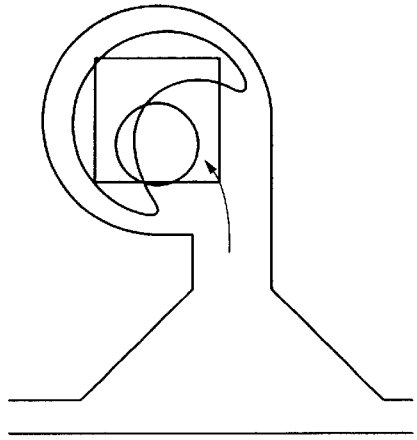
Figure 15B:
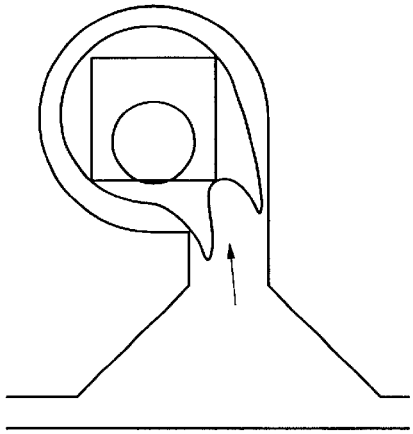
Figure 15E:
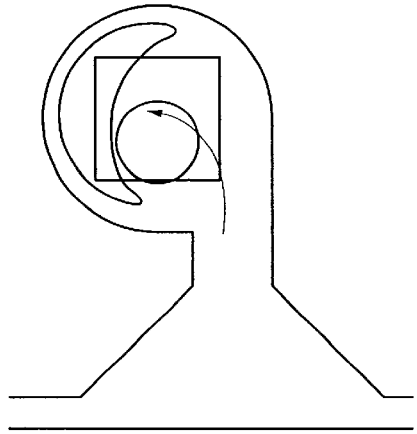
Figure 15C:
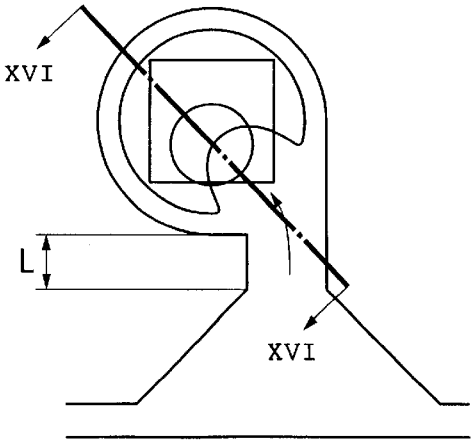
Figure 15F:
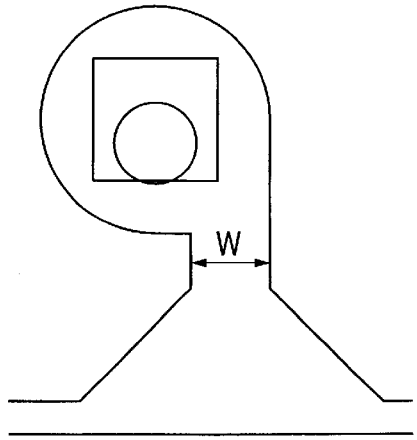
Figures 16A, 16B, 16C, 16D, 16E:
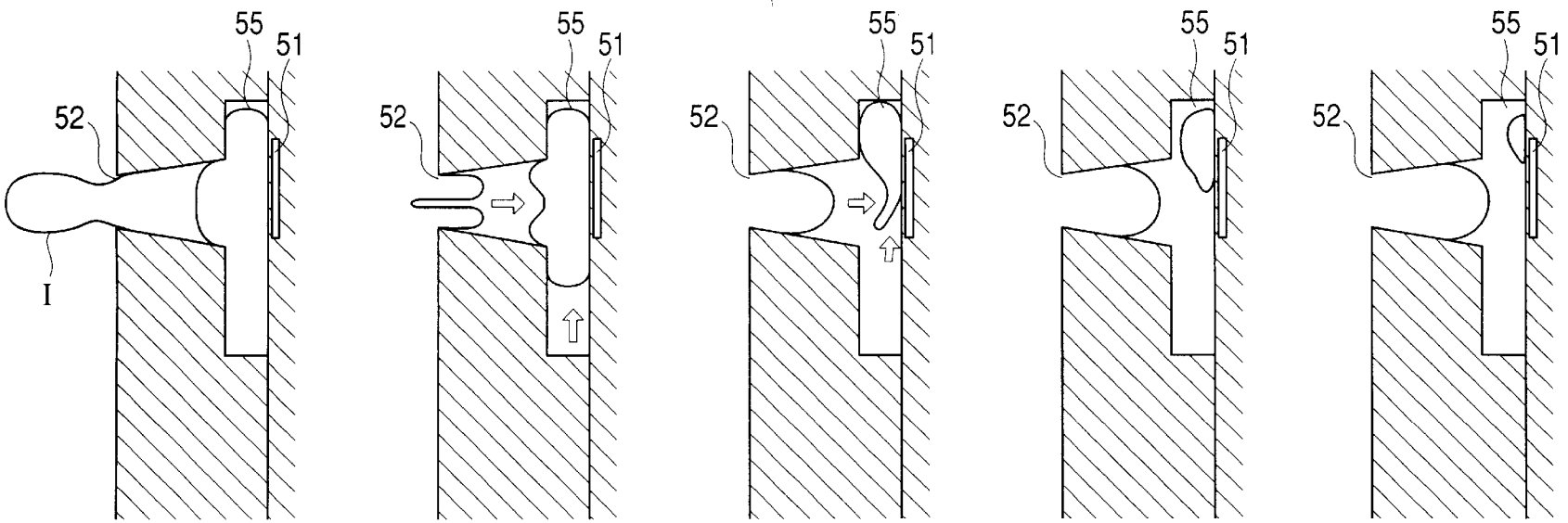
FIGS. 16A, 16B, 16C, 16D and 16E are sectional views cut along the line XVI—XVI of FIG. 15C and showing the same bubble disappearance process as in FIGS. 15A to 15F.

FIGS. 15A to 15F shows a plan view of a bubble from bubbling to bubble disappearance as in FIGS. 5A to 5F. FIGS. 15A, 15E and 15F show states of maximum bubbling, immediately before bubble disappearance and bubble disappearance, respectively. Each of FIGS. 16A to 16E corresponds to FIGS. 11A to 11E in this case. In the configuration of FIGS. 15A to 15F, the length L and the width W of the narrow part of the ink flow path 183 are different from those in the configuration of FIGS. 10A and 10B. More specifically, W is made narrower and L is made longer than the configuration of FIGS. 10A and 10B. Thus, the flow rate of the ink on the liquid chamber side flowing from the common liquid chamber 54 at the time of bubble disappearance can be increased, whereby the bubble at the time of bubble disappearance can be formed in a crescent shape as shown in the figures. In this state, the state shown in FIGS. 16A to 16E can be created. FIGS. 16A to 16E are sectional views cut along the line XVI—XVI of the bubble disappearance process shown in FIG. 15C, being shown such that the relation between the ink on the liquid chamber side and the ink on the discharge port side is easily understood. Although FIGS. 16A and 16B show substantially the same states as FIGS. 11A and 11B, the states in the process of FIGS. 16C to 16E are different from FIGS. 11C to 11E. FIG. 16C shows a situation in which the ink on the liquid chamber side has reached a position where the ink on the discharge port side collides against the electrothermal converting element 51 before the ink on the discharge port side reaches the electrothermal converting element 51. FIG. 16D shows a state in which the ink on the discharge port side contacts to be combined with the ink on the liquid chamber side that has flown onto the electrothermal converting element 51. Further, in FIGS. 16A to 16E, reference symbol I denotes an ink liquid droplet. FIG. 16E shows a state in which the bubble disappearance process has further progressed after the ink on the liquid chamber side and the ink on the discharge port side are combined. In this way, in the above-mentioned configuration, a state in which the ink on the discharge port side directly collides against the electrothermal converting element 51 can be avoided.

In addition, with a configuration in which interaction between the ink on the discharge port side and the ink on the liquid chamber is strengthened at the time of bubble disappearance as in this embodiment, motion of the ink on the discharge port side becomes unstable in the first place. In a configuration in which the ink on the discharge port side collides against the electrothermal converting element 51, a collision position becomes random. Thus, occurrence of damages as in the case in which collision occurs in a specific portion every time the bubble disappearance is performed can be prevented.

In this way, according to this embodiment, the electrothermal converting element 51 does not receive a strong impact force in the bubble disappearance process to thereby hardly suffer damages. As a result, it becomes possible to remarkably improve durability of the electrothermal converting element 51.

In addition, FIGS. 17$A_1$, 17$B_1$, 17$A_2$, 17$B_2$, 17$A_3$ and 17$B_3$ show a situation in which an ink liquid droplet is discharged from the nozzle of the ink jet recording head shown in FIGS. 10A and 10B in the order of FIGS. 17$A_1$ and 17$B_1$ through FIGS. 17$A_3$ and 17$B_3$. Further, FIGS. 17$A_1$, 17$A_2$ and 17$A_3$ are plan views showing the discharge port forming member in a state in which it is looked through and FIGS. 17$B_1$, 17$B_2$ and 17$B_3$ are sectional views cut along the lines 17$B_1$—17$B_1$, 17$B_2$—17$B_2$ and 17$B_3$—17$B_3$ in FIGS. 17$A_1$, 17$A_2$ and 17$A_3$. In the figures, reference symbol C denotes the central line of the electrothermal converting element, G denotes the central line of the ink flow path, M denotes a main droplet and S denotes a satellite.

FIGS. 17$A_1$ and 17$B_1$ show a state immediately after a bubble generated on the electrothermal converting element 51 is disappeared. The main droplet and the satellite droplet following it are discharged from the discharge port 52 along the central axis of the discharge port 52.

As described above, since the center of the discharge port 52 is offset in the direction of the common liquid chamber 54 from the center of the electrothermal converting element 51, the discharge port 52 is arranged in a position that is offset in that direction relatively to the bubble disappearance area A (see FIG. 17$A_1$) that is an energy origin of a micro liquid droplet. Therefore, compared with the case described with reference to FIGS. 13$A_1$ to 13$A_3$ through 13$B_1$ to 13$B_3$, a relative distance between the center of the discharge port 52 and the bubble disappearance position is longer. Thus, a meniscus surface rises a little as shown by an arrow A of FIG. 17$B_1$ in the vicinity of a wall surface of a discharge port taper portion (nozzle) by an impact of cavitation and a micro liquid droplet is hardly generated at the time of bubble disappearance. In addition, even if a micro liquid droplet is generated, since a taper is formed on the wall surface of the discharge port 52 and the discharge port 52 gets narrower toward its front, the micro liquid droplet collides against the wall surface of the discharge port taper portion, not being discharged to the outside of the discharge port 52.

In this way, the micro liquid droplet never collides against the edge of the discharge port 52 and the ink accumulation is not formed on the external surface in the vicinity of the discharge port 52 in the recording head of this embodiment. Thus, as described with reference to FIGS. 14$A_1$ to 14$A_3$ through 14$B_1$ to 14$B_3$, the ink liquid droplet never contacts the ink accumulation to be attracted toward the ink accumulation by a surface tension when it is discharged from the discharge port 52. Therefore, since the ink liquid droplet discharged from the discharge port 52 flies steadily straight along the central axis of the discharge port as shown in FIGS. 17$A_2$ and 17$B_2$ as well as 17$A_3$ and 17$B_3$, an arrival position of the ink liquid droplet is stabilized, whereby a grade of a recorded image can be kept high. Change of a printing grade with respect to an offset amount of the discharge port 52 in the direction of the common liquid chamber 54 is shown in Table 11 below. In the table, "D" indicates that wet twist is conspicuous, "C" indicates that wet twist is a little, "B" indicates that a grade is relatively good, and "A" indicates that a grade is very good.

TABLE 11

| Offset amount (μm) | 10 | 9 | 8 | 7 | 6 | 5 | 4 | 3 | 2 | 1 | 0 |
|---|---|---|---|---|---|---|---|---|---|---|---|
| Printing grade | C | B | B | A | A | A | A | A | B | C | D |

From Table 11, it is seen that wet twist is conspicuous when the position of the discharge port 52 is not offset but wet twist is receded as the offset amount of the discharge port 52 is increased and a very high grade printing is attained at the offset amount of 3 μm to 7 μm.

When an offset amount X (see FIGS. 1A to 1C) of the center of the discharge port 52 with respect to the center of the electrothermal converting element 51 is smaller than 1 μm, a velocity vector slanted to the inside of the pressure chamber 55 cannot be sufficiently given to the ink between the discharge port 52 and the bubble. In addition, the ink on the discharge port side tends to collide against the electrothermal converting element 51 before the ink on the liquid chamber side reaches there. In this case, the colliding position of the ink on the discharge port 52 side is fixed and the electrothermal converting element 51 is susceptible to damages. As a result, durability becomes short. In addition, since the relative distance between the center of the discharge port 52 and the bubble disappearance position becomes short, it is highly likely that a micro liquid droplet generated at the time of bubble disappearance is discharged to the outside of the discharge port 52 without colliding against the wall surface of the discharge port taper portion. Then, an ink accumulation tends to be formed at the outer edge of the discharge port 52 and a discharge direction of a liquid droplet is susceptible to influence of the ink accumulation. On the other hand, when the offset amount X is larger than 10 μm, an acting direction of a discharge pressure at the time of bubbling may be slanted from the central axis of the discharge port 52 by a large degree and the discharge direction of the ink liquid droplet may deviate. Thus, this offset amount X is preferably within the range of $1\ \mu m \leqq X \leqq 10\ \mu m$.

In addition, more preferably, the offset amount X is from 3 μm to 7 μm.

(Third Embodiment)

Figure 18A:
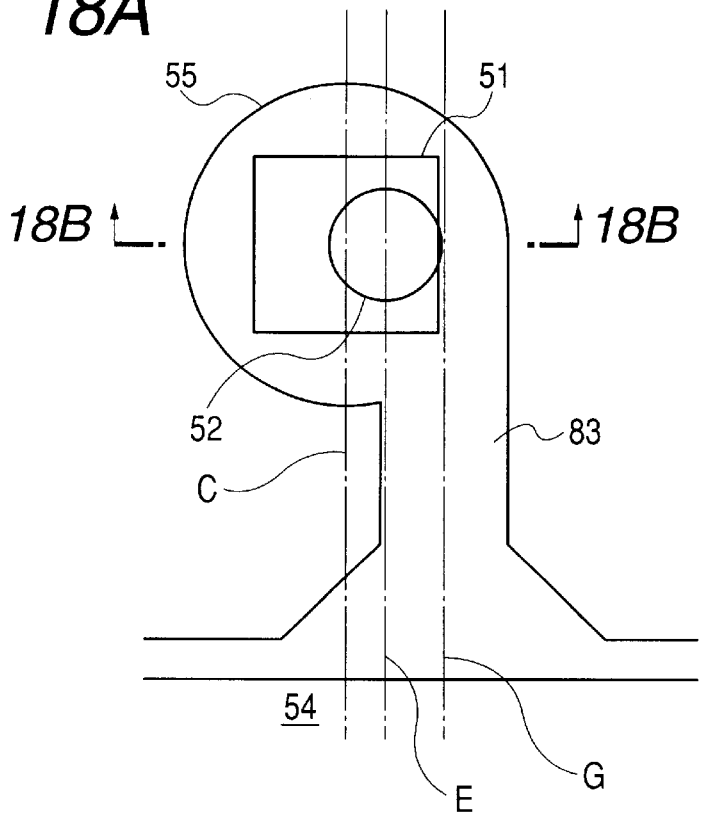
FIGS. 18A and 18B are schematic views showing a nozzle portion in accordance with a third embodiment of the ink jet recording head of the present invention.
Figure 18B:
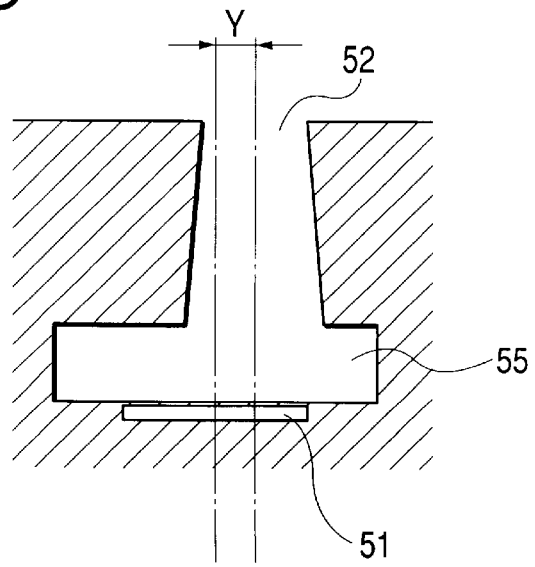

FIGS. 18A and 18B are schematic views showing a nozzle portion in accordance with a third embodiment of the ink jet recording head of the present invention. FIG. 18A is a plan view showing a discharge port forming member in perspective and FIG. 18B is a sectional view cut along the line 18B—18B of FIG. 18A. In the figures, reference symbol C denotes a central line of an electrothermal converting element and G denotes a central line of an ink flow path.

In the ink jet recording head of this embodiment, the ink flow path 83 is arranged such that its central line is located in a position offset from the central line of the electrothermal converting element 51 and the discharge port 52 is arranged such that its center is located in a position offset by an offset amount Y in the direction of the central line of the ink flow path 83 that is on the ink flow path side from the center of the electrothermal converting element 51. Since other configurations of the ink jet recording head of this embodiment are the same as those of the ink jet recording heads shown in the first and the second embodiments, detailed description of the configurations is omitted.

FIGS. 19$A_1$ and 19$A_2$ through 19$C_1$ and 19$C_2$ show a bubble disappearance process of a bubble after an ink liquid droplet is discharged from the nozzle of the ink jet recording head shown in FIGS. 18A and 18B in the order of FIGS. 19$A_1$ and 19$A_2$ through FIGS. 19$C_1$ and 19$C_2$. States shown in FIGS. 19$A_1$ and 19$A_2$ to FIGS. 19$C_1$ and 19$C_2$ correspond to the states shown in FIGS. 11B to 11D, respectively.

FIGS. 19$A_1$ and 19$A_2$ show a state in which the bubble starts to contract after a maximum bubbling state.

In this state, the ink between the discharge port 52 and the bubble is pulled by a negative pressure at the time of bubble disappearance of the bubble and takes a protruded shape toward the direction of the electrothermal converting element 51. A velocity vector of the ink at this point points to a substantially vertical direction with respect to the electrothermal converting element 51 as shown by an arrow in the FIG. 19$A_2$.

FIGS. 19$B_1$ and 19$B_2$ show a state in which the contraction of the bubble has further progressed.

In a configuration of this embodiment, since the discharge port 52 is arranged relatively on the central line side of the ink flow path 83 than the electrothermal converting element 51, the ink on the discharge port side between the discharge port 52 and the bubble is subject to a force pointing to the central line of the electrothermal converting element 51 from the central line of the ink flow path 83 in a process in which the bubble contracts. Thus, a velocity vector at the time when the bubble swells to be substantially the same size as the electrothermal converting element 51 is not perpendicular to the electrothermal converting element 51 but inclines to the inside direction of the pressure chamber 55 as shown by an arrow in FIG. 19$B_2$. As a result, even if the bubbling further progresses and is in a state shown in FIGS. 19$C_1$ and 19$C_2$, the bubble disappearance process ends without the ink on the discharge port side intensively colliding against a part of the electrothermal converting element 51 vertically.

In addition, with a configuration in which the discharge port 52 is offset to the central line side of the ink flow path 83 as in this embodiment, a state described below can also be created in a system in which a moving direction of the ink on the discharge port side is not slanted to the inside of the pressure chamber 55 at the time of bubble disappearance. That is, since the center of gravity of the ink on the discharge port side gets close to the central line side of the ink flow path 83, a position where the ink on the discharge port side collides against the electrothermal converting element 51 at the time of bubble disappearance gets close to the common liquid chamber 54 side. Thus, timing of the ink on the liquid chamber side flowing from the common liquid chamber 54 side reaching the above-mentioned collision position of the ink on the discharge port side becomes earlier. As a result, the ink on the liquid chamber side flowing from the common liquid chamber 54 side covers the position where the ink on the discharge port side collides before the ink on the discharge port side reaches the electrothermal converting element 51 at the time of bubble disappearance. Thus, the ink on the discharge port side does not impact the electrothermal converting element 51 and the electrothermal converting element 51 does not suffer damages.

A state of the interaction between the ink on the discharge port side and the ink on the liquid chamber side in the bubble disappearance process in this case is substantially as shown in FIGS. 15A to 15E and FIGS. 16A to 16E.

In addition, with a configuration in which the interaction between the ink on the discharge port side and the ink on the liquid chamber is strengthened at the time of bubble disappearance as in this embodiment, motion of the ink on he discharge port side becomes unstable in the first place. In a configuration in which the ink on the discharge port side collides against the electrothermal converting element 51, a collision position becomes random. Thus, occurrence of damages as in the case in which collision occurs in a specific portion every time the bubble disappearance is performed can be prevented. In this way, according to this embodiment, the electrothermal converting element 51 does not receive a strong impact force in the bubble disappearance process and hardly suffers damages. As a result, it becomes possible to remarkably improve durability of the electrothermal converting element 51.

In addition, FIGS. 20$A_1$, 20$B_1$, 20$A_2$, 20$B_2$, 20$A_3$ and 20$B_3$ show a situation in which an ink liquid droplet is discharged from the nozzle of the ink jet recording head shown in FIGS. 18A and 18B in the order of FIGS. 20$A_1$ and 20$B_1$ through FIGS. 20$A_3$ and 20$B_3$. Further, FIGS. 20$A_1$, 20$A_2$ and 20$A_3$ are plan views showing the discharge port forming member in a state in which it is looked through and FIGS. 20$B_1$, 20$B_2$ and 20$B_3$ are sectional views cut along the lines 20$B_1$—20$B_1$, 20$B_2$—20$B_2$ and 20$B_3$—20$B_3$ of FIGS. 20$A_1$, 20$A_2$ and 20$A_3$. In the figures, reference symbol M denotes a main droplet and S denotes a satellite, E denotes the central line of the discharge port, D denotes the bubble disappearance and A denotes the bubble disappearance area.

FIGS. 20$A_1$ and 20$B_1$ show a state immediately after a bubble generated on the electrothermal converting element 51 is disappeared. The main droplet and the satellite droplet following it are discharged from the discharge port 52 along the central axis of the discharge port 52.

As described above, since the center of the discharge port 52 is offset on the center side of the ink flow path 83 from the center of the electrothermal converting element 51, the discharge port 52 is arranged in a position that is offset in a direction relatively more apart from the bubble disappearance area A (see FIG. 17$A_1$) that is an energy origin of a smaller liquid droplet than in the above-mentioned first embodiment. Therefore, compared with the case described with reference to FIGS. 13$A_1$ to 13$A_3$ through 13$B_1$ to 13$B_3$, a relative distance between the center of the discharge port 52 and the bubble disappearance position is longer. Thus, a meniscus surface is hardly subject to an impact of cavitation and a micro liquid droplet is hardly generated at the time of bubble disappearance. In addition, even if a micro liquid droplet is generated, since a taper is formed on the wall surface of the discharge port 52 and the discharge port 52 gets narrower toward its front, the micro liquid droplet collides against the wall surface of the discharge port taper portion and is not discharged to the outside of the discharge port 52.

In this way, the micro liquid droplet never collides against the edge of the discharge port 52 and the ink accumulation is not formed on the external surface in the vicinity of the discharge port 52 in the recording head of this embodiment. Thus, as described with reference to FIGS. 14$A_1$ to 14$A_3$ through 14$B_1$ to 14$B_3$, the ink liquid droplet never contacts the ink accumulation to be attracted toward the ink accumulation by a surface tension when it is discharged from the discharge port 52. Therefore, since the ink liquid droplet discharged from the discharge port 52 flies steadily straight along the central axis of the discharge port 52 as shown in FIGS. 20$A_2$ and 20$B_2$ as well as 20$A_3$ and 20$B_3$, an arrival position of the ink liquid droplet is stabilized, whereby a grade of a recorded image can be kept high. When an offset amount Y (see FIGS. 3A to 3C) of the center of the discharge port 52 with respect to the center of the electrothermal converting element 51 is smaller than 1 $\mu$m, a velocity vector slanted to the inside of the pressure chamber 55 cannot be sufficiently given to the ink between the discharge port 52 and the bubble. On the other hand, if the offset amount Y is larger than 10 $\mu$m, an acting direction of a discharge pressure at the time of bubbling is slanted from the central axis of the discharge port 52 by a large degree and adversely affects the discharge direction of the ink liquid droplet. Thus, this offset amount Y is desirably within the range of $1\ \mu m \leqq Y \leqq 10\ \mu m$.

(Fourth Embodiment)

Figure 21A:
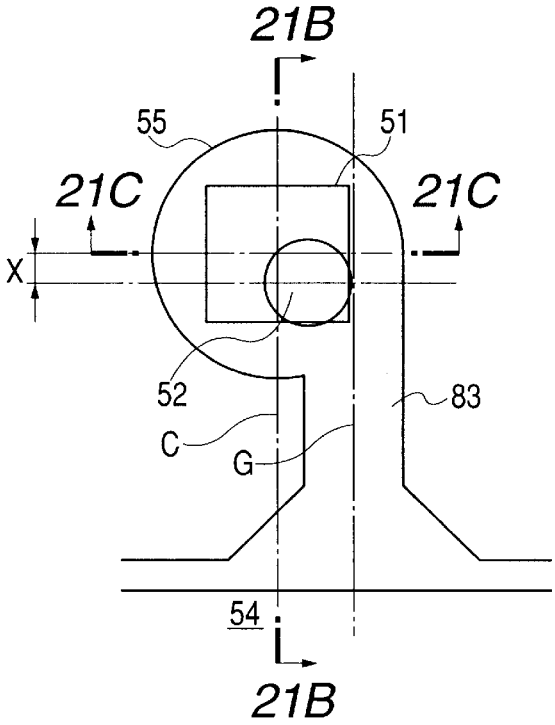
FIGS. 21A, 21B and 21C are schematic views showing a nozzle portion in accordance with a fourth embodiment of the ink jet recording head of the present invention.
Figure 21B:
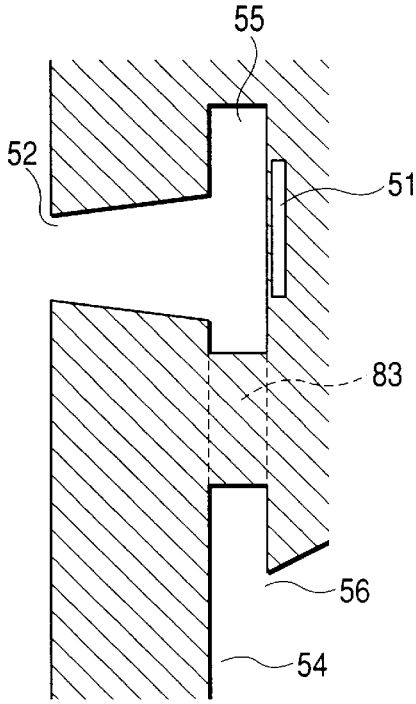
Figure 21C:
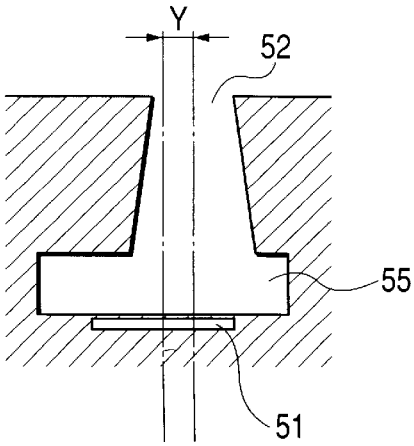

FIGS. 21A to 21C are schematic views showing a nozzle portion in accordance with a fourth embodiment of the ink jet recording head of the present invention. FIG. 21A is a plan view showing a discharge port forming member in a state in which it is looked through, FIG. 21B is a sectional view cut along the line 21B—21B of FIG. 21A, and FIG. 21C is a sectional view cut along the line 21C—21C of FIG. 21A.

In the ink jet recording head of this embodiment, the ink flow path 83 is arranged such that its central line is located in a position offset from the central line of the electrothermal converting element 51. In addition, the discharge port 52 is arranged such that its center is located in a position offset by an offset amount X in the direction from the center of the electrothermal converting element 51 to the common liquid chamber 54 and at the same time its center is located in a position offset by an offset amount Y to the direction of the central line of the ink flow path 83 from the center of the electrothermal converting element 51. Since other configurations of the ink jet recording head of this embodiment are the same as those of the ink jet recording heads shown in the first to the third embodiments, detailed description of the configurations is omitted.

As in the above-mentioned second and third embodiments, according to the configuration of this embodiment, at the time when the ink between the discharge port 52 and the bubble moves in the direction of the electrothermal converting element 51 following contraction at the time of bubble disappearance, it also has a velocity vector that is not perpendicular to the electrothermal converting element 51 but inclines to the inside direction of the pressure chamber 55. As a result, the bubble disappearance process ends without the ink intensively colliding against a position of a part of the electrothermal converting element 51 vertically.

In addition, with a configuration in which the discharge port 52 is offset to the common liquid chamber 54 side as in this embodiment, a state described below can also be created in a system in which a moving direction of the ink on the discharge port side is not slanted to the inside of the pressure chamber 55 at the time of bubble disappearance. That is, since the center of gravity of the ink on the discharge port side gets close to the common liquid chamber 54 side, a position where the ink on the discharge port side collides against the electrothermal converting element 51 at the time of bubble disappearance gets close to the common liquid chamber 54 side. Thus, timing of the ink on the liquid chamber side flowing from the common liquid chamber 54 side reaching the above-mentioned collision position of the ink on the discharge port side becomes earlier. As a result, the ink on the liquid chamber side flowing from the common liquid chamber 54 side covers the position where the ink on the discharge port side collides before the ink on the discharge port side reaches the electrothermal converting element 51 at the time of bubble disappearance. Thus, the ink on the discharge port side does not impact the electrothermal converting element 51 and the electrothermal converting element 51 does not suffer damages.

In addition, with a configuration in which the interaction between the ink on the discharge port side and the ink on the liquid chamber is strengthened at the time of bubble disappearance as in this embodiment, motion of the ink on he discharge port side becomes unstable in the first place. In a configuration in which the ink on the discharge port side collides against the electrothermal converting element 51, a collision position becomes random. Thus, occurrence of damages as in the case in which collision occurs in a specific portion every time the bubble disappearance is performed can be prevented.

Therefore, the electrothermal converting element 51 does not receive a strong impact force in the bubble disappearance process and hardly suffers damages. As a result, it becomes possible to remarkably improve durability of the electrothermal converting element 51.

In addition, since the center of the discharge port 52 is offset in the direction of the common liquid chamber 54 direction from the center of the electrothermal converting element 51, the discharge port 52 is arranged in a position that is offset in that direction relatively apart from the bubble disappearance area A (see FIG. 21A) that is an energy origin of a micro liquid droplet. Therefore, compared with the case described with reference to FIGS. 13$A_1$ to 13$A_3$ through 13$B_1$ to 13$B_3$, a relative distance between the center of the discharge port 52 and the bubble disappearance position is longer. Thus, a meniscus surface rises a little in the vicinity of a wall surface of a discharge port taper portion (nozzle) by an impact of cavitation and a micro liquid droplet is hardly generated at the time of bubble disappearance. In addition, even if a micro liquid droplet is generated, since the discharge port taper portion gets narrower toward the front in the discharge direction, the micro liquid droplet collides against the wall surface of the discharge port taper portion and is not discharged to the outside of the discharge port 52.

In this way, the micro liquid droplet never collides against the edge of the discharge port 52 and the ink accumulation is not formed on the external surface in the vicinity of the discharge port 52 in the ink jet recording head of this embodiment. Thus, as described with reference to FIGS. 14$A_1$ to 14$A_3$ through 14$B_1$ to 14$B_3$, the ink liquid droplet never contacts the ink accumulation to be attracted toward the ink accumulation by a surface tension when it is discharged from the discharge port 52. Therefore, since the ink liquid droplet discharged from the discharge port 52 flies steadily straight along the central axis of the discharge port, an arrival position of the ink liquid droplet is stabilized, whereby a grade of a recorded image can be kept high.

Further, in the case in which the discharge port 52 is offset in two directions as in this embodiment, when it is assumed that an offset amount of the center of the discharge port 52 from the center of the electrothermal converting element 51 is Z, the offset amount Z can be represented as $Z=\sqrt{(X^2+Y^2)}$. Therefore, if the offset amount Z is to be adjusted to the same degree as the offset amount of the second embodiment shown in FIGS. 10A and 10B or the third embodiment shown in FIGS. 18A and 18B, each of the offset amount X and Y shown in FIGS. 21A to 21C becomes smaller than the offset amounts X and Y shown in the second embodiment or the third embodiment. Therefore, this embodiment has an advantage in that the velocity vector of the ink between the discharge port 52 and the bubble can be directed to the inside of the pressure chamber 55 as in the cases of the second and the third embodiments while keeping the offset amounts X and Y of the center of the discharge port 52 from the center of the electrothermal converting element 51 relatively small.

(Fifth Embodiment)

Figure 22B:
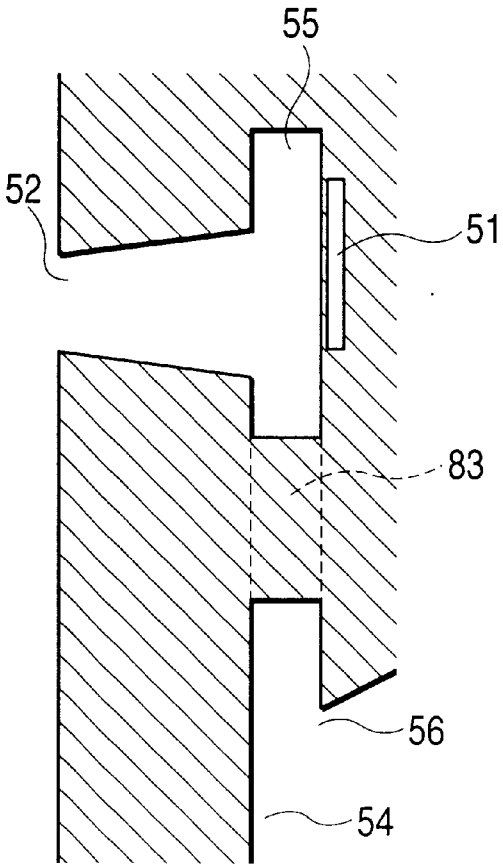
FIGS. 22A and 22B are schematic views showing a nozzle portion in accordance with a fifth embodiment of the ink jet recording head of the present invention.
Figure 22A:
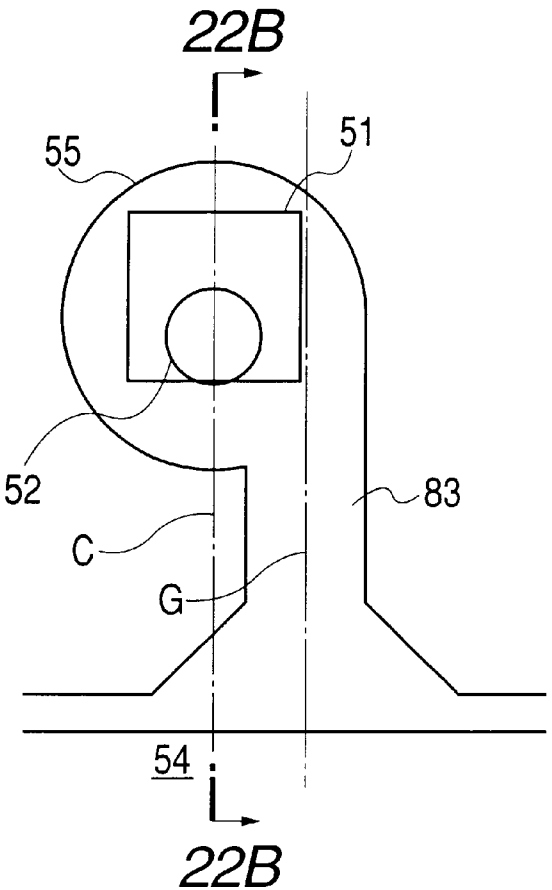

FIGS. 22A and 22B are schematic views showing a nozzle portion in accordance with a fifth embodiment of the ink jet recording head of the present invention. FIG. 22A is a plan view showing a discharge port forming member in a state in which it is looked through and FIG. 22B is a sectional view cut along the line 22B—22B of FIG. 22A. In the figures, reference symbol C denotes a central line of an electrothermal converting element (central line of a pressure chamber) and G denotes a central line of an ink flow path.

In the ink jet recording head of this embodiment, the ink flow path 83 is arranged such that its central line is located in a position offset from the central line of the electrothermal converting element 51. In addition, the discharge port 52 is arranged such that its center is located in a position offset in the direction to the common liquid chamber 54 from the center of the pressure chamber 55 and the electrothermal converting element 51 is arrange such that its center is located in a position offset in the direction to the inside of the pressure chamber 55 from the center of the pressure chamber 55. The relative positional relation between the discharge port 52 and the electrothermal converting element 51 in this embodiment is the same as that shown in FIGS. 10A and 10B. A characteristic point of this embodiment resides in the fact that the center of the electrothermal converting element 51 is arranged offset with respect to the center of the pressure chamber 55. Since other configurations of the ink jet recording head of this embodiment are the same as those of the ink jet recording heads shown in the second embodiment, detailed description of the configurations is omitted.

In the configurations shown in FIGS. 10A, 10B, 18A, 18B, 21A, 21B and 21C, when the offset amount of the center of the discharge port 52 with respect to the center of the pressure chamber 55 becomes excessively large, a flow resistance balance in the pressure chamber 55 is collapsed and a discharge direction of an ink liquid droplet tends to change or a bubble accumulation tends to be generated in the pressure chamber 55 because a dead space increases in the pressure chamber 55. Here, "bubble accumulation" means that bubbles formed by bubbles solved in ink gathering are held up.

On the other hand, according to the configuration of this embodiment, the offset amount between the center of the discharge port 52 and the electrothermal converting element 51 can be set large while keeping the offset amount of the center of the discharge port 52 from the center of the pressure chamber 55 small. Thus, it is possible to substantially eliminate a state in which the electrothermal converting element 51 is subject to a strong impact force and suffers damages in the bubble disappearance process while attaining appropriate maintenance in a discharge direction of an ink droplet and suppression of a bubble accumulation in the pressure chamber 55.

In addition, since the center of the discharge port 52 is offset in the direction of the common liquid chamber 54 direction from the center of the electrothermal converting element 51, the discharge port 52 is arranged in a position that is offset in the direction relatively apart from the bubble disappearance area that is an energy origin of a micro liquid droplet. Therefore, compared with the case described with reference to FIGS. 13$A_1$ to 13$A_3$ through 13$B_1$ to 13$B_3$, a relative distance between the center of the discharge port 52 and the bubble disappearance position is longer. Thus, a meniscus surface rises a little in the vicinity of a wall surface of a discharge port taper portion (nozzle) by an impact of cavitation and a micro liquid droplet is hardly generated at the time of bubble disappearance. In addition, even if a micro liquid droplet is generated, since the discharge port taper portion gets narrower toward the front of the discharge direction, the micro liquid droplet collides against the wall surface of the discharge port taper portion and is not discharged to the outside of the discharge port 52.

In this way, the micro liquid droplet never collides against the edge of the discharge port 52 and the ink accumulation is not formed on the external surface in the vicinity of the discharge port 52 in the recording head of this embodiment. Thus, as described with reference to FIGS. 14$A_1$ to 14$A_3$ through 14$B_1$ to 14$B_3$, the ink droplet never contacts the ink accumulation to be attracted toward the ink accumulation by a surface tension when it is discharged from the discharge port 52. Therefore, since the ink droplet discharged from the discharge port 52 flies steadily straight along the central axis of the discharge port as shown in FIGS. 17$A_2$ and 17$B_2$ as well as 17$A_3$ and 17$B_3$, an arrival position of the ink droplet is stabilized, whereby a grade of a recorded image can be kept high.

As a result, it becomes possible to remarkably improve durability of the electrothermal converting element 51 while keeping a grade of a recorded image high.

Further, a configuration to which this embodiment can be applied is not limited to the above. For example, in the configurations shown in FIGS. 18A, 18B, 21A, 21B and 21C, the center of the electrothermal converting element 51 is offset from the center of the pressure chamber 55 in the direction opposite the direction from the center of the electrothermal converting element 51 to the center of the discharge port 52, whereby effects similar to those described in the above-mentioned embodiments can be realized.

(Sixth Embodiment)

Figure 23B:
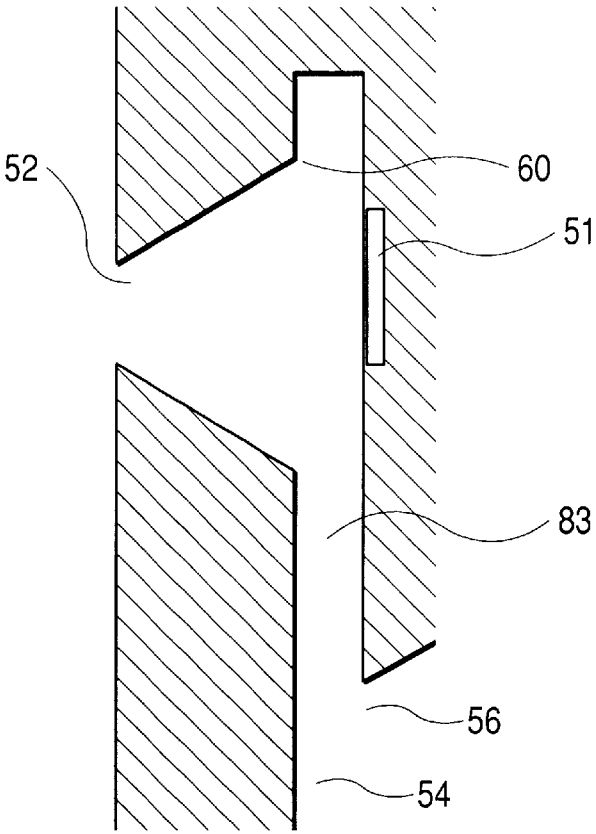
FIGS. 23A and 23B are schematic views showing a nozzle portion in accordance with a sixth embodiment of the ink jet recording head of the present invention.
Figure 23A:
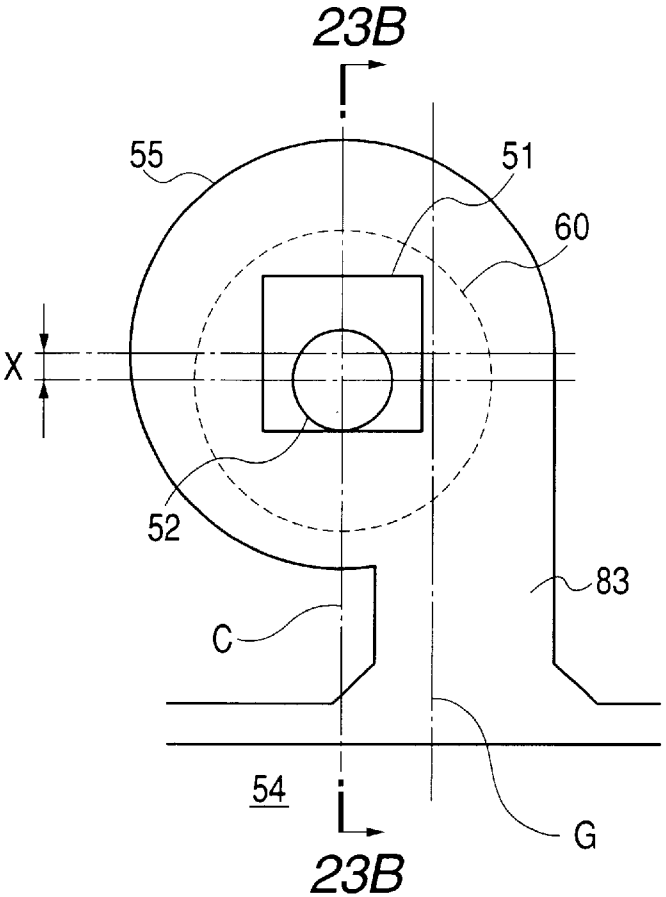

FIGS. 23A and 23B are schematic views showing a nozzle portion in accordance with a sixth embodiment of the ink jet recording head of the present invention. FIG. 23A is a plan view showing a discharge port forming member in a state in which it is looked through and FIG. 23B is a sectional view cut along the line 23B—23B of FIG. 23A. In the figures, reference symbol C denotes a central line of an electrothermal converting element (central line of a pressure chamber) and G denotes a central line of an ink flow path.

In the ink jet recording head of this embodiment, the ink flow path 83 is arranged such that its central line is located in a position offset from the central line of the electrothermal converting element 51. In addition, the discharge port 52 is arranged such that its center is located in a position offset by an offset amount X in the direction to the common liquid chamber 54 from the center of the pressure chamber 55. The discharge port 52 is provided with a taper on the side wall such that a cross section increases toward the inside of the pressure chamber 55. In FIG. 23A, the edge of the part of the discharge port 52 communicating to the pressure chamber 55, that is, a discharge port taper lower end 60 is shown by a broken line. As is apparent from the figure, in the ink jet recording head of this embodiment, the area occupied by the electrothermal converting element 51 is included in the area surrounded by the discharge port taper lower end 60 when it is viewed on a plane parallel to a plane of the pressure chamber 55 to which the discharge port 52 communicates. Since other configurations of the ink jet recording head of this embodiment are the same as those of the ink jet recording heads shown in the first to the fifth embodiments, detailed description of the configurations is omitted.

Next, states of ink and a bubble in a bubble disappearance process in this ink jet recording head will be described with reference to FIGS. 24A to 24F and FIGS. 25A to 25F. FIGS. 24A to 24F and FIGS. 25A to 25F show the bubble disappearance process in the order of FIGS. 24A to 24F and FIGS. 25A to 25F, respectively. FIGS. 24A to 24F are plan views showing a discharge port forming member in a state in which it is looked through and FIGS. 25 are sectional views cut along the ink flow path 83 direction. FIGS. 24A to 24F and FIGS. 25A to 25F show states at corresponding timings, respectively. Reference symbol C denotes an electrothermal converting element, G denotes a central line of an ink flow path and I denotes an ink droplet.

Figure 24A:
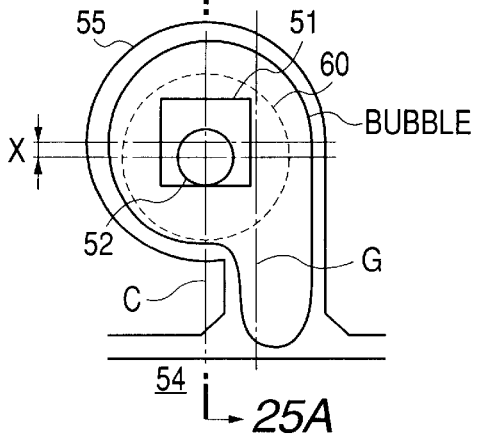
Figure 24D:
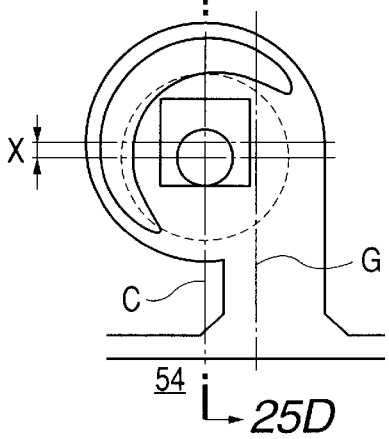
Figure 24B:
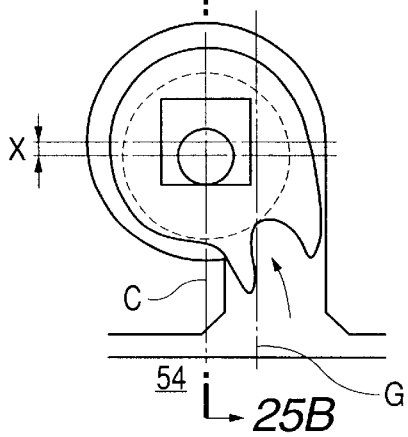
Figure 25A:
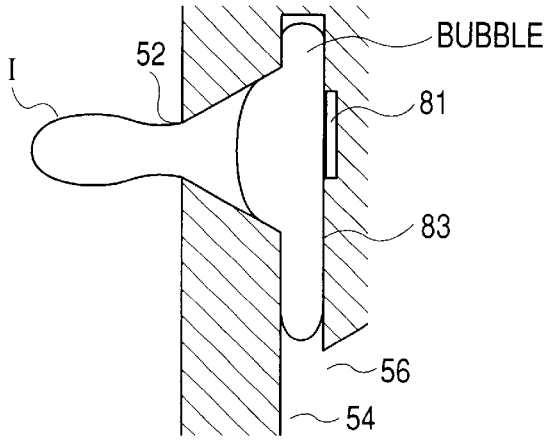
FIGS. 25A, 25B, 25C, 25D, 25E and 25F are sectional views cut along the lines 25A—25A, 25B—25B, 25C—25C, 25D—25D, 25E—25E and 25F—25F, respectively of FIGS. 24A to 24F and showing the bubble disappearance process of the ink jet recording head of FIGS. 23A and 23B.
Figure 25D:
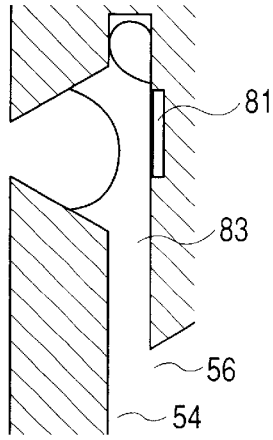
Figure 25B:
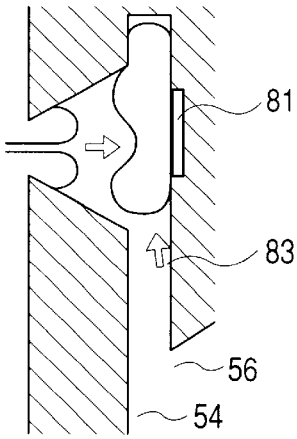
Figure 25E:
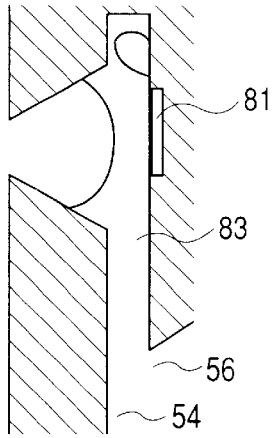
Figure 25C:
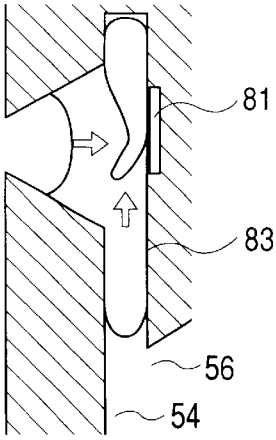
Figure 25F:
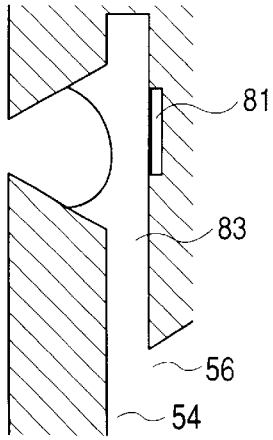

FIGS. 24A and 25A show a maximum bubbling state. Bubble disappearance is started from this state. Then, as shown in FIGS. 24B and 25B, ink starts to flow in from the common liquid chamber 54 side and the ink on the discharge port side between the discharge port 52 and the bubble starts to move in the direction of the electrothermal converting element 51.

Figure 24E:
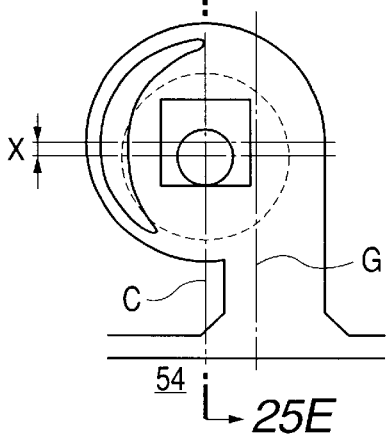
Figure 24C:
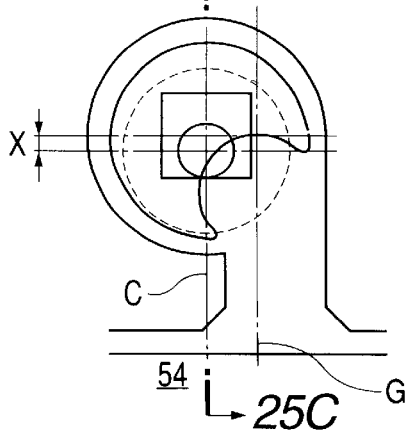
Figure 24F:
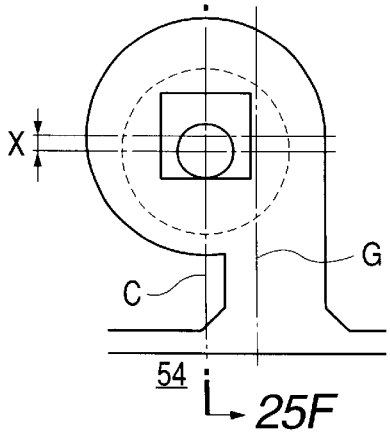

In this embodiment, since the discharge port 52 is arranged such that its center is offset more to the common liquid chamber 54 side than the center of the pressure chamber 55, the ink on the liquid chamber side covers a position where the ink on the discharge port side collides before the ink on the discharge port side reaches the electrothermal converting element 51. Thus, the ink on the discharge port side does not collide against the electrothermal converting element 51 to join the ink on the common liquid chamber side. At this point, the ink on the discharge port side is easy to move in the central part of the discharge port 55 and the ink contacting the taper wall surface of the discharge port 55 is hard to move. Thus, a force for causing a flow from the center of the discharge port 52 to the discharge port taper lower end 60, when it is viewed on a plane parallel to a surface to which the discharge port 52 communicates, acts on the ink depending on the ink on the discharge port side to join. Thus, as shown in FIGS. 24D and 24E as well as FIGS. 25D and 25E, the bubble is pushed by the ink to be unevenly distributed in the inner side of the pressure chamber 55 compared with the discharge port taper lower end 60 from the center of the discharge port 52 when it is viewed on a plane parallel to a surface to which the discharge port 52 communicates. Bubble disappearance occurs in this position, and the ink and the bubble are in a state shown in FIGS. 24F and 25F.

In this embodiment, the discharge port taper lower end 60 is positioned more outside than the electrothermal converting element 51 when it is viewed on a plane parallel to a surface to which the discharge port 52 communicates. Therefore, the bubble disappearance occurs in the outside of the electrothermal converting element 51 more surely. Thus, according to this embodiment, application of an impact to the electrothermal converting element 51 at the time of ink bubble disappearance can be prevented more surely and a durable life of the electrothermal converting element 51 can be further extended.

(Seventh Embodiment)

Figure 26B:
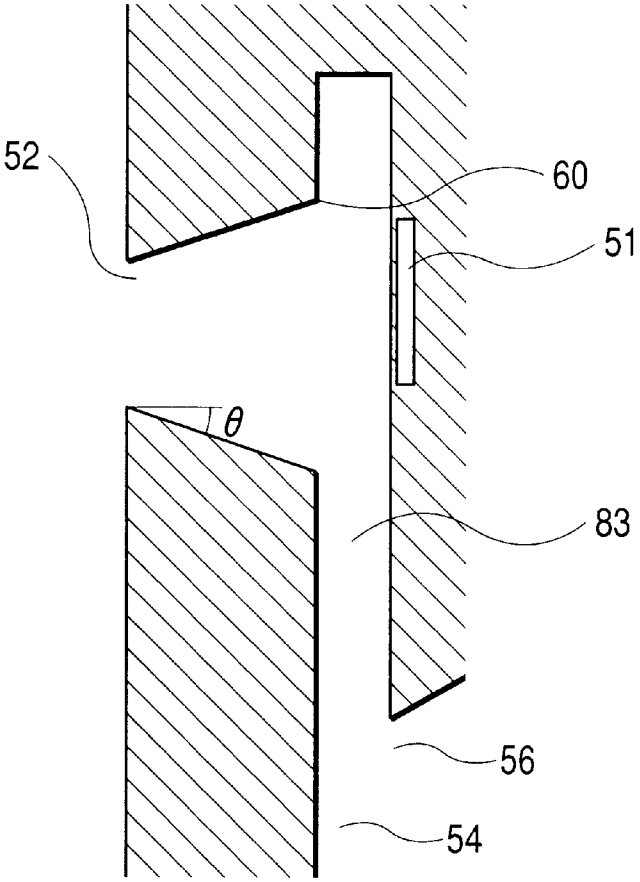
FIGS. 26A and 26B are schematic views showing a nozzle portion in accordance with a seventh embodiment of the ink jet recording head of the present invention.
Figure 26A:
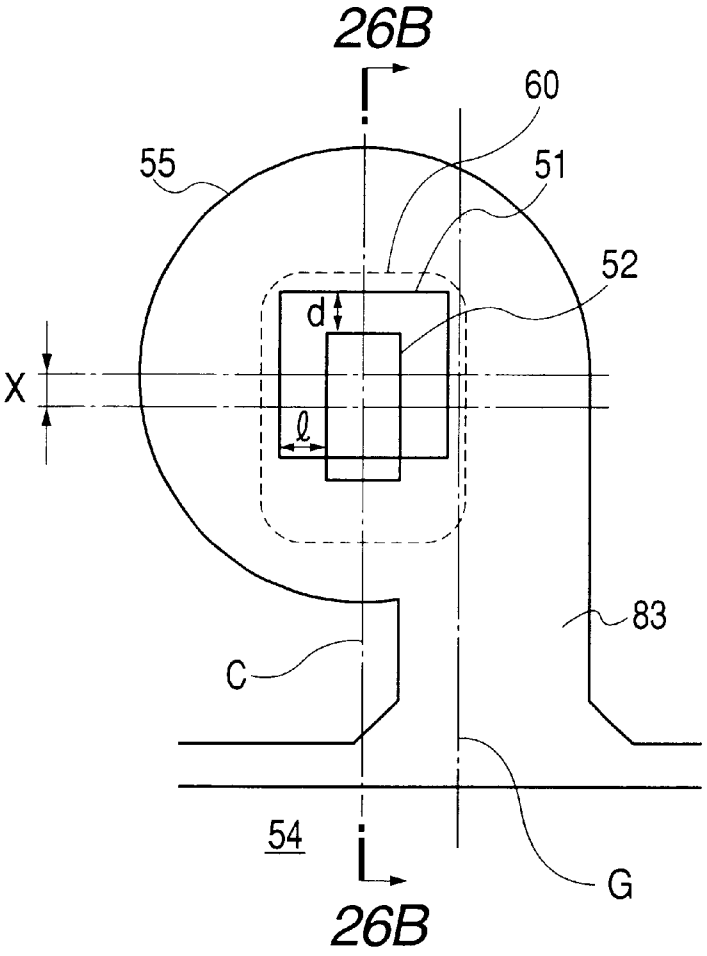

FIGS. 26A and 26B are schematic views showing a nozzle portion in accordance with a seventh embodiment of the ink jet recording head of the present invention. FIG. 26A is a plan view showing a discharge port forming member in a state in which it is looked through and FIG. 26B is a sectional view cut along the line 26B—26B of FIG. 26A. In the figures, reference symbol C denotes a central line of an electrothermal converting element and G denotes a central line of an ink flow path.

The ink jet recording head of this embodiment is different from the configuration of the sixth embodiment in that the discharge port 52 has a rectangular shape long in the direction offset from the center of the electrothermal converting element 51 in the center of the discharge port 52. Since other configurations of the ink jet recording head of this embodiment are the same as those of the sixth embodiment, detailed description of the configurations is omitted.

In the ink jet recording head of this embodiment, since the discharge port 52 has the above-mentioned shape, the ink jet recording head can be configured such that the discharge port taper lower end 60 encloses the electrothermal converting element 51 without making a taper angle e of the wall surface large. Thus, it becomes easy to form the discharge port 52. In addition, the size of the pressure chamber 55 can be made smaller. Therefore, it is possible to make an arrangement pitch of the discharge port 52 small and improve resolution.

Further, in this embodiment, it is desirable to make a distance $\alpha$ and a distance $\beta$ equal, which are a distance from the end of the edge of the opening on the ink discharge surface side to the end of the electrothermal converting element 1 of the discharge port 52 viewed in the opposite direction of the offset direction of the discharge port 52 and a distance from the end of the edge of the opening on the ink discharge surface side of the ink discharge port 52 to the end of the electrothermal converting element viewed in the direction perpendicular to the offset direction of the discharge port 52, respectively. Thus, a minimum size of the taper angle $\theta$ of the discharge port 55 will suffice.

In addition, although the example in which the shape of the discharge port 52 is rectangular is shown in this embodiment, the shape may be elliptical or oval.

(Eighth Embodiment)

Figure 27A:
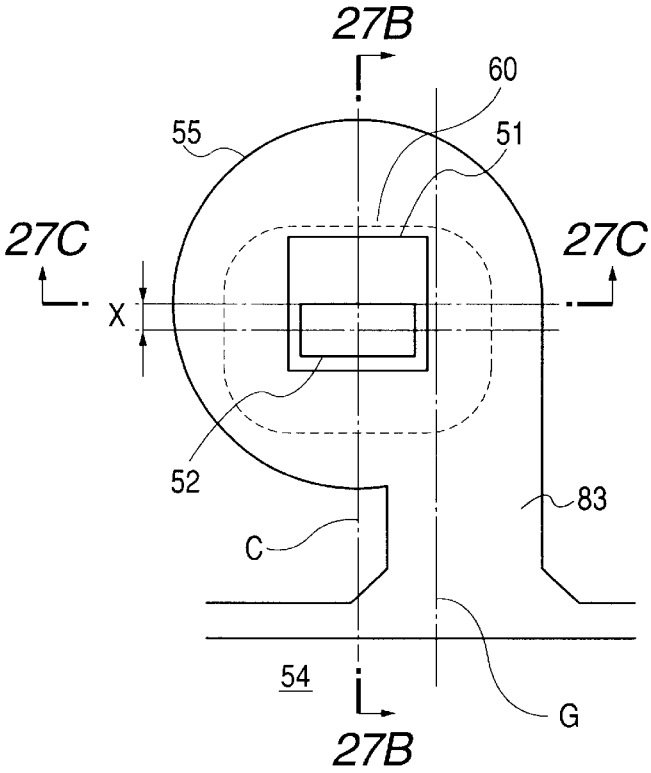
FIGS. 27A, 27B and 27C are schematic views showing a nozzle portion in accordance with an eighth embodiment of the ink jet recording head of the present invention.
Figure 27B:
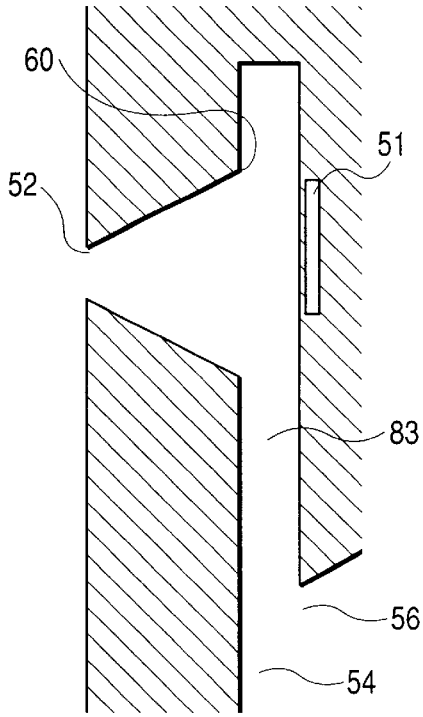
Figure 27C:
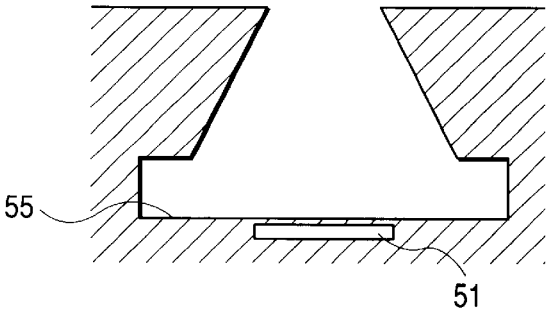

FIGS. 27A to 27C are schematic views showing a nozzle portion in accordance with an eighth embodiment of the ink jet recording head of the present invention. FIG. 27A is a plan view showing a discharge port forming member in a state in which it is looked through, FIG. 27B is a sectional view cut along the line 27B—27B of FIG. 27A, and FIG. 27C is a sectional view cut along the line 27C—27C of FIG. 27A. In the figures, reference symbol C denotes a central line of an electrothermal converting element and G denotes a central line of an ink flow path.

The ink jet recording head of this embodiment is different from the configuration of the sixth embodiment in that the discharge port 52 has a rectangular shape long in the direction in which wiring 62 of the electrothermal converting element 51 is connected. Since other configurations of the ink jet recording head of this embodiment are the same as those of the sixth embodiment, detailed description of the configurations is omitted.

According to this configuration, the connecting portion of the electrothermal converting element 51 and the wiring 62 can be positioned inside the area surrounded by the discharge port taper lower end 60. Therefore, it is possible to make it harder for an impact at the time of ink bubble disappearance to be applied to the connecting portion. Usually, the connecting portion is relatively weak to an impact because there is physically a step between the wiring 62 and the electrothermal converting element 51. According to this embodiment, since it is possible to make an impact not to be applied to this portion weak to an impact, durability of this portion can be improved and electrical reliability of the ink jet recording head can be improved.

Further, it is needless to mention that the shape of the discharge port 52 is not limited to rectangular and may be elliptical or oval.

As described above, according to the present invention, an ink flow path is arranged such that its central line is positioned offset from a central line of an electrothermal converting element, whereby influence on the electrothermal converting element due to cavitation can be reduced.

Moreover, an ink discharge port is arranged such that its center is positioned offset from the center of the electrothermal converting element, whereby ink between the discharge port and a bubble in a nozzle is controlled not to vertically collide against the electrothermal converting element at the time of bubble disappearance of the bubble, hence damage to the electrothermal converting element can be prevented to improve durability of the electrothermal converting element more remarkably.

In addition, a taper is provided on a discharge port wall surface in a manner that the cross section of the discharge port increases toward the pressure chamber side and the electrothermal converting element is positioned within an area surrounded by the edge of the opening on the pressure chamber side of the discharge port when it is viewed on a plane parallel to a connecting plane on the pressure chamber side of the discharge port, whereby it is possible to make bubble disappearance occur almost surely in an area outside the electrothermal converting element. Thus, the durability of the electrothermal converting element can be improved more remarkably.

In addition, a width, a height and the like are changed and a flow resistance is made uniform for a plurality of nozzles with different lengths of the ink flow path, whereby it is possible to provide an ink jet recording head that can perform high grade image recording with less unevenness of density.

As many apparently widely different embodiments of the present invention can be made without departing from the spirit and scope thereof, it is to be understood that the invention is not limited to the specific embodiments thereof except as defined in the appended claims.

What is claimed is:

1. An ink jet recording head, comprising:

a plurality of ink discharge ports for discharging ink;

a plurality of electrothermal converting elements that are provided to be associated with each of said ink discharge ports, respectively, for bubbling and discharging the ink;

a plurality of pressure chambers for containing said electrothermal converting elements and providing spaces for heating and bubbling said ink;

a common liquid chamber for supplying ink to said plurality of pressure chambers; and a plurality of ink flow paths for respectively communicating said pressure chambers with said common liquid chamber, wherein said ink flow paths are arranged such that central lines of said ink flow paths in a direction of ink supply to said pressure chambers at boundary portions between said ink flow paths and said pressure chambers are positioned offset from central lines of said electrothermal converting elements extending in the same direction, and wherein the centers of said ink discharge ports are arranged to be positioned offset from the centers of said electrothermal converting elements.

2. An ink jet recording head according to claim 1, wherein said pressure chamber has a substantially cylindrical shape.

3. An ink jet recording head according to claim 1, wherein the centers of said ink discharge ports are arranged to be positioned offset from the centers of said electrothermal converting elements toward said ink flow paths.

4. An ink jet recording head according to claim 1, wherein an amount of said offset between the centers of said ink discharge ports and the centers of said electrothermal converting elements is 1 to 10 $\mu$m.

5. An ink jet recording head according to claim 4, wherein the amount of said offset between the centers of said ink discharge ports and the centers of said electrothermal converting elements is 3 to 10 $\mu$m.

6. An ink jet recording head according to claim 1, wherein the centers of said electrothermal converting elements are arranged to be positioned offset from the centers of said pressure chambers.

7. An ink jet recording head according to claim 1, wherein an area occupied by said electrothermal converting element is included in an area surrounded by an edge of a portion of said ink discharge port communicating to said pressure chamber when it is viewed on a plane parallel to a surface to which said ink discharge port communicates.

8. An ink jet recording head according to claim 7, wherein said ink discharge port is provided with a taper on a side wall such that a cross section area increases toward said pressure chamber side.

9. An ink jet recording head according to claim 8, wherein a distance from an edge of an opening on said ink discharge surface side of said ink discharge port to an edge of said electrothermal converting element is substantially equal at an arbitrary position in a part where the area occupied by said electrothermal converting element goes over the edge of the opening on said ink discharge surface side of said ink discharge port when it is viewed on a plane parallel to a surface of said pressure chamber to which said ink discharge port communicates.

10. An ink jet recording head according to claim 7, wherein the center of said ink discharge port is arranged to be positioned offset from the center of said electrothermal converting element and said ink discharge port has a shape long in the direction offset from said electrothermal converting element.

11. An ink recording head according to claim 10, wherein said ink discharge port is rectangular.

12. An ink jet recording head according to claim 10, wherein said ink discharge port is elliptical.

13. An ink jet recording head according to claim 10, wherein said ink discharge port is oval.

14. An ink jet recording head according to claim 7, wherein said ink discharge port has a shape long in the direction in which wiring for supplying electric power to said electrothermal converting element is connected.

15. An ink jet recording head according to claim 14, wherein said ink discharge port is rectangular.

16. An ink jet recording head according to claim 14, wherein said ink discharge port is elliptical.

17. An ink jet recording head according to claim 14, wherein said ink discharge port is oval.

18. An ink jet recording head according to claim 1, wherein the offset directions of said ink flow paths from the central lines of said electrothermal converting elements are the same for said plurality of ink flow paths arranged in one row.

19. An ink jet recording head according to claim 1, wherein said plurality of ink flow paths have different lengths, and wherein flow resistances are substantially equal in said plurality of ink flow paths with different lengths.

20. An ink jet recording head according to claim 19, wherein a difference of the flow resistances in said plurality of ink flow paths is within 10%.

21. An ink jet recording head according to claim 19, wherein cross section areas of said plurality of ink flow paths with different lengths are different.

22. An ink jet recording head according to claim 21, wherein widths of said plurality of ink flow paths with different lengths are different.

23. An ink jet recording head according to claim 21, wherein heights of said plurality of ink flow paths with different lengths are different.

24. An ink jet recording head according to claim 19, wherein a rib is provided in at least any one of said plurality of ink flow paths.

25. An ink jet recording head according to claim 19, wherein a flow resistance per a unit length of an area on said common liquid chamber side of said ink flow path is smaller than the flow resistance of an area on said discharge port side of said ink flow path.

26. An ink jet recording head according to claim 19, wherein said plurality of ink discharge ports are arranged offset in a printing direction.

27. A method of manufacturing the ink jet recording head as described in claim 19, comprising the step of:

finding a flow resistance R of said ink flow path by expressions shown below and determining a shape of said ink flow path such that the flow resistances are equal in said plurality of ink flow paths based on the obtained flow resistance:

$$R = \eta \int_0^L \frac{D(x)}{S(x)^2}\, dx$$

$$D(x) = 12.0 \times \left(0.33 + 1.02 \times \left(\frac{a(x)}{b(x)} + \frac{b(x)}{a(x)}\right)\right)$$

where, x is a distance from said common liquid chamber;

S(x) is a cross section area of said ink flow path in a position of the distance x;

D(x) is a cross section coefficient of said ink flow path in the position of the distance x;

a(x) is a height of said ink flow path in the position of the distance x;

b(x) is a width of said ink flow path in the position of the distance x; and $\eta$ is an ink viscosity.

28. A method according to claim 27, wherein multiplications and additions are performed along a path in which a main flow of ink is generated, and S(x) and D(x) are obtained on a cross section perpendicular to the path.

29. A method of manufacturing the ink jet recording head as described in claim 19, comprising the step of:

finding the flow resistance R of said ink flow path by expressions shown below and determining a shape of said ink flow path such that the flow resistances are equal in said plurality of ink flow paths based on the obtained flow resistance:

$$R = \eta \sum_{n=1}^{k} \frac{D(x_n)(x_n - x_{n-1})}{S(x_n)^2}$$

$$D(x_n) = 12.0 \times \left(0.33 + 1.02 \times \left(\frac{a(x_n)}{b(x_n)} + \frac{b(x_n)}{a(x_n)}\right)\right)$$

where, k is a number of divisions of said ink flow path;

xn is a distance to an nth divided position when said ink flow path is divided into k parts;

S(xn) is a cross section area of said ink flow path in the position of the distance xn from the common liquid chamber;

D(xn) is a cross section coefficient of said ink flow path in the position of the distance xn from the common liquid chamber;

a(xn) is a height of said ink flow path in the position of the distance xn from the common liquid chamber;

b(xn) is a width of said ink flow path in the position of the distance xn from the common liquid chamber; and η is an ink viscosity.

30. A method according to claim 29, wherein multiplications and additions are performed along a path in which a main flow of ink is generated, and S(xn) and D(xn) are obtained on a cross section perpendicular to the path.

31. A method according to claim 28 or 30, wherein the multiplications and the additions are performed over said path from said common liquid chamber to the center of said electrothermal converting element.

32. An ink jet recording head, comprising:

a plurality of ink discharge ports for discharging ink;

a plurality of electrothermal converting elements that are provided to be associated with each of said ink discharge ports, respectively, for bubbling and discharging the ink;

a plurality of pressure chambers for containing said electrothermal converting elements and providing spaces for heating and bubbling said ink;

a common liquid chamber for supplying ink to said plurality of pressure chambers; and a plurality of ink flow paths for respectively communicating said pressure chambers with said common liquid chamber, wherein said ink flow paths are arranged such that central lines of said ink flow paths in a direction of ink supply to said pressure chambers at boundary portions between said ink flow paths and said pressure chambers are positioned offset from central lines of said electrothermal converting elements extending in the same direction, wherein the offset directions of said ink flow paths from the central lines of said electrothermal converting elements are the same for said plurality of ink flow paths arranged in one row, and wherein said ink flow paths are formed in two opposing rows side by side on both sides of said common liquid chamber, and wherein the offset directions of each of said ink flow paths from the central line of each of said electrothermal converting elements for said opposing ink flow path rows are symmetrical with respect to a line parallel with a row direction of said opposing ink flow path rows.

33. An ink jet recording head, comprising:

a plurality of ink discharge ports for discharging ink;

a plurality of electrothermal converting elements that are provided to be associated with each of said ink discharge ports, respectively, for bubbling and discharging the ink;

a plurality of pressure chambers for containing said electrothermal converting elements and providing spaces for heating and bubbling said ink;

a common liquid chamber for supplying ink to said plurality of pressure chambers; and a plurality of ink flow paths for respectively communicating said pressure chambers with said common liquid chamber, wherein said ink flow paths are arranged such that central lines of said ink flow paths in a direction of ink supply to said pressure chambers at boundary portions between said ink flow paths and said pressure chambers are positioned offset from central lines of said electrothermal converting elements extending in the same direction, and wherein side walls of said pressure chambers facing said ink flow paths have no acute corner.

34. An ink jet recording head according to claim 33, wherein said pressure chamber has a substantially cylindrical shape.

35. An ink jet recording head, comprising:

a plurality of ink discharge ports for discharging ink;

a plurality of electrothermal converting elements that are provided to be associated with each of said ink discharge ports, respectively, for bubbling and discharging the ink;

a plurality of pressure chambers for containing said electrothermal converting elements and providing spaces for heating and bubbling said ink;

a common liquid chamber for supplying ink to said plurality of pressure chambers; and a plurality of ink flow paths for respectively communicating said pressure chambers with said common liquid chamber, wherein said ink flow paths are arranged such that central lines of said ink flow paths in a direction of ink supply to said pressure chambers at boundary portions between said ink flow paths and said pressure chambers are positioned offset from central lines of said electrothermal converting elements extending in the same direction, and wherein ink flows into said pressure chambers from respective single entrances.

36. An ink jet recording head according to claim 35, wherein said single entrances are spaced from said central lines of said electrothermal converting elements, respectively.

* * * * *

UNITED STATES PATENT AND TRADEMARK OFFICE

CERTIFICATE OF CORRECTION

PATENT NO. : 6,652,079 B2
DATED : November 25, 2003
INVENTOR(S) : Ken Tsuchii et al.

It is certified that error appears in the above-identified patent and that said Letters Patent is hereby corrected as shown below:

Column 14,
Line 53, ‘predetermine” should read -- predetermined --.

Column 22,
Line 17, “an” should read -- a --.

Column 23,
Line 5, “an” should read -- a --.

Column 33,
Line 50, “an” should be deleted.

Column 35,
Line 41, “respect” should read -- respect to --.

Column 41,
Line 6, “he” should read -- the --.

Column 43,
Line 11, “he” should read -- the --.

Column 44,
Line 5, “arrange” should read -- arranged --.

Column 47,
Line 18, “e” should read -- θ --.

Signed and Sealed this

Sixth Day of July, 2004

JON W. DUDAS
*Acting Director of the United States Patent and Trademark Office*